US006445367B1

(12) United States Patent
Suzuki et al.

(10) Patent No.: US 6,445,367 B1
(45) **Date of Patent: *Sep. 3, 2002**

(54) ELECTRON-BEAM GENERATING DEVICE HAVING PLURALITY OF COLD CATHODE ELEMENTS, METHOD OF DRIVING SAID DEVICE AND IMAGE FORMING APPARATUS APPLYING SAME

(75) Inventors: Noritake Suzuki, Atsugi; Hidetoshi Suzuki, Fujisawa; Kunihiro Sakai, Isehara; Takahiro Oguchi, Yamato, all of (JP)

(73) Assignee: Canon Kabushiki Kaisha, Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/489,391

(22) Filed: Jun. 12, 1995

(30) Foreign Application Priority Data

Jun. 13, 1994 (JP) ..... 6-130371
Dec. 28, 1994 (JP) ..... 6-328016
Jun. 7, 1995 (JP) ..... 7-140578

(51) Int. Cl.[7] ..... G09G 3/22
(52) U.S. Cl. ..... 345/75.2
(58) Field of Search ..... 345/74, 74.1, 75.2, 345/75.1; 315/169.1, 169.3, 169.4, 366, 167, 174, 175; 313/309, 336, 495

(56) References Cited

U.S. PATENT DOCUMENTS 3,938,034 A * 2/1976 Japenga ..... 325/20 R (List continued on next page.)

FOREIGN PATENT DOCUMENTS

EP 0278405 8/1988
EP 0299461 1/1989

(List continued on next page.)

OTHER PUBLICATIONS

"Electrical Conduction and Electron Emission of Discotinuous Thin Films" by G. Dittmer; Thin Solid Films, 9(1972) pp. 317–328.

(List continued on next page.)

*Primary Examiner*—Amare Mengistu
(74) *Attorney, Agent, or Firm*—Fitzpatrick, Cella, Harper & Scinto

(57) ABSTRACT

A method and apparatus for driving an electron source in which a high-quality image display is presented by correcting a non-uniform effective current distribution caused in cold cathode elements by leakage current. A digital video signal enters a shift register where a serial-to-parallel conversion is made for each line of an image based upon a shift clock signal. One line of the image data that has been subjected to the serial-to-parallel conversion is latched in a latch circuit and then applied to a voltage modulating circuit. The latter voltage-modulates the input data and sends the modulated signal to a voltage/current converting circuit. The latter converts the voltage quantity to a current quantity, which is applied to each of the cold cathode elements of a display panel through respective column terminals. A voltage V1 is applied to the selected row wire, and a voltage V2 (V2≠V1) is applied to all other row wires, for controlling the leakage current.

73 Claims, 49 Drawing Sheets

U.S. PATENT DOCUMENTS

| | | | | | |
|---|---|---|---|---|---|
| 4,904,895 | A | | 2/1990 | Tsukamoto et al. | 313/336 |
| 4,954,744 | A | | 9/1990 | Suzuki et al. | 313/336 |
| 4,956,578 | A | | 9/1990 | Shimizu et al. | 315/1 |
| 5,066,883 | A | | 11/1991 | Yoshioka et al. | 313/309 |
| 5,155,416 | A | | 10/1992 | Suzuki et al. | 315/366 |
| 5,235,254 | A | * | 8/1993 | Ho | 315/219 |
| 5,300,862 | A | | 4/1994 | Parker et al. | 315/169.1 |
| 5,404,081 | A | * | 4/1995 | Kane et al. | 315/169.1 |
| 5,446,720 | A | * | 8/1995 | Oguchi et al. | 369/126 |
| 5,578,906 | A | * | 11/1996 | Smith | 315/169.3 |
| 5,583,528 | A | * | 12/1996 | Ebihara | 345/58 |
| 5,659,329 | A | | 8/1997 | Yamanobe et al. | 345/74 |

FOREIGN PATENT DOCUMENTS

| | | | | |
|---|---|---|---|---|
| EP | 0573754 | | 12/1993 | |
| EP | 0596242 | | 5/1994 | |
| JP | 52-6492 | | 1/1977 | |
| JP | 56-138792 | | 10/1981 | |
| JP | 57-191692 | | 11/1982 | |
| JP | 59-45708 | * | 3/1984 | |
| JP | 01031332 | | 2/1989 | H01J/029/48 |
| JP | 02257551 | | 10/1990 | H01J/031/15 |
| JP | 03055738 | | 3/1991 | H01J/001/30 |
| JP | 04028137 | | 1/1992 | H01J/001/30 |
| JP | 4-289644 | | 10/1992 | |
| JP | 5-242793 | | 9/1993 | |
| JP | 6-67621 | | 3/1994 | |
| JP | 6-289814 | | 10/1994 | |

OTHER PUBLICATIONS

"Operation of Tunnel–Emission Devices" by C.A. Mead; Journal of Applied Physics; vol. 32, No. 4; Apr. 1961 pp. 646–652.

"Physical properties of thin–film field emission cathodes with molybdenum cones" by C.A. Spindt et al. Journal of Applied Physics. vol. 47, No. 12; Dec. 1976; pp. 5248–5263.

"Strong Electron Emission From Patterned Tin–Indium Oxide Thin Films" by M. Hartwell et al.; Int'l Electron Devices Mtg. Washington,D.C. 1975; pp. 519–521.

"Field Emission" by W.P. Dyke et al. Advances in Electronics and Electron Physics; 1956; Academic Press Inc., New York, N.Y. pp. 89–185.

"The Emission of Hot Electrons and The Field Emission of Electrons From Tin Oxide" by M.I. Elinson et al.; Radio Engineering and Electronic Physics; Jul. 1965; pp. 1290–1296.

"Electroforming and Eelctron Emission of Carbon Thin Films" by H. Araki et al. Journal of the Vacuum Society of Japan; vol. 26, No. 1 pp. 22–28.

"Recent Deveopment on Microtips Display at Leti"' by R. Meyer et al. Technical Digest of IVMC 91, Nagahama 1991; pp. 6–9.

* cited by examiner $$\begin{cases} IA = ICC3 + IL \\ ICC3 \cdot Rc = 3 \cdot IL \cdot Rc \end{cases}$$

$$ICC3 = \frac{3}{4} IA$$

$$\begin{cases} IA = ICC3 + IL1 \\ ICC3 \cdot Rc - 2 \cdot IL2 \cdot Rc - IL1 \cdot Rc = 0 \\ IL2 = \dfrac{V2 - V1}{2 \cdot Rc} \end{cases}$$

$$IL1 = \frac{1}{2}\left(IA - \frac{V2 - V1}{Rc}\right)$$

$$ICC3 = \frac{1}{2}\left(IA + \frac{V2 - V1}{Rc}\right)$$

$$\begin{cases} IA = IB \\ IA = ICC3 + IL1 \\ V1 - V2 - IL1 \cdot Rc + ICC3 \cdot Rc = 0 \end{cases}$$

$$IL1 = \frac{1}{2}\left(IA - \frac{V2 - V1}{Rc}\right)$$

$$ICC3 = \frac{1}{2}\left(IA + \frac{V2 - V1}{Rc}\right)$$

HSYNC

ADDRESS OF SELECTED ELEMENT

VIDEO LUMINANCE SIGNAL

LUT1

LUT2

WAVEFORM OF ELEMENT CURRENT If : tot (M,1)

WAVEFORM OF EMISSION CURRENT Ie

ELECTRON-BEAM GENERATING DEVICE HAVING PLURALITY OF COLD CATHODE ELEMENTS, METHOD OF DRIVING SAID DEVICE AND IMAGE FORMING APPARATUS APPLYING SAME

BACKGROUND OF THE INVENTION

1. Field of the Invention

This invention relates to an electron-beam generating device having a plurality of matrix-wired cold cathode elements and to a method of driving the device. The invention further relates to an image forming apparatus to which the electron-beam generating device is applied, particularly a display apparatus using phosphors as image forming members.

2. Description of the Related Art

Two types of elements, namely thermionic cathode elements and cold cathode elements, are known as electron emission elements. Examples of cold cathode elements are surface-conduction electron emission elements, electron emission elements of the field emission type (abbreviated to "FE" below) and metal/insulator/metal type (abbreviated to "MIM" below).

An example of the surface-conduction electron emission element is described by M. I. Ellinson, Radio. Eng. Electron Phys., 10, 1290 (1965). There are other examples as well, as will be described later.

The surface-conduction electron emission element makes use of a phenomenon in which electron emission is produced in a small-area thin film, which has been formed on a substrate, by passing a current parallel to the film surface. Various examples of this surface-conduction electron emission element have been reported. One relies upon a thin film of $SnO_2$ according to Ellinson, mentioned above. Other examples use a thin film of Au [G. Dittmer: "Thin Solid Films", 9, 317 (1972)]; a thin film of $In_2O_3/SnO_2$ (M. Hartwell and C. C. G. Fonstad: "IEEE Trans. E.D. Conf.", 519 (1975); or a thin film of carbon (Hisashi Araki, et al: "Shinkuu", Vol. 26, No. 1, p. 22 (1983).

FIG. 1 is a plan view of the element according to M. Hartwell, et al., described above. This element construction is typical of these surface-conduction electron emission elements. As shown in FIG. 1, numeral 3001 denotes a substrate. Numeral 3004 denotes an electrically conductive thin film comprising a metal oxide formed by sputtering. The conductive film 3004 is subjected to an electrification process referred to as "energization forming", described below, whereby an electron emission portion 3005 is formed. The spacing L in FIG. 1 is set to 0.5~1 mm, and the spacing W is set to 0.1 mm. For the sake of illustrative convenience, the electron emission portion 3005 is shown to have a rectangular shape at the center of the conductive film 3004. However, this is merely a schematic view and the actual position and shape of the electron emission portion are not represented faithfully here.

In above-mentioned conventional surface-conduction electron emission elements, especially the element according to Hartwell, et al., generally the electron emission portion 3005 is formed on the conductive thin film 3004 by the so-called "energization forming" process before electron emission is performed. According to the forming process, a constant DC voltage or a DC voltage which rises at a very slow rate on the order of 1 V/min is impressed across the conductive thin film 3004 to pass a current through the film, thereby locally destroying, deforming or changing the property of the conductive thin film 3004 and forming the electron emission portion 3005, the electrical resistance of which is very high. A fissure is produced in part of the conductive thin film 3004 that has been locally destroyed, deformed or changed in property. Electrons are emitted from the vicinity of the fissure if a suitable voltage is applied to the conductive thin film 3004 after energization forming.

Known examples of the FE type are described in W. P. Dyke and W. W. Dolan, "Field emission", Advances in Electron Physics, 8, 89 (1956), and in C. A. Spindt, "Physical Properties of Thin-Film Field Emission cathodes with Molybdenum Cones", J. Appl. Phys., 47, 5248 (1976).

A typical example of the construction of an FE-type element is shown in FIG. 2, which is a sectional view of the element according to Spindt, et al., described above. The element includes a substrate 3010, emitter wiring 3011 comprising an electrically conductive material, an emitter cone 3012, an insulating layer 3013 and a gate electrode 3014. The element is caused to produce a field emission from the tip of the emitter cone 3012 by applying an appropriate voltage across the emitter cone 3012 and gate electrode 3014.

In another example of the construction of an FE-type element, the stacked structure of the kind shown in FIG. 2 is not used. Rather, the emitter and gate electrode are arranged on the substrate in a state substantially parallel to the plane of the substrate.

A known example of the MIM type is described by C. A. Mead, "Operation of Tunnel Emission Devices", J. Appl. Phys., 32, 646 (1961). FIG. 3 is a sectional view illustrating a typical example of the construction of the MIM-type element. The element includes a substrate 3020, a lower electrode 3021 consisting of a metal, a thin insulating layer 3022 having a thickness on the order of 100 Å, and an upper electrode 3023 consisting of a metal and having a thickness on the order of 80~300 Å. The element is caused to produce a field emission from the surface of the upper electrode 3023 by applying an appropriate voltage across the upper electrode 3023 and lower electrode 3021.

Since the above-mentioned cold cathode element makes it possible to obtain an electron emission at a lower temperature in comparison with a thermionic cathode element, a heater for applying heat is unnecessary. Accordingly, the structure is simpler than that of the thermionic cathode element and it is possible to fabricate elements that are finer. Further, even though a large number of elements are arranged on a substrate at a high density, problems such as fusing of the substrate do not readily arise. In addition, the cold cathode element differs from the thermionic cathode element in that the latter has a slow response speed because it is operated by heat produced by a heater. Thus, an advantage of the cold cathode element is a quicker response speed.

For these reasons, extensive research into applications for cold cathode elements is being carried out.

By way of example, among the various cold cathode elements, the surface-conduction electron emission element is particularly simple in structure and easy to manufacture and therefore is advantageous in that a large number of elements can be formed over a large area. Accordingly, research has been directed to a method of arraying and driving a large number of elements, as disclosed in Japanese Patent Application. Laid-Open (Kokai) No. 64-31332, filed by the assignee of the present invention.

Applications of surface-conduction electron emission elements that have been researched are image forming apparatus such as image display apparatus and image recording apparatus, charged beam sources, etc.

As for applications to image display apparatus, research has been conducted with regard to such an apparatus using, in combination, surface-conduction type electron emission elements and phosphors which emit light in response to irradiation with an electron beam, as disclosed, for example, in the specifications of U.S. Pat. No. 5,066,883 and Japanese Patent Application Laid-Open (KOKAI) Nos. 2-257551 and 4-28137 filed by the assignee of the present invention. The image display apparatus using the combination of the surface-conduction type electron emission elements and phosphors is expected to have characteristics superior to those of the conventional image display apparatus of other types. For example, in comparison with. a liquid-crystal display apparatus that have become so popular in recent years, the above-mentioned image display apparatus emits its own light and therefore does not require back-lighting. It also has a wider viewing angle.

A method of driving a number of FE-type elements in a row is disclosed, for example, in the specification of U.S. Pat. No. 4,904,895 filed by the present applicant. A flat-type display apparatus reported by Meyer et al., for example, is known as an example of an application of an FE-type element to an image display apparatus. [R. Meyer: "Recent Development on Microtips Display at LETI", Tech. Digest of 4th Int. Vacuum Microelectronics Conf., Nagahara, pp. 6~9, (1991).]

An example in which a number of MIM-type elements are arrayed in a row and applied to an image display apparatus is disclosed in the specification of Japanese Patent Application Laid-Open No. 3-55738 filed by the assignee of the present invention.

Under these circumstances, the inventors have conducted exhaustive research with regard to multiple electron sources. FIG. 4A shows an example of a method of wiring a multiple electron source. In FIG. 4A, a total of n×m cold cathode elements are wired two-dimensionally in matrix form, with m-number of elements arrayed in the vertical direction and n-number in the horizontal direction. In FIG. 4A, numeral 3074 denotes a cold cathode element, 3072 row-direction wiring, 3073 column-direction wiring, 3075 wiring resistance of the row-direction wiring 3072 and 3076 wiring resistance of the column-direction wiring 3073. Further, Dx1, Dx2, . . . Dxm represent a feed terminals for the row-direction wiring. Further, Dy1, Dy2, . . . Dyn represent feed terminals for the column-direction wiring. This simple wiring method is referred to as a "matrix wiring method". Since the matrix wiring method involves a simple structure, fabrication is easy.

In a case where a multiple electron beam source constructed using the matrix wiring method is applied to an image display apparatus, it is preferred that m and n each be a number of several hundred or more in order to assure display capacity. In addition, it is required that an electron beam of desired intensity be capable of being produced from each cold cathode element in order to display an image at a correct luminance.

In a case where a large number of matrix-wired cold cathode elements are driven in the prior art, the method adopted is to drive the group of elements on one row of the matrix simultaneously. Rows driven are successively changed over one by one so that all rows are scanned. In accordance with this method, drive time allocated to each element is lengthened by a factor of n in comparison with the method of scanning all elements successively one element at a time, thus making it possible to raise the luminance of the display apparatus.

One example of this is a method of driving FE-type elements disclosed by Parker et al. (U.S. Pat. No. 5,300,862). FIG. 4B is a circuit diagram for describing this method.

Numerals 2201A~2201C in FIG. 4B denote controlled constant-current sources, 2202 a switching circuit, 2203 a voltage source, 2204A a column wire, 2204B a row wire and 2205 an FE-type element.

The switching circuit 2202 selects one of the row wires 2204B and connects it to the voltage source 2203. The controlled constant-current sources 2201A~2201C supply current to each column wire 2204A. By carrying out these operations synchronously in suitable fashion, one row of FE-type elements is driven.

However, when a matrix-wired multiple electron beam source is actually driven by the above-described drive method, a problem which arises is that the intensity of the electron beam outputted from each cold cathode element deviates from the desired value. This results in unevenness or fluctuation in the luminance of the display image and, hence, a decline in picture quality.

This problem will be described in greater detail with reference to FIGS. 5A~7B. In order to avoid overly complicated drawings, FIGS. 5A~7B illustrate only one row (n pixels) of the m×n pixels. Each pixel is provided to correspond to a respective cold cathode element. The farther to the right the position is taken, the more distant the position is from the feed terminal Dx of the row wiring 3072. For the sake of simplifying the description, luminance levels are represented by numerical values, the maximum value is 255, the minimum value is 0 and the intermediate values grow successively larger by 1.

FIG. 5A illustrates an example of a desired display pattern, in which it is desired that only the right-most pixel be made to emit light at the luminance 255. FIG. 5B illustrates measurement of the-luminance of an image displayed by actually driving the cold cathode elements.

FIG. 6A illustrates another example of a desired displayed pattern, in which it is desired that the group of pixels on the left half of the row be made to emit no light (luminance 0) and that the group of pixels on the right half of the row be made to emit light at luminance 255. FIG. 6B illustrates measurement of the luminance of an image displayed by actually driving the cold cathode elements.

FIG. 7A illustrates another example of a desired displayed pattern, in which it is desired that all pixels of the row be made to emit light at luminance 255. FIG. 7B illustrates measurement of the luminance of an image displayed by actually driving the cold cathode elements.

Thus, as evident from these examples, the luminance of the actual display image deviates from the desired luminance. Moreover, if attention is directed toward the pixel indicated by arrow P in these Figures, it will be apparent that the magnitude of the deviation from the desired luminance is not necessarily constant.

As a consequence, the luminance of the displayed image is inaccurate and unstable.

Further, as shown in these Figures, undesirable light as indicated by q is emitted.

Furthermore, there are cases where pixels emit light even in rows that should not have been selected. (This phenomenon is not shown.)

For these reasons, the contrast of the image declines and picture quality deteriorates markedly.

SUMMARY OF THE INVENTION

Accordingly, an object of the present invention is to obtain a correct and fluctuation-free intensity for the electron beams produced by a multiple electron beam source having matrix-wired cold cathode elements, to prevent a deviation and fluctuation in the display luminance of an image display apparatus as well as a decline in contrast.

The foregoing object is attained by the apparatus and drive method according to the present invention described below.

Specifically, the present invention provides an electron-beam generating device comprising: a plurality of cold cathode elements arrayed in the form of rows and columns on a substrate; m-number of row wires and n-number of column wires for wiring the plurality of cold cathode elements into a matrix; and drive signal generating means for generating signals which drive the plurality of cold cathode elements one row at a time; the drive signal generating means including: current-waveform determining means for determining a current waveform, which will be passed through each of the n-number of column wires, on the basis of an externally entered electron-beam demand value; current applying means for passing the current, which has been determined by the current-waveform determining means, through each column wire; and voltage applying means for applying a voltage V1 to a row wire of a row selected from the m-number of row wires and applying a voltage V2 to all other row wires.

Further, the present invention provides a method of driving an electron-beam generating device having a plurality of cold cathode elements arrayed in the form of rows and columns on a substrate, m-number of row wires and n-number of column wires for wiring the plurality of cold cathode elements into a matrix, and drive signal generating means for generating signals which drive the plurality of cold cathode elements one row at a time; the drive method comprising: a current-waveform determining step of determining a current waveform, which will be passed through each of the n-number of column wires, on the basis of an externally entered electron-beam demand value; a current applying step of passing the current, which has been determined at the current-waveform determining step, through each column wire; and a voltage applying step of applying a voltage V1 to a row wire of a row selected from the m-number of row wires and applying a voltage V2 to the other row wires.

In order to clarify the actions of the device and drive method of the present invention as set forth above, problems encountered in the conventional drive method will be described with reference to the drawings.

As the result of exhaustive research, the inventors have discovered that when a drive pattern is altered as shown in FIGS. 5A, 6A, 7A according to the drive method of the prior art, the effective drive current which flows into a desired cold cathode element experiences a large amount of fluctuation. This will be described in connection with the conventional drive method with reference to FIGS. 8A, 8B, 9A and 9B.

FIG. 8A is a diagram showing the way in which current flows in a case where drive is performed by the method of FIG. 4B. In order to facilitate the description, a 2×2 matrix is used and the wiring resistance is omitted. In FIG. 8A, CC1~CC4 represent cold cathode elements.

FIG. 8A illustrates a case in which only the element CC3 among the four elements is driven. In order to drive the element CC3, the switching circuit 2202 selects row wire Dx2 and connects it to the voltage source 2203. Meanwhile, the controlled constant-current source 2201A outputs a current IA to drive the cold cathode element CC3. The controlled constant-current source 2201B does not output any current.

In this case, the current IA is split into a current ICC3 and a current IL. Of these, the current ICC3 is a drive current which effectively acts to drive the cold cathode element CC3. The other current IL is leakage current. An equivalent circuit for calculating the current ICC3 is illustrated in FIG. 8B. To simplify the description, the resistance of each cold cathode element is indicated as Rc and the resistance of the cold cathode element CC3 particularly is encircled. When the equation shown in FIG. 8B are solved, the result obtained is ICC3=3·(IA)/4.

Next, an example in which the drive pattern is changed is shown in FIG. 9A, which shows a case in which the cold cathode elements CC3 and CC4 are driven simultaneously. The switching circuit 2202 selects row wire Dx2 and connects it to the voltage source 2203. Meanwhile, the controlled constant-current sources 2201A and 2201B output currents to drive the cold cathode elements CC3 and CC4. In a case where outputs of identical strength are sought from the cold cathode elements CC3 and CC4, it will suffice to establish the relation IA=IB. In such case no leakage current flows into the cold cathode elements CC1 and CC2. Accordingly, we have ICC3=IA, as evident from the equivalent circuit shown in FIG. 9B.

A comparison of FIGS. 8A and 9A clearly shows that regardless of the fact that the same current IA flows from the controlled, constant current source 2201A, the drive current ICC3 which effectively flows into the cold cathode element CC3 fluctuates. In other words, with the method of the prior art, the leakage current IL is not controlled and fluctuation occurs.

By contrast, in accordance with the above-described device or drive method of the present invention, it is possible to control the leakage current IL so as to have a constant magnitude. As a result, a constant drive current can be supplied to the cold cathode elements at all times even if the drive pattern is changed. The situation in the case of this invention will be described with reference to FIGS. 10A, 10B, 11A, 11B.

FIG. 10A should be compared with FIG. 8A. That is, FIG. 10A shows a case in which only the cold cathode element CC3 is driven. According to the present invention, a potential V1 is applied to a selected row wire (i.e., Dx2) and a potential V2 is applied to all unselected row wires (i.e., Dx1). In the example of FIG. 10A, a switching circuit 502 and voltage sources V1, V2 cooperate to perform this operation.

Output current IA from the a controlled constant-current source splits into a drive current ICC3 and a leakage current IL1. In the case of this invention, the leakage current IL1 is controlled by the voltages V1 and V2. A constant current IL2 flows into the cold cathode elements CC2 and CC4 as long as the output of the controlled constant-current source 501B is zero.

The drive current ICC3 and leakage current IL1 are obtained from the equivalent circuit and equations of FIG. 10B:

$$ICC3 = \frac{1}{2}\left(IA + \frac{V2 - V1}{Rc}\right)$$

$$IL1 = \frac{1}{2}\left(IA - \frac{V2 - V1}{Rc}\right)$$

FIG. 11A should be compared with FIG. 9A. That is, this is for a case in which the cold cathode elements CC3 and CC4 are driven simultaneously. In this case also the potential V1 is applied to a selected row wire (i.e., Dx2) and the potential V2 is applied to all unselected row wires (i.e., Dx1).

The drive current ICC3 and leakage current IL1 are obtained from the equivalent circuit and equations of FIG. 10B:

$$ICC3 = \frac{1}{2}\left(IA + \frac{V2 - V1}{Rc}\right)$$

$$IL1 = \frac{1}{2}\left(IA - \frac{V2 - V1}{Rc}\right)$$

Thus, according to the present invention, as evident from the foregoing examples, the leakage current IL1 can be controlled so as to be constant, as a result of which the drive current ICC3 of the cold cathode elements does not fluctuate even if the drive pattern is altered.

Accordingly, the fluctuation in output which was a problem in the prior art can be prevented. Further, since the magnitude of the leakage current can be controlled by V1 and V2, setting suitable voltage values makes it possible to prevent unnecessary electrons from being outputted by the cold cathode elements of an unselected row as a result of leakage current.

There are instances in which the leakage current flows through a parasitic conduction path besides the cold cathode elements themselves.

There are many cases in which the parasitic conduction path is formed about the periphery of the cold cathode elements or at the periphery of the member insulating the row wires from the column wires.

As a typical example of the former, consider the case of a surface-conduction electron emission element. If the surface of the substrate at the periphery of the element is soiled by electrically conductive matter 3006, a leakage current will flow (see FIG. 1).

In the case of an FE-type element, a leakage current will flow if an insulating layer 3013 is flawed or the surface of the insulating layer 3013 is soiled by electrically conductive matter 3015 (see FIG. 2).

In the case of an MIM-type element, a leakage current will flow if an insulating layer 3022 is flawed or the surface of the insulating layer 3022 is soiled by electrically conductive matter 3024 (see FIG. 3).

As a typical example of the latter, consider a case where an insulating layer provided at the solid cross section of a column wire and row wire is flawed or the surface of the insulating layer is soiled by electrically conductive matter. A leakage current will flow through the affected portion. This occurs irrespective of the type of cold cathode element.

The present invention is effective in dealing with such leakage currents ascribable to these causes.

In the electron-beam generating device according to the present invention, the current-waveform determining means comprises means for outputting the current waveform, which has been determined on the basis of the electron-beam demand value, as a voltage signal that has been amplitude-modulated or pulse-width modulated, and the current applying means comprises a voltage/current converting circuit.

In the drive method of the present invention, the current-waveform determining step comprises a step of outputting the current waveform, which has been determined on the basis of the electron-beam demand value, as a voltage signal that has been amplitude-modulated or pulse-width modulated, and the current applying step comprises a step of converting a voltage signal to a current signal.

In accordance with the device or drive method described above, once the modulated signal has been outputted in the form of a voltage signal, it is converted to a current signal. This means that the arrangement of the electrical circuitry of the controlled constant-current sources becomes very simple.

Further, in the electron-beam generating device according to the present invention, the current-waveform determining means comprises element-current determining means for determining an element current, which is to be passed through a cold cathode element of a selected row (a row to which the voltage V1 has been applied), on the basis of the externally entered electron-beam demand value and an output characteristic of the cold cathode element, and correcting means for correcting the element current determined by the electron-element current determining means.

The correcting means includes leakage-current determining means for determining a leakage-current passed through an unselected row (a row to which the voltage V2 has been applied), and adding means for adding an output value from the element-current determining means and an output value from the leakage-current determining means.

In the drive method of the present invention, the current-waveform determining step comprises an element-current determining step of determining an element current, which is to be passed through a cold cathode element of a selected row (a row to which the voltage V1 has been applied), on the basis of the externally entered electron-beam demand value and an output characteristic of the cold cathode element, and a correcting step of correcting the element current determined at the electron-element current determining step.

The correcting step includes a leakage-current determining step of determining a leakage current passed through an unselected row (a row to which the voltage V2 has been applied), and an adding step of adding an output value obtained at the element-current determining step and an output value obtained at the leakage-current determining step.

In accordance with the device or drive method described above, an accurate drive current can be supplied to a cold cathode element and, hence, an accurate output can be obtained. In particularly, the degree of accuracy can be greatly improved by correcting the leakage current, which has a great influence upon output. In particular, since leakage current can be rendered constant according to the present invention, the correction is highly effective.

Further, in the electron-beam generating device of the present invention, the leakage-current determining means includes means for applying the voltage V2 to a row wire, and current measuring means for measuring a current which flows into a column wire.

In the drive method of the present invention, the leakage-current determining step includes a current measuring step of measuring current which flows through a column wire when the voltage V2 has been applied to a row wire.

In accordance with the device and drive method described above, the precision of a correction can be raised by actually measuring the leakage current. Even if the magnitude of the leakage current varies with time, an appropriate correction can be made according to the change.

Further, in the electron-beam generating device of the present invention, the leakage-current determining means comprises a memory in which leakage values found in advance by measurement or calculation are stored.

In the drive method of the present invention, the leakage-current determining step comprises a step of reading data out of a memory in which leakage values found in advance by measurement or calculation are stored.

In accordance with the device or drive method described above, a correction can be made at high speed through a simple arrangement.

Further, in the electron-beam generating device of the present invention, the correcting means includes wiring-potential measuring means for measuring wiring potential, and means for changing amount of a correction in conformity with result of measurement by the wiring-potential measuring means.

In the drive method of the present invention, the correcting step includes a wiring-potential measuring step of measuring wiring potential, and a step of changing amount of a correction in conformity with result of measurement at the wiring-potential measuring step.

In accordance with the device or drive method described above, it is possible to apply a correction that takes into account a change in leakage current ascribable to a voltage drop caused by wiring resistance. This makes possible a further improvement in the accuracy of electron-beam output.

In the electron-beam generating device or drive method of the present invention, image information is used as the externally entered electron-beam demand information.

The above-mentioned device or drive method is ideal for use in various image forming apparatus such as an image display apparatus, printer or electron-beam exposure system.

In the electron-beam generating device of the present invention, surface-conduction electron emission elements are used as the cold cathode elements.

The above-mentioned device is simple to manufacture and even a device having a large area can be fabricated with ease.

If the electron-beam generating device of the present invention is combined with an image forming member for forming an image by irradiation with an electron beam outputted by the electron-beam generating device, an image forming apparatus having a high picture quality can be provided.

If the above-mentioned image forming apparatus has phosphors as image forming members for forming an image by irradiation with the electron beam, an image display apparatus suited to a television or computer terminal can be provided.

Other features and advantages of the present invention will be apparent from the following description taken in conjunction with the accompanying drawings, in which like reference characters designate the same or similar parts throughout the figures thereof.

BRIEF DESCRIPTION OF THE DRAWINGS

The accompanying drawings, which are incorporated in and constitute a part of the specification, illustrate embodiments of the invention and, together with the description, serve to explain the principles of the invention.

DESCRIPTION OF THE PREFERRED EMBODIMENTS

Preferred embodiments of the present invention will be described in detail in accordance with the accompanying drawings.

First Embodiment

An image display apparatus which is a first embodiment of the present invention, as well as a method of driving the apparatus, will now be described in detail. The construction and operation of the electrical circuitry will be described first, then the structure and method of manufacturing a display panel and finally the structure and method of manufacturing a cold cathode element incorporated within the display panel.

(Construction and operation of electrical circuitry)

Figure 14:
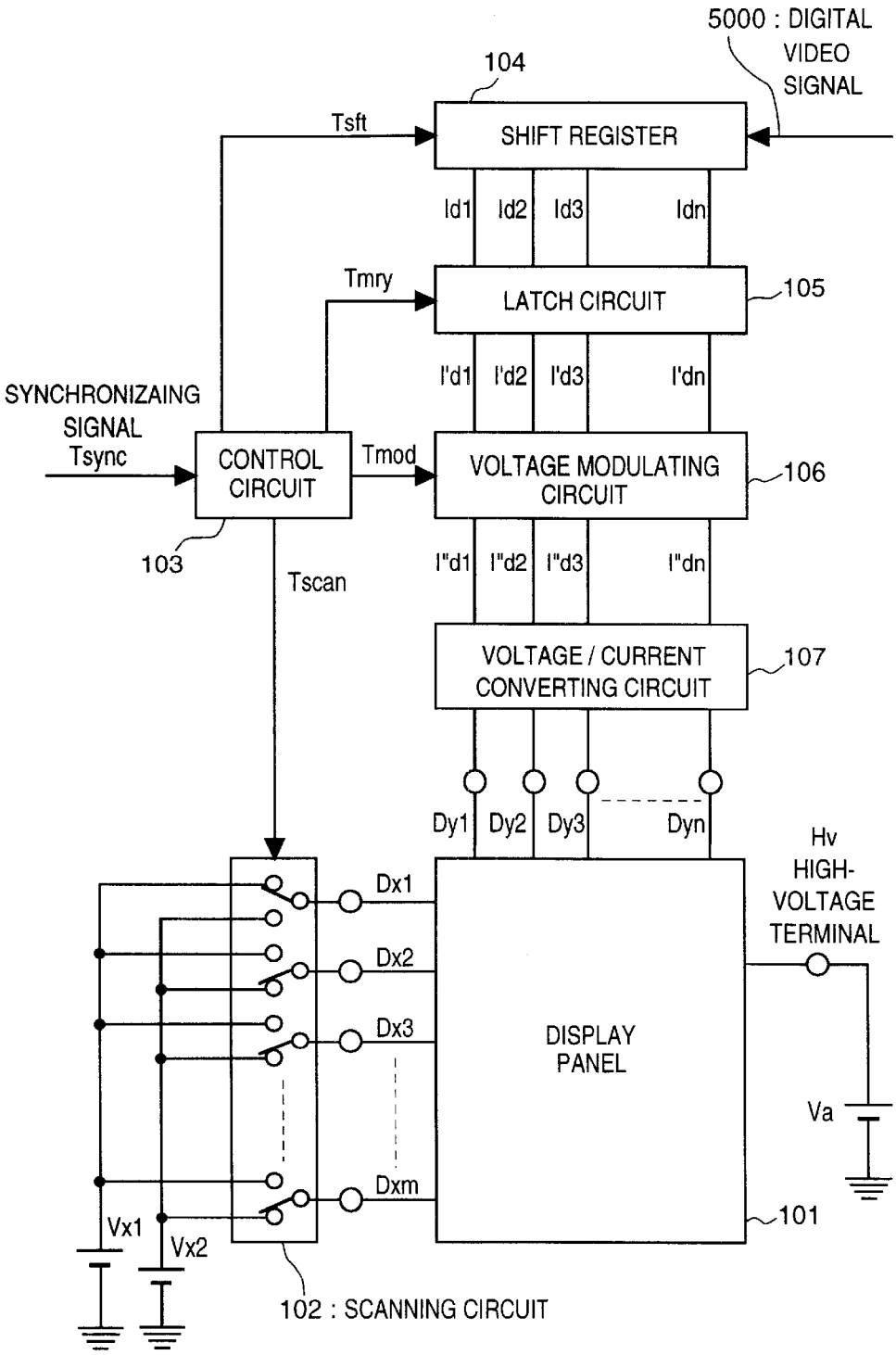
FIG. 14 is a diagram illustrating the construction of an image display apparatus according to a first embodiment.

In FIG. 14, a display panel 101 is connected to external electrical circuitry via terminals $D_{x1}$~$D_{xm}$ and terminals $D_{y1}$~$D_{yn}$. A high-voltage terminal Hv on a face place is connected to an external high-voltage power supply $V_a$ and is adapted to accelerate emitted electrons. Scanning signals for successively driving, one row at a time, multiple electron beam sources provided within the panel, namely a group of surface-conduction electron emission elements matrix-wired in the form of M rows and N columns, are applied to the terminals $D_{x1}$~$D_{xm}$. Modulating signals for controlling the output electron beams of the respective elements of the surface-conduction electron emission elements in a row selected by the scanning signals are applied to the terminals $D_{y1}$~$D_{yn}$.

A scanning circuit 102 will be described next. The scanning circuit 102 is internally provided with M-number of switching elements. On the basis of a control signal Tscan issued by a control circuit 103, each switching element connects a DC power supply $V_{x1}$ to the wiring terminal of a row of electron elements being scanned and a DC power supply $V_{x2}$ to the terminal of a row of electron emission elements not being scanned.

On the basis of an image signal that enters from the outside, the control circuit 103 acts to coordinate the operation timing of each component so as to present an appropriate display. The externally applied image signal may be a composite of image data and a synchronizing signal, as in the manner of an NTSC signal, or it may be a signal in which the image data and synchronizing signal are separated in advance. This embodiment will be described with regard to the latter case. (The former image signal can be dealt with similarly in this embodiment if a well-known synchronous separation circuit is provided to separate the signal into the image data and synchronizing signal.)

More specifically, on the basis of an externally entered synchronizing signal Tsync, the control circuit 103 generates control signals Tscan and Tmry applied to the scanning circuit 102 and a latch circuit 105. The synchronizing signal Tsync generally comprises a vertical synchronizing signal and a horizontal synchronizing signal but is designated by Tsync in order to simplify the description.

Externally applied image data 5000 (luminance data) enters a shift register 104. The shift register 104 is for converting the image data, which enters serially in a time series, to a parallel signal every line of the image. The shift register 104 operates based upon the control signal (shift clock) Tsft which enters from the control circuit 103. The serial/parallel-converted data of one line of the image (which data corresponds to the drive data of N-number of electron emission elements) is outputted to a latch circuit 105 as parallel signals $I_{d1}$~$I_{dn}$.

The latch circuit 105 is a memory circuit for storing one line of the image data for a requisite period of time only. The latch circuit 105 stores $I_{d1}$~$I_{dn}$ simultaneously in accordance with the control signal Tmry sent from the control circuit 103. The data thus stored is outputted to a voltage modulating circuit 106 as $I'_{d1}$~$I'_{dn}$.

The voltage modulating circuit 106 produces a voltage signal, the amplitude of which has been modulated in dependence upon the image data $I'_{d1}$~$I'_{dn}$, and outputs the voltage signal as $I''_{d1}$~$I''_{dn}$. More specifically, the greater the luminance of the image data, the larger the amplitude of the voltage outputted. For example, a voltage of 2 V is outputted for maximum luminance and a voltage of 0 V for minimum luminance. The output signals $I''_{d1}$~$I''_{dn}$ enter a voltage/current converting circuit 107.

Figure 15:
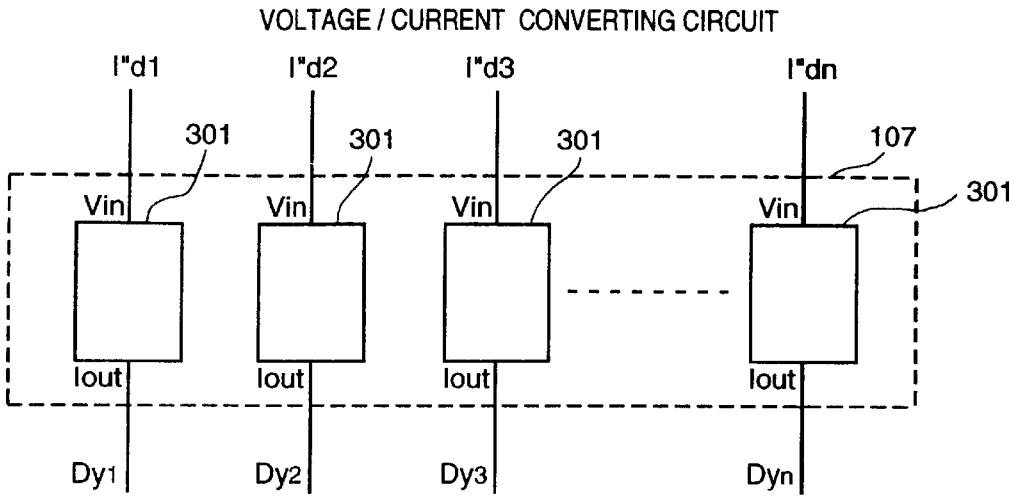
FIG. 15 is a diagram showing the internal construction of a voltage/current converting circuit.
Figure 16:
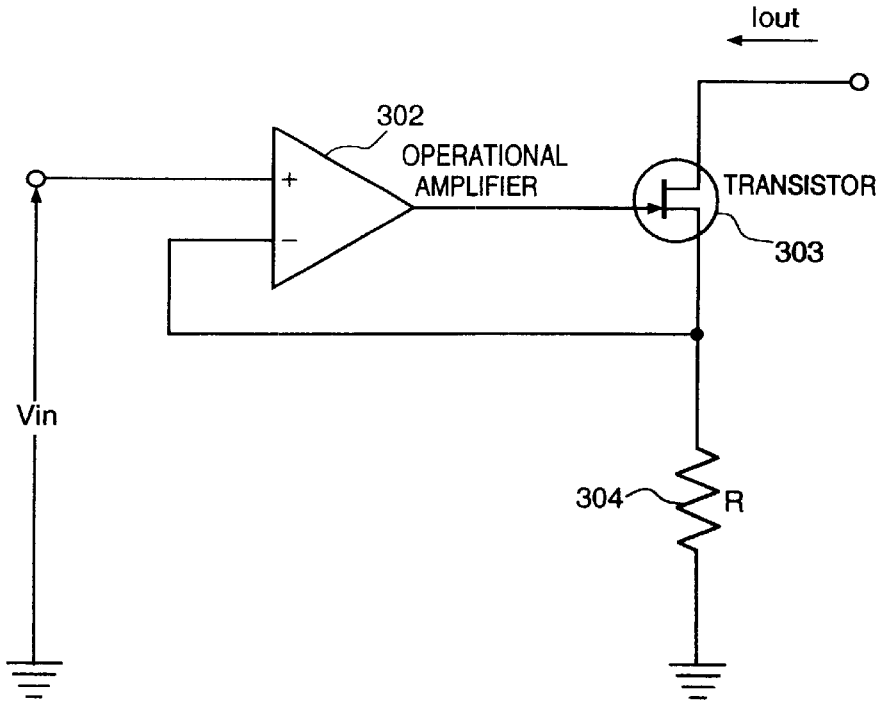
FIG. 16 is a diagram showing the detailed internal circuitry of the voltage/current converting circuit.

The voltage/current converting circuit 107 is a circuit for controlling the current which is passed through a cold cathode element in dependence upon the amplitude of the input voltage signal. The output signal of the voltage/current converting circuit 107 is applied to terminals $D_{y1}$~$D_{yn}$ of the display panel 101. FIG. 15 is a diagram showing the internal construction of the voltage/current converting circuit 107. As shown in FIG. 15, the voltage/current converting circuit 107 is internally equipped with voltage/current converters 301 corresponding to respective ones of the signals $I''_{d1}$~$I''_{dn}$ applied to the circuit 107. Each of the voltage/current converters 301 is composed of circuitry of the kind illustrated in FIG. 16. As shown in FIG. 16, the converter includes an operational amplifier 302, a transistor 303 of the junction FET type, by way of example, and a resistor 304 having a resistance of R ohms. In accordance with the circuit of FIG. 16, the magnitude of an output current $I_{out}$ is decided in conformity with the amplitude of the input voltage signal $V_{in}$. The following relation holds:

$$I_{out}=V_{in}/R \quad \text{(Eq. 1)}$$

By setting the design parameters of the voltage/current converter 301 to suitable values, it is possible to control the current $I_{out}$, which flows through a cold cathode element, in dependence upon the voltage-modulated image data $V_{in}$.

Figure 23:
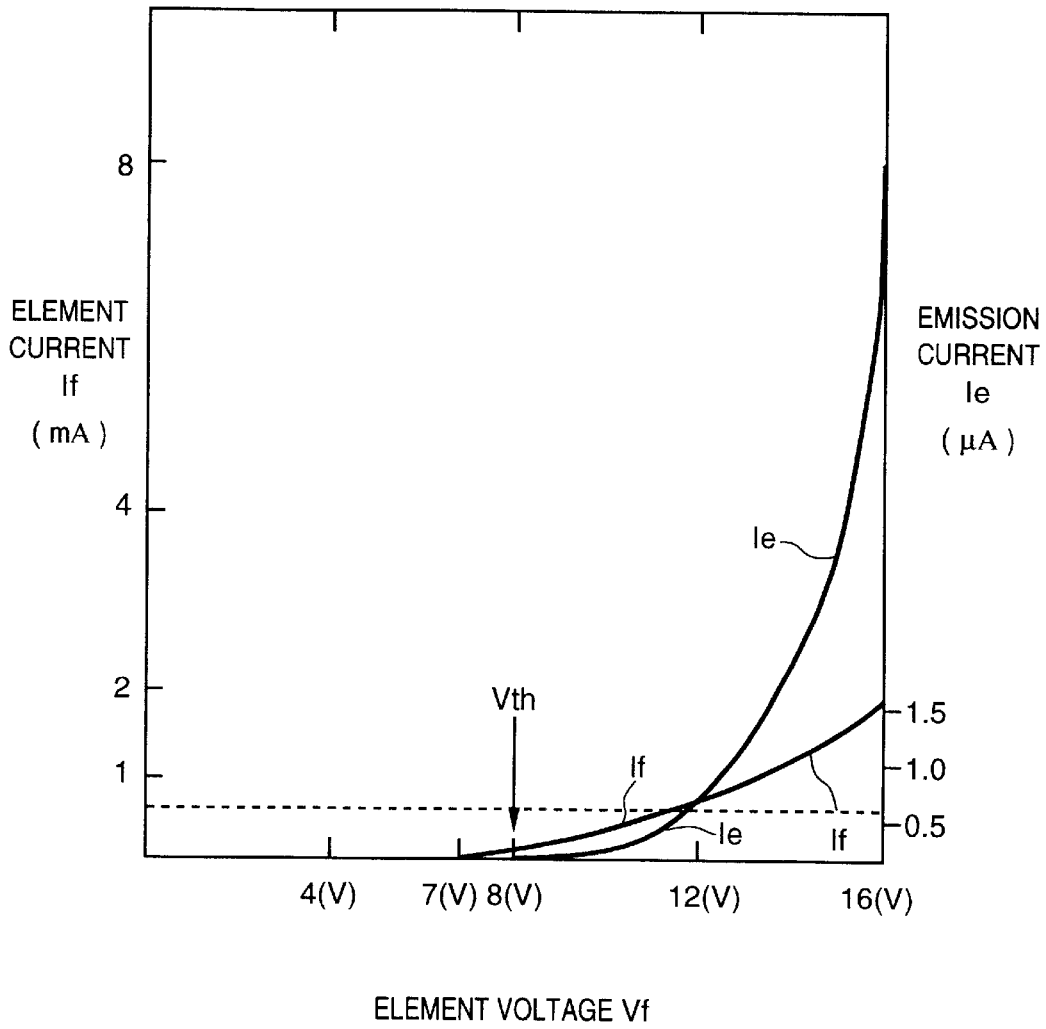
FIG. 23 is a diagram showing a Vf–If and a Vf–Ie characteristic of a surface-conduction electron emission element.

In this embodiment, the size R of the resistor 304 and the other design parameters are decided in the following manner:

A surface-conduction electron emission element used in this embodiment has an electron emission characteristic in which $V_{th}$ (=8 V) is adopted as a threshold value, as shown in FIG. 23. Accordingly, in order to prevent an unnecessary light emission from the display screen, it is required that the voltage applied to a column of electron emission elements not being scanned be made less than 8 V without fail. In the scanning circuit 102 of FIG. 14, it is so arranged that the output voltage of the voltage source $V_{x2}$ is applied to the X-direction wiring of a of electron emission elements not being scanned. Therefore, the requirement $$V_{x2}<8 \quad \text{(Eq. 2)}$$

is satisfied. Accordingly, 7.5 V is decided upon as being the voltage of $V_{x2}$ in this embodiment. This means that the voltage applied to an electron emission element not being scanned will not exceed 7.5 V even at its maximum value.

Figure 17:
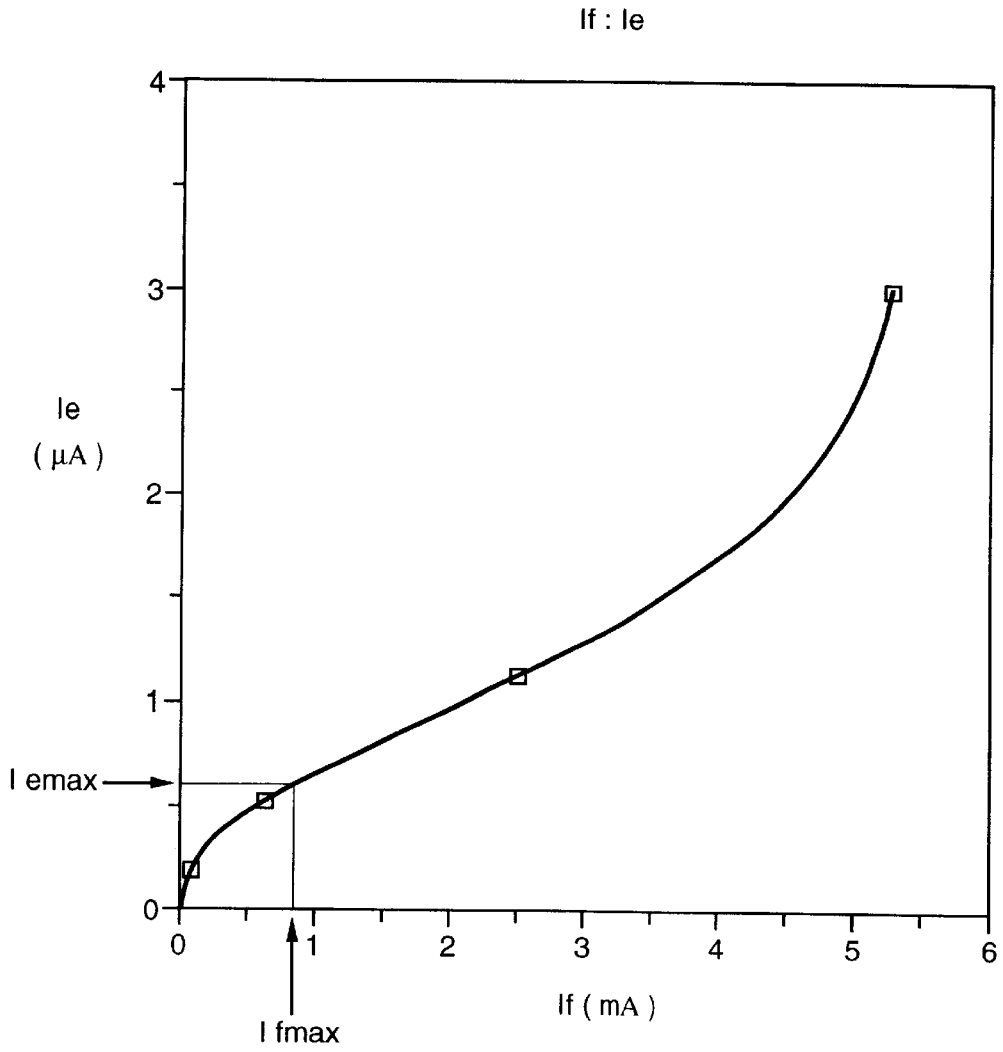
FIG. 17 is a diagram showing the operating characteristics of $I_f$ and $I_e$ of a surface-conduction electron emission element.

It is required to arrange it so that an electron emission element being scanned will emit an electron beam appropriately in conformity with the image data. In this embodiment, emission current $I_e$ is controlled by suitably modulating the element current $I_f$ utilizing the $I_f$–$I_e$ characteristic (FIG. 17) of the surface-conduction electron emission element. As shown in FIG. 17, the emission current. which prevails when the display device is made to emit light at maximum luminance is designed to be $I_{emax}$, and the element current at this time is set to be $I_{fmax}$. For example, $I_{emax}$=0.6 $\mu$A, and $I_{fmax}$=0.8 mA.

The voltage $V_{in}$ of the output signal from the voltage modulating circuit 106 is 2 V for maximum luminance and 0 V for minimum luminance. Therefore, the resistance R can be determined as follows by substituting the above into Equation (1):

$$R=2/0.0008=2.5\ K\Omega$$

Further, when the display device is made to emit light at maximum luminance, the surface-conduction electron emission element possess an electrical resistance on the order of $$12\ V/0.8\ mA=15\ K\Omega$$

When the fact that this and the resistance R (=2.5 KΩ) are serially connected is taken into account, the output voltage of the voltage source $V_{x1}$ is set as follows:

$$V_{x1}=15\ V$$

The accelerating voltage $V_a$ (see FIG. 14) applied to the phosphors is determined as follows: The necessary power to be introduced to the phosphors to obtain the desired maximum luminance is calculated from the light-emission efficiency of the phosphors and the magnitude of the accelerating voltage $V_a$ is decided in such a manner that ($I_{emax}\times V_a$) will satisfy this introduced power. For example, let this power be 10 KV.

Thus, the parameters are set as described above.

The operation of the circuitry will be described in greater detail with reference to the waveform diagrams of FIGS. 18A~18C.

Figure 18A:
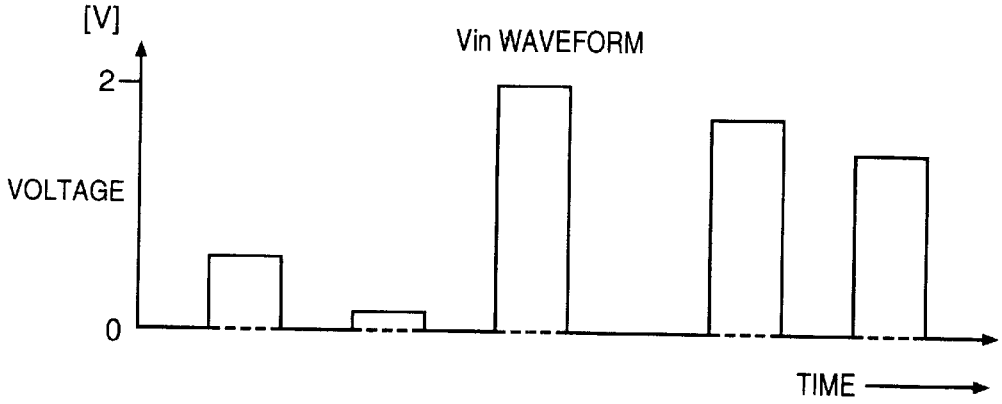
FIG. 18A is a diagram showing a voltage-modulated signal waveform, which is input to the voltage/current converting circuit of the first embodiment.

FIG. 18A exemplifies any one of the signals $I''_{d1}$~$I''_{dn}$ which enter the voltage/current converting circuit 107. This is a signal waveform that is voltage-modulated in conformity with the image data 5000 (luminance data). The signal level is assigned a value of 2 V for maximum luminance and 0 V for minimum luminance, as mentioned earlier.

Figure 18B:
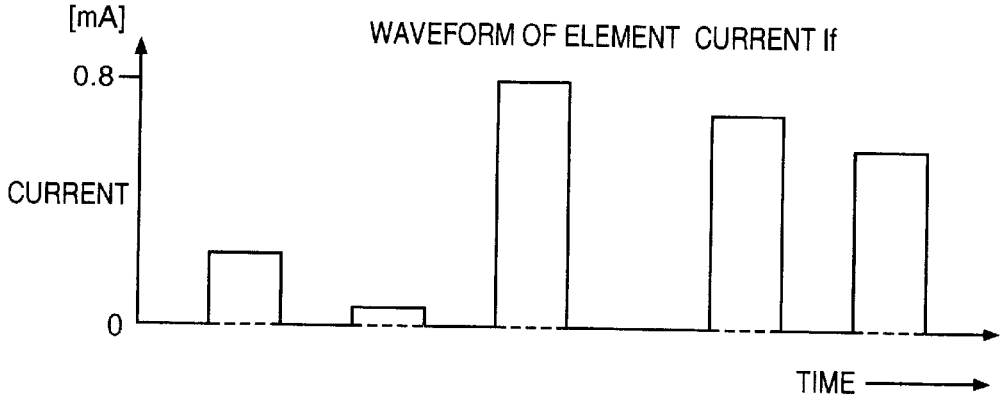
FIG. 18B is a diagram showing the waveform of an output current from the voltage/current converting circuit of the first embodiment.

FIG. 18B is a waveform of the output current $I_{out}$, namely the current $I_f$ which flows into an electron emission element being scanned, from the voltage/current converting circuit 107 in a case where the signal of FIG. 18A is applied thereto. It should be noted that the current waveforms shown in FIGS. 18A~18C are instantaneous current waveforms that are not averaged in terms of time. It goes without saying the this waveform corresponds to Equation (1).

Figure 18C:
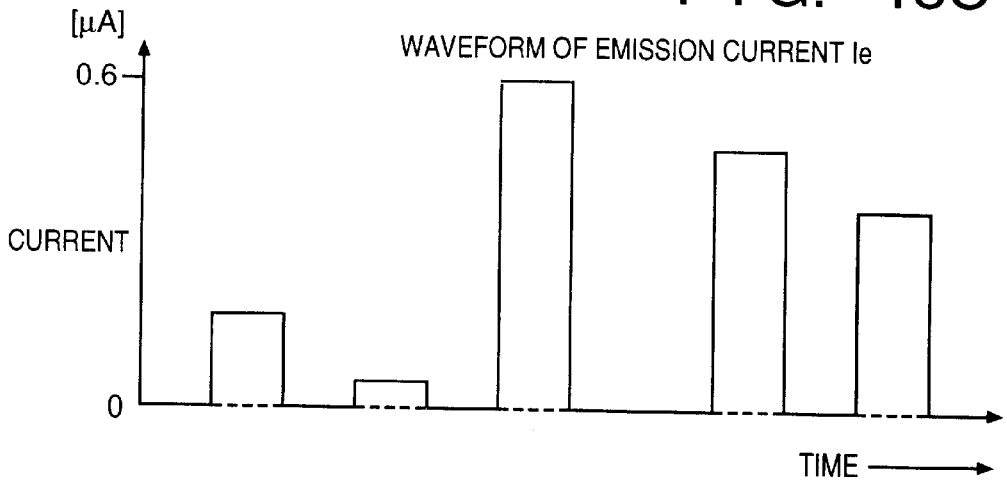
FIG. 18C is a diagram showing the waveform of an emission current from an electron emission element according to the first embodiment.

FIG. 18C illustrates the waveform of the emission current Ie produced by an electron emission element in conformity with the waveforms of FIGS. 18A and 18B.

Thus, in this embodiment as described above, the relationship between the element current $I_f$ and emission current $I_e$ (exemplified in FIG. 17) of a surface-conduction electron emission element is utilized to modulate the element current $I_f$ in dependence upon the image data, thereby controlling the emission current Ie to present a grayscale display.

In a case where no voltage applied to an unselected row, as is done in the prior art, the current impressed upon the surface-conduction electron emission element develops a variance owing to a leakage current. The result is that luminance faithful to the image data is not reproduced. Even if an attempt is made to improve reproducibility, it is difficult to measure directly the current effectively applied to the surface-conduction electron emission element. This makes it difficult to apply feedback to the modulated current.

By contrast, in accordance with this embodiment, the arrangement is such that Vx2 is applied to an unselected row. And the element current If which flows into a surface-conduction electron emission element is modulated by the voltage/current converting circuit 107. As a result of which it is possible to be the leakage current constant. This means that an image can be displayed at a luminance which is very faithful to the original image signal over the entire display screen.

In this embodiment, the arrangement of FIG. 16 is described as an embodiment of the voltage/current converting circuit 107. However, this circuit arrangement does not impose a limitation upon the invention. Any circuit arrangement will suffice so long as the current which flows into a load resistor (a surface-conduction electron emission element) can be modulated in dependence upon the input voltage. For example, if a comparatively large output current Iout is required, it is preferred that a power transistor be Darlington-connected at the portion of transistor 303.

In this embodiment, a digital video signal (indicated at numeral 5000 in FIG. 14), which readily lends itself to data processing, is used as the input video signal. However, this does not impose a limitation upon the invention, for an analog video signal may be used.

Further, in this embodiment, the shift register 104, which is convenient in terms of processing a digital signal, is employed in the serial/parallel conversion processing. However, this does not impose a limitation upon the invention. For example, by controlling storage addresses in such a manner that these addresses are changed in successive fashion, use may be made of an random-access memory having a function equivalent to that of the shift register.

In accordance with this embodiment as described above, it is possible to improve upon the problem of the non-uniformity in Ie caused by the fluctuation of the leakage current. This makes it possible to perform drive at a substantially uniform distribution. As a result, a high-quality image having little luminance distribution can be formed.

Figure 50A:
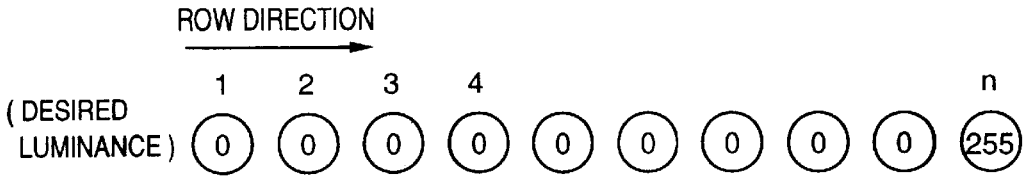
FIGS. 50A, 50B, 51A, 51B, 52A, 52B are diagrams exemplifying the effects of the first embodiment.
Figure 50B:
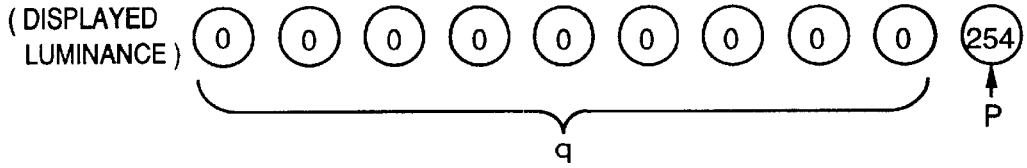
Figure 51A:
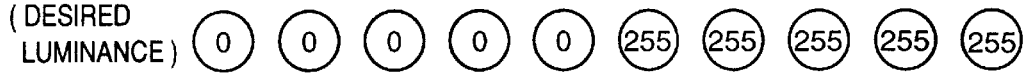
Figure 51B:
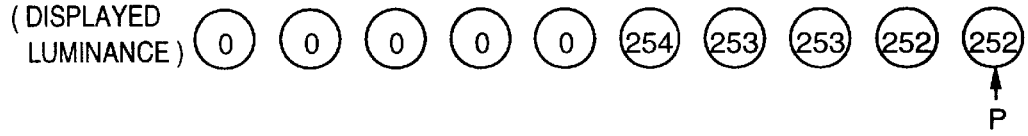
Figure 52A:
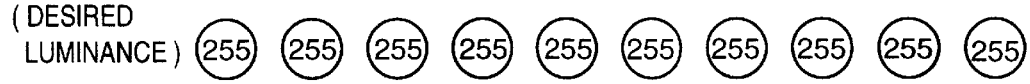
Figure 52B:
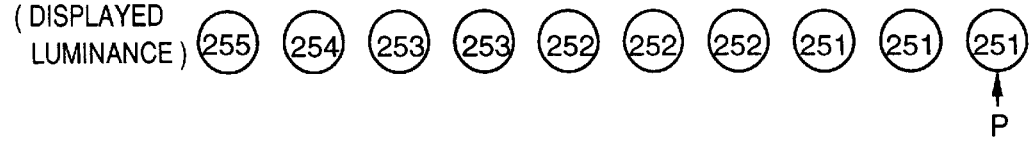

For example, as shown in FIGS. 50B, 51B and 52B, the accuracy of displayed luminance is improved greatly in comparison with the conventional method.

Figure 1:
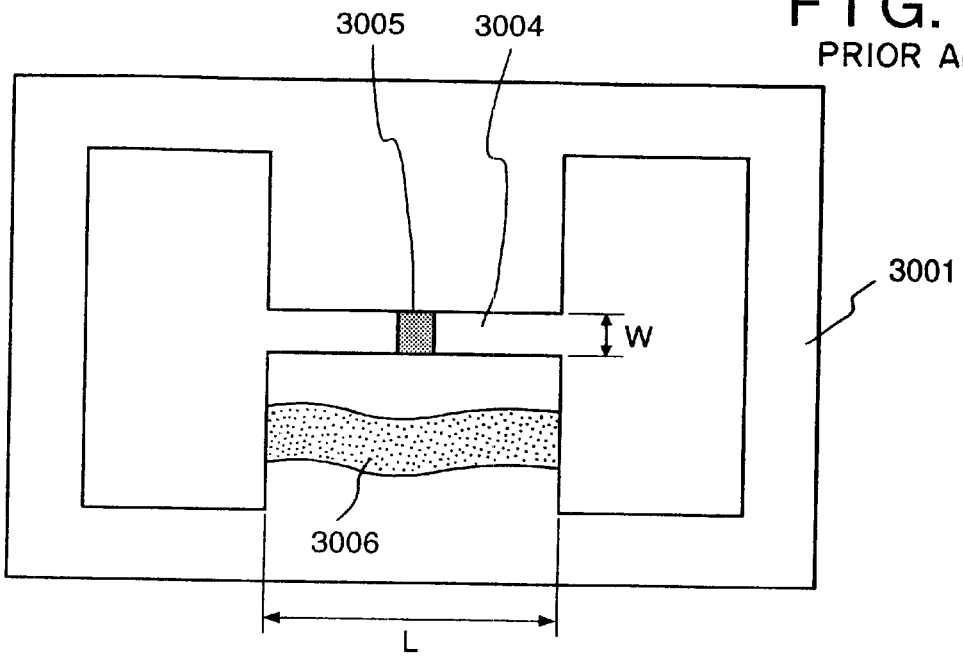
FIG. 1 PRIOR ART
FIG. 1 is a plan view illustrating a surface-conduction electron emission element according to the prior art.
Figure 2:
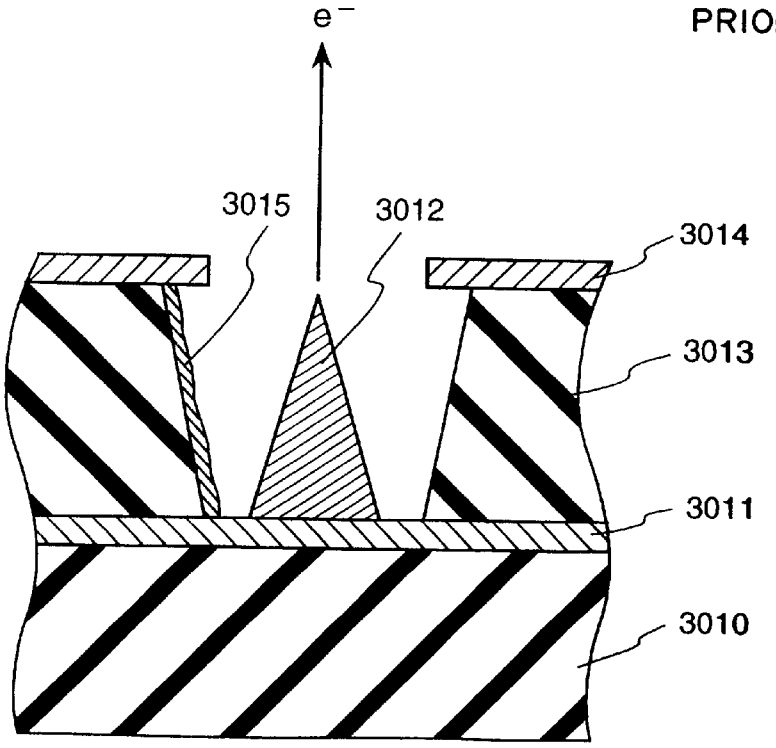
FIG. 2 PRIOR ART
FIG. 2 is a sectional illustrating an FE-type electron emission element according to the prior art.
Figure 3:
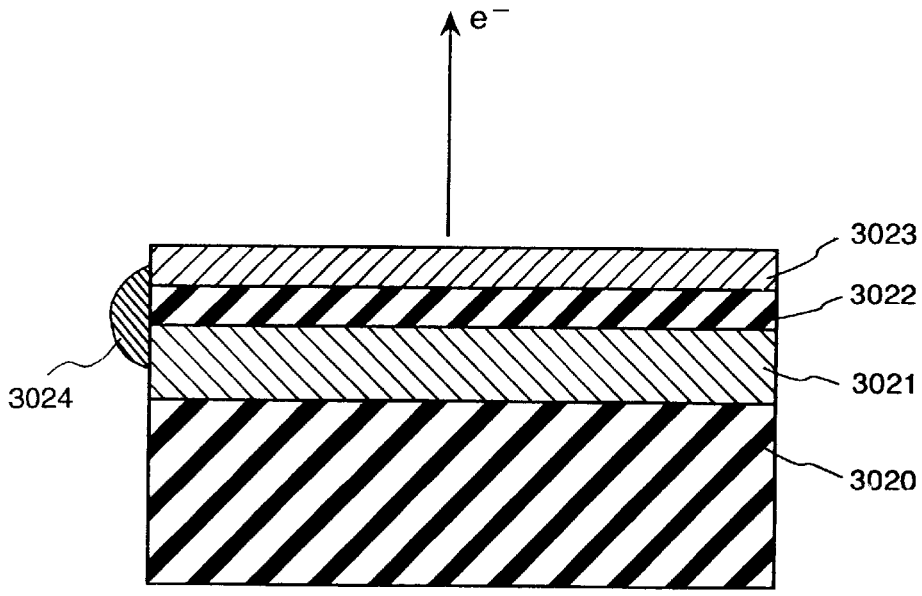
FIG. 3 PRIOR ART
FIG. 3 is a sectional view illustrating a MIM-type electron emission element according to the prior art.
Figure 4A:
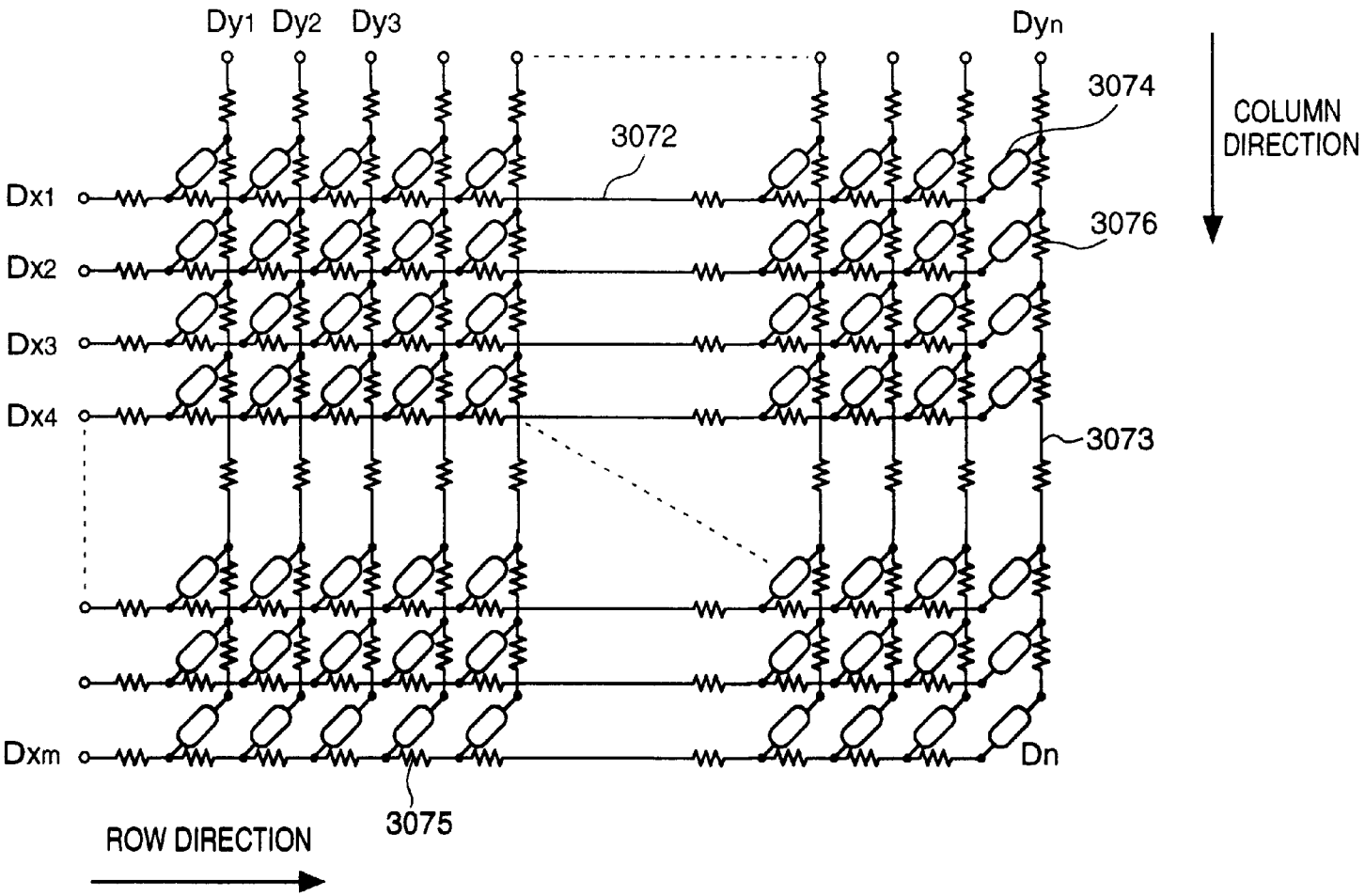
FIG. 4A PRIOR ART
FIG. 4A is a diagram showing a method of matrix-wiring m×n electron emission elements.
Figure 4B:
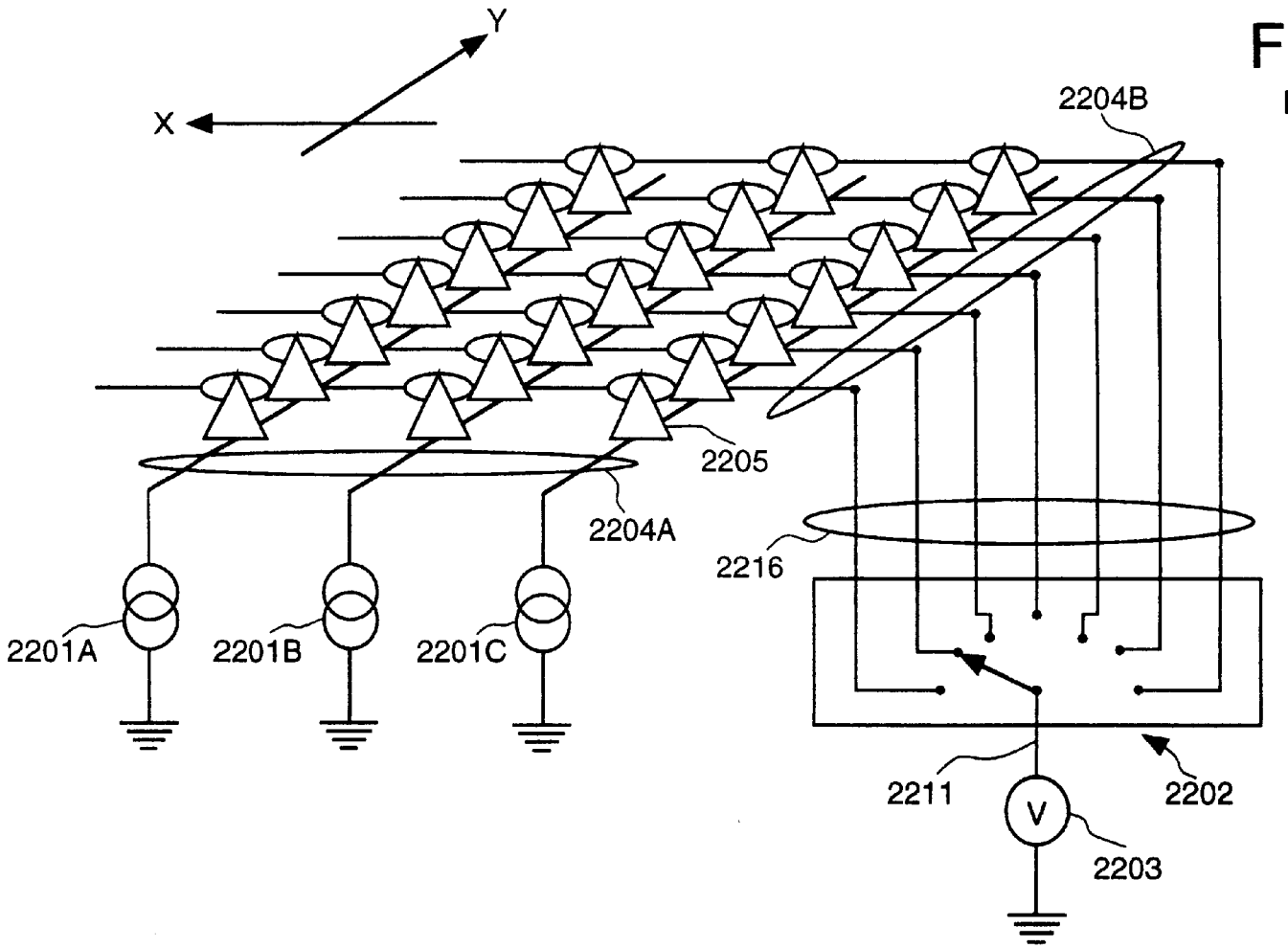
FIG. 4B PRIOR ART
FIG. 4B is a diagram showing a method of driving FE elements according to the prior art.
Figure 5A:
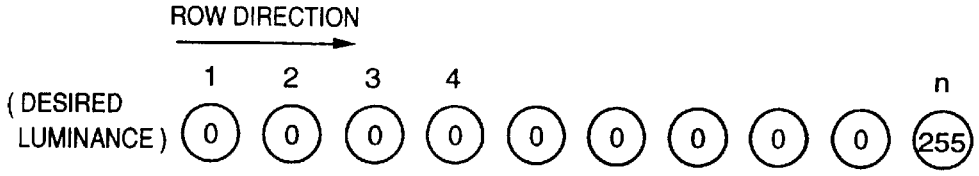
FIG. 5A PRIOR ART
FIG. 5A is a diagram showing an example of luminance desired of one row (n-number) of pixels.
Figure 5B:
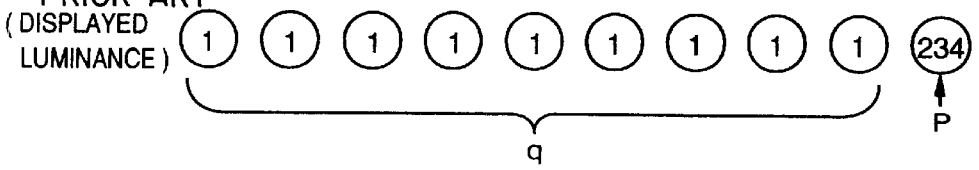
FIG. 5B PRIOR ART
FIG. 5B is a diagram showing a deviation in luminance which occurs in the prior art when the pattern of FIG. 5A is displayed.
Figure 6A:
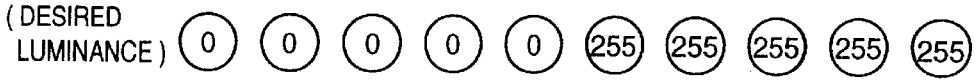
FIG. 6A PRIOR ART
FIG. 6A is a diagram showing another example of luminance desired of one row (n-number) of pixels.
Figure 6B:
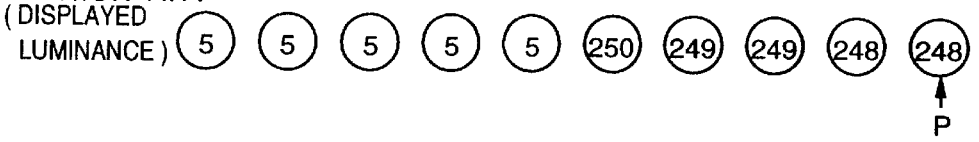
FIG. 6B PRIOR ART
FIG. 6B is a diagram showing a deviation in luminance which occurs in the prior art when the pattern of FIG. 6A is displayed.
Figure 7A:
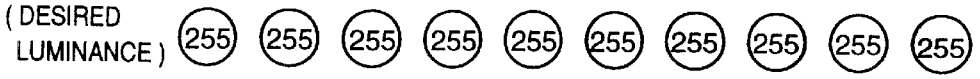
FIG. 7A PRIOR ART
FIG. 7A is a diagram showing another example of luminance desired of one row (n-number) of pixels.
Figure 7B:
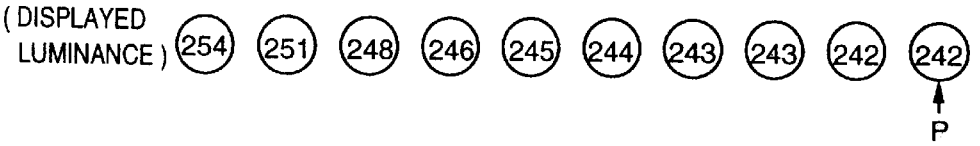
FIG. 7B PRIOR ART
FIG. 7B is a diagram showing a deviation in luminance which occurs in the prior art when the pattern of FIG. 7A is displayed.
Figure 8A:
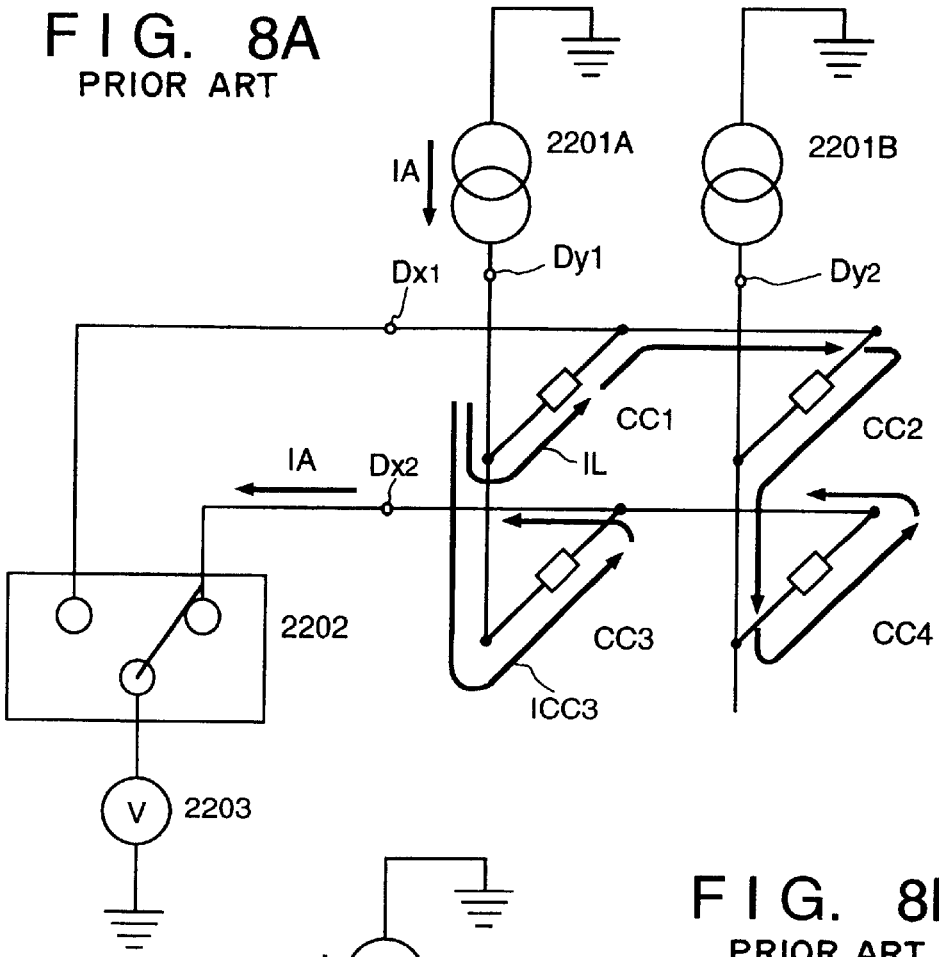
FIG. 8A PRIOR ART
FIGS. 8A, 8B, 9A and 9B are circuit diagrams showing the flow of current in conventional method of drive.
Figure 8B:
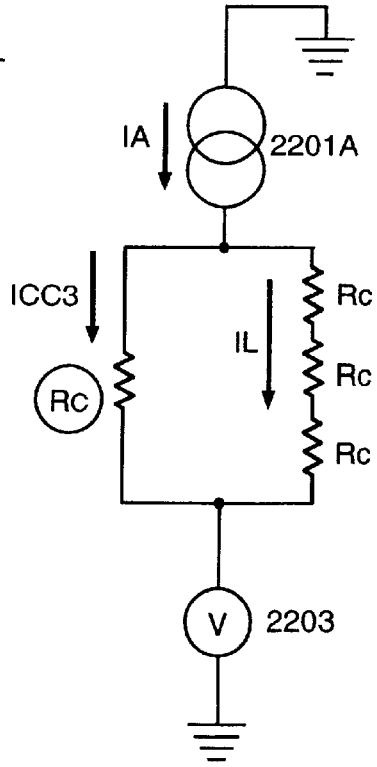
FIG. 8B PRIOR ART
Figure 9A:
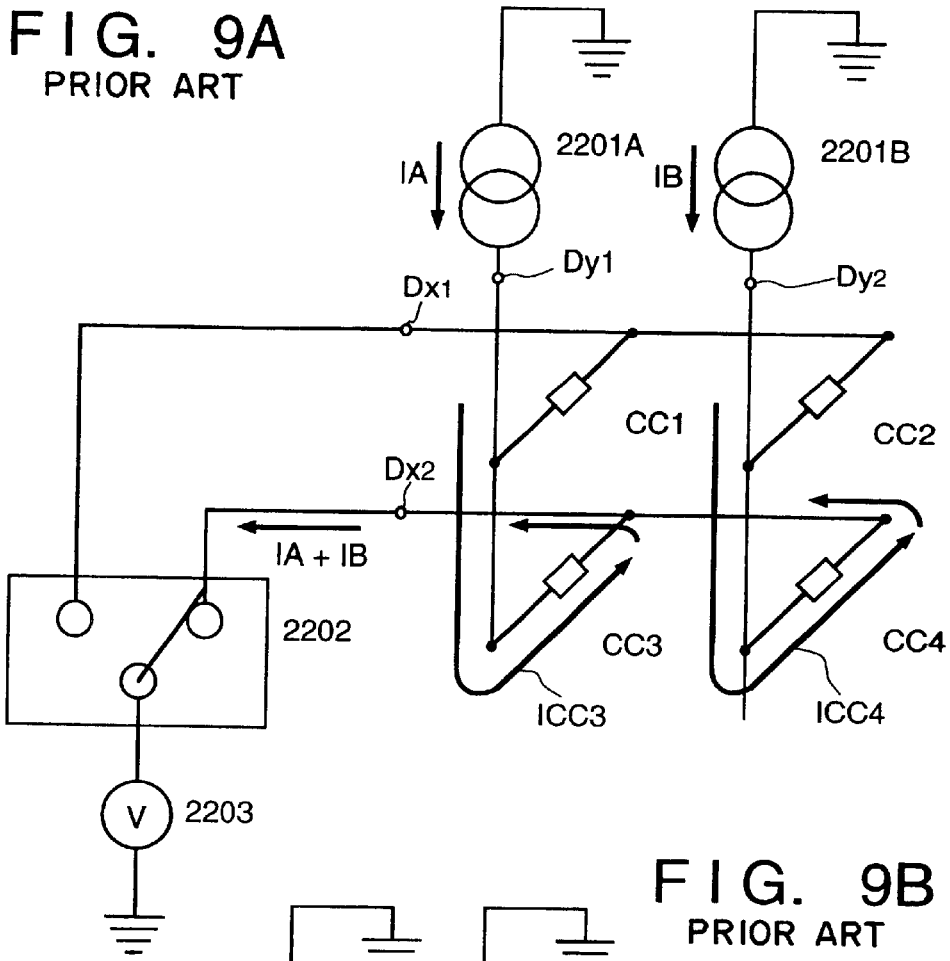
FIG. 9A PRIOR ART
Figure 9B:
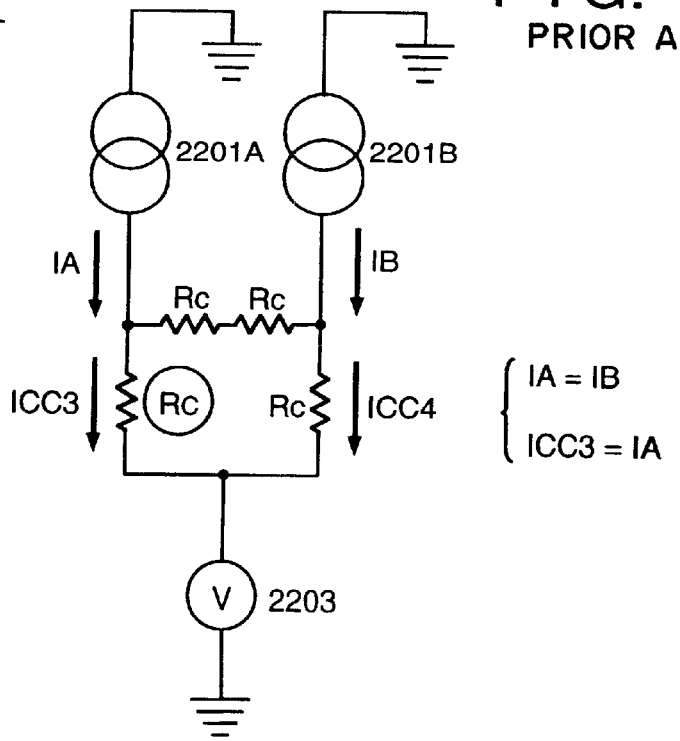
FIG. 9B PRIOR ART
Figure 10A:
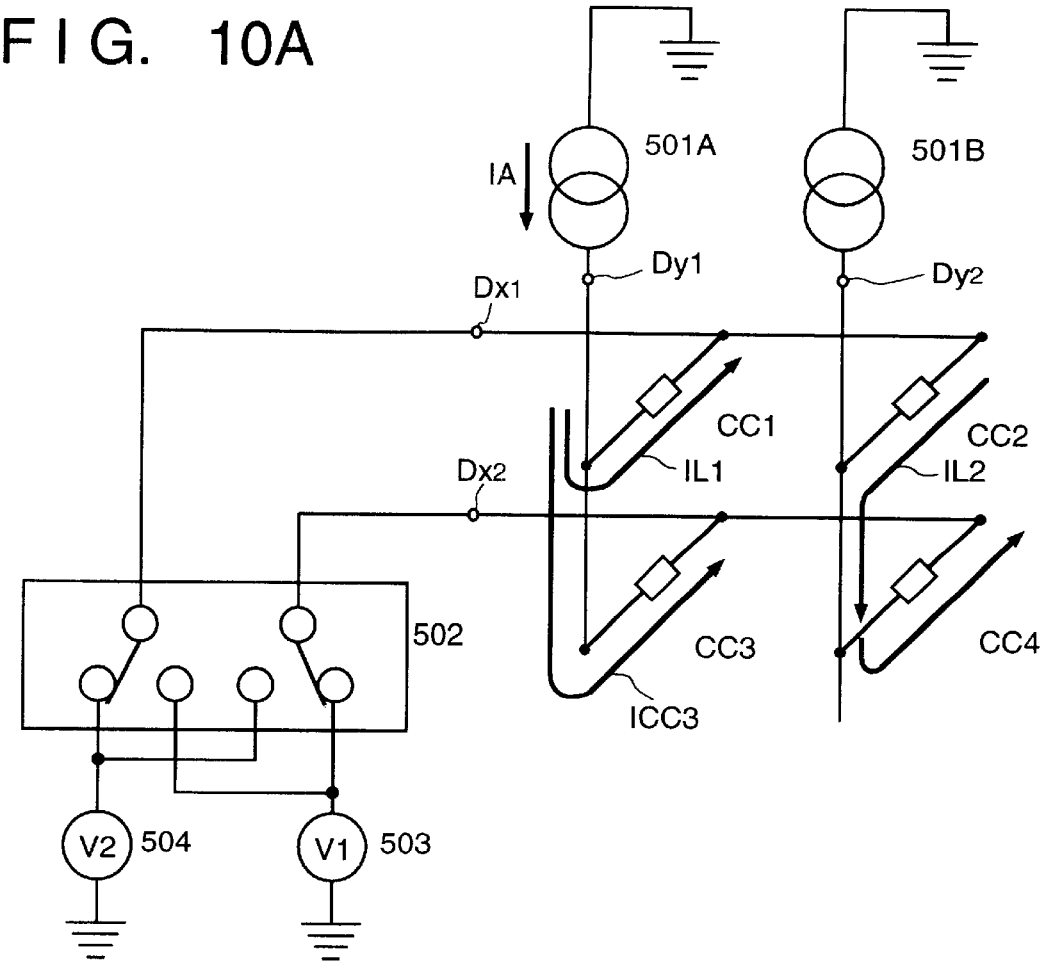
FIGS. 10A, 10B, 11A and 11B are circuit diagrams showing the flow of current in a method of drive according to the present invention.
Figure 10B:
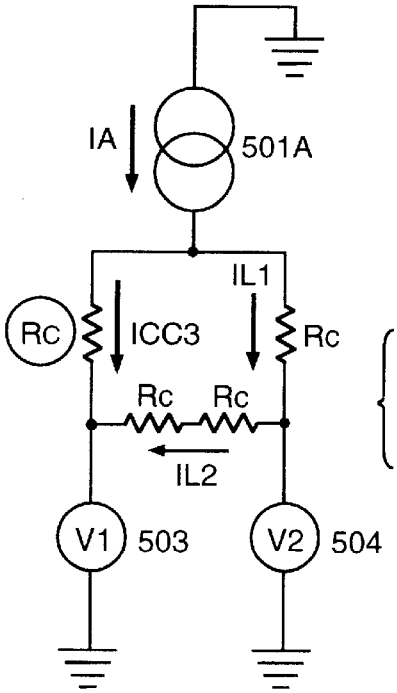
Figure 11A:
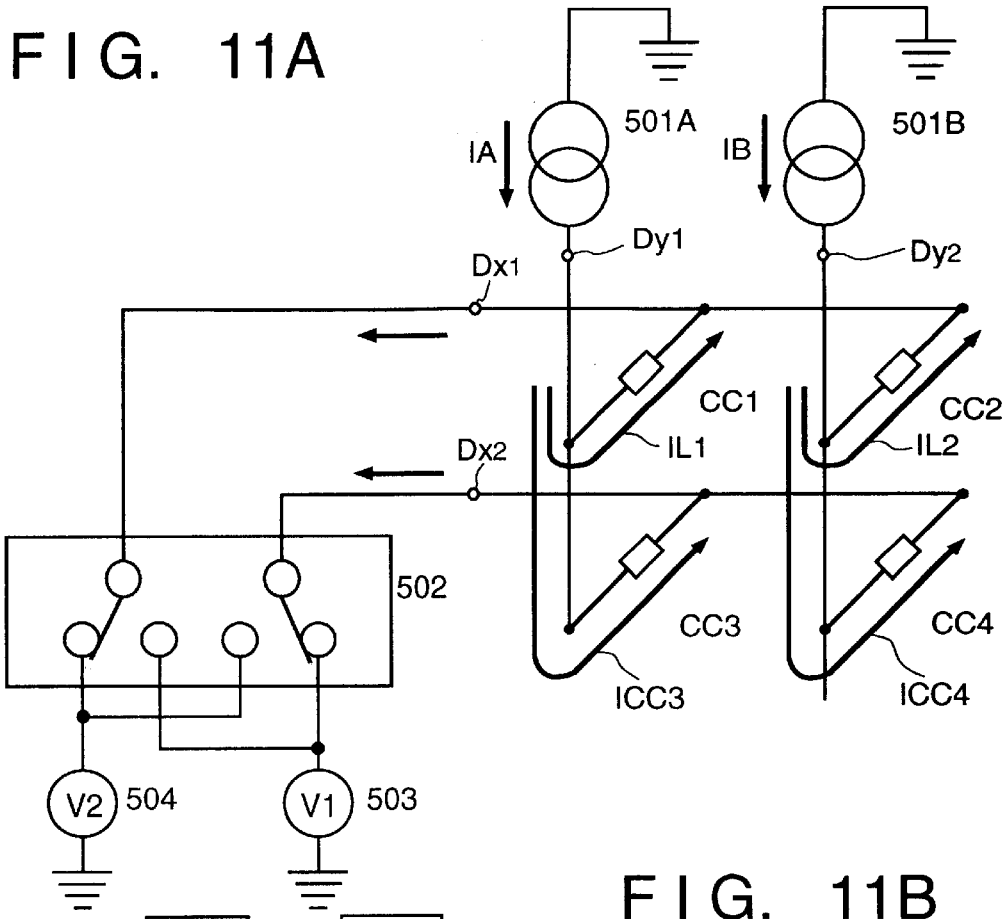
Figure 11B:
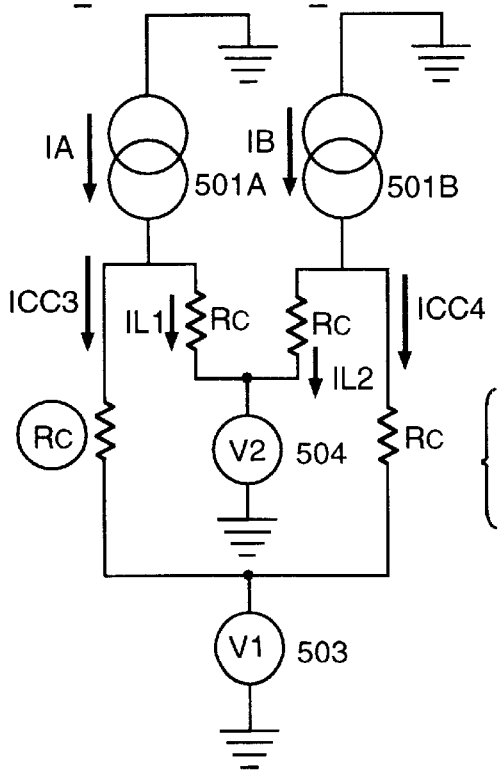

Specifically, leakage current is controlled by the method of applying suitable voltages Vx1, Vx2 to row wires. This provides the following effects:

First, in comparison with the prior-art example shown in FIGS. 5B, 6B, 7B, fluctuation in luminance when the display pattern is changed can be reduced by a wide margin, as indicated at the arrows P.

Second, in the prior art, pixels for which the desired luminance is zero still emit light (see q in FIG. 5B). This can be prevented.

Third, it is possible to prevent an unselected row from emitting light.

As a result of the foregoing, a deviation or fluctuation in luminance and a decline in contrast can be reduced.

(Construction of display panel and method of manufacturing same)

The construction and method of manufacturing the display panel 101 of the image display apparatus according to the first embodiment will now be described while giving an illustration of a specific example.

Figure 12:
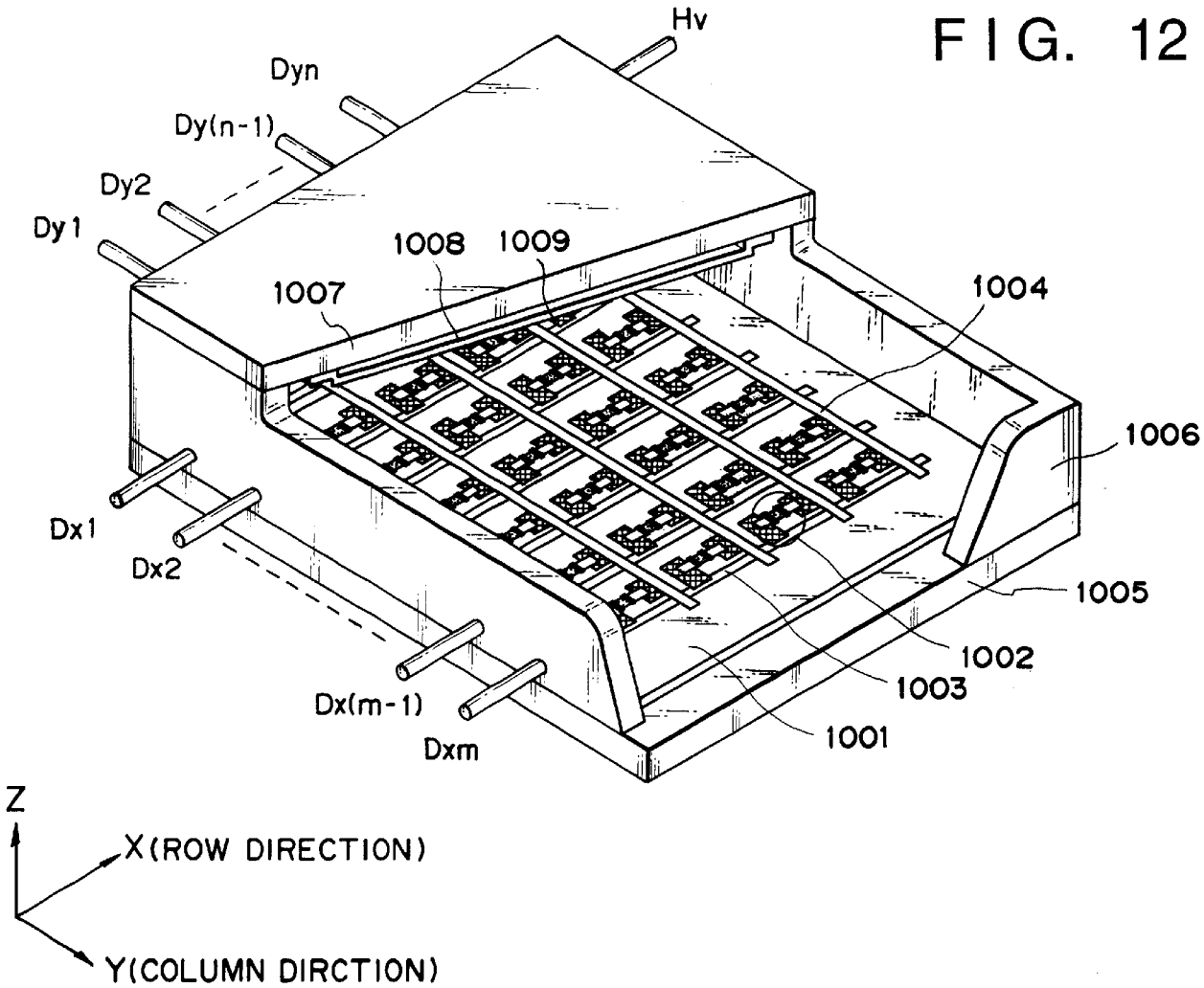
FIG. 12 is a perspective view of a display panel used in this embodiment.

FIG. 12 is a perspective view of the display panel used in this embodiment. A portion of the panel is cut away in order to illustrate the internal structure.

Shown in FIG. 12 are a rear plate 1005, a side wall 1006 and a face plate 1007. A hermetic vessel for maintaining a vacuum in the interior of the display panel is formed by the components 1005~1007. In terms of assembling the hermetic vessel, the joints between the members require to be sealed to maintain sufficient strength and air-tightness. By way of example, a seal is achieved by coating the joints with frit glass and carrying out calcination in the atmosphere or in a nitrogen environment at a temperature of 400~500° C. for 10 min or more. The method of evacuating the interior of the hermetic vessel will be described later.

A substrate 1001 is fixed to the rear plate 1005, which substrate has m×n cold cathode elements formed thereon. (Here m, n are positive integers of having a value of two or greater, with the number being set appropriately in conformity with the number of display pixels intended. For example, in a display apparatus the purpose of which is to display high-definition television, it is desired that the set numbers of elements be no less than n=3000, m=1000. In this embodiment, n=3072, m=1024 hold.) The m×n cold cathode elements are matrix-wired by m-number of row-direction wires 1003 and n-number of column-direction wires 1004. The portion constituted by the components 1001~1004 is referred to as a "multiple electron beam source". The method of manufacturing the multiple electron beam source and the structure thereof will be described in detail later.

Figure 13A:
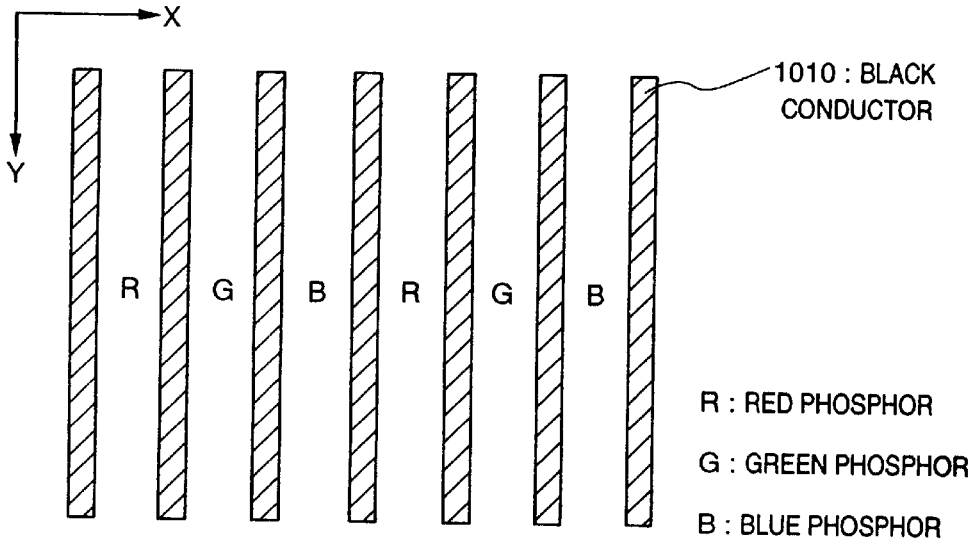
FIGS. 13A and 13B are diagrams showing the arrangement of pixels in the display panel used in this embodiment.

A phosphor film 1008 is formed on the underside of the face plate 1007. Since this embodiment relates to a color display apparatus, portions of the phosphor film 1008 are coated with phosphors of the three primary colors red, green and blue used in the field of CRT technology. The phosphor of each color is applied in the form of stripes, as shown in FIG. 13A, and a black conductor 1010 is provided between the phosphor stripes. The purpose of providing the black conductors 1010 is to assure that there will not be a shift in the display colors even if there is some deviation in the position irradiated with the electron beam, to prevent a decline in display contrast by preventing the reflection of external light, and to prevent the phosphor film from being charged up by the electron beam. Though the main ingredient used in the black conductor 1010 is graphite, any other material may be used so long as it is suited to the above-mentioned objectives.

Figure 13B:
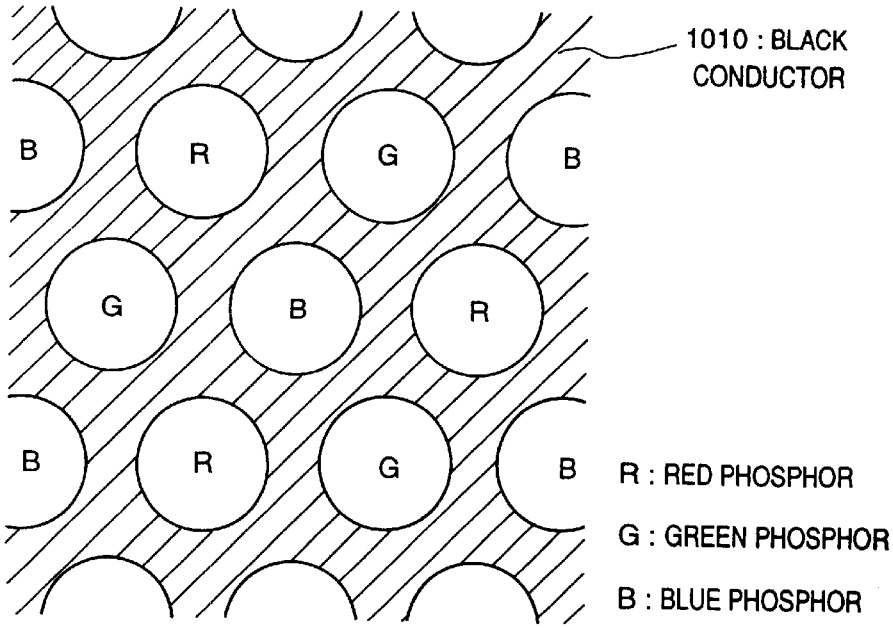

The application of the phosphors of the three primary colors is not limited to the stripe-shaped array shown in FIG. 13A. For example, a delta-shaped array, such as that shown in FIG. 13B, or other array may be adopted.

In a case where a monochromatic display panel is fabricated, a monochromatic phosphor material may be used as the phosphor film 1008 and the black conductor material need not necessarily be used.

Further, a metal backing 1009 well known in the field of CRT technology is provided on the surface of the phosphor film 1008. The purpose of providing the metal backing 1009 is to improve the utilization of light by reflecting part of the light emitted by the phosphor film 1008, to protect the phosphor film 1008 against damage due to bombardment by negative ions, to act as an electrode for applying an electron-beam acceleration voltage, and to act as a conduction path for the electrons that have excited the phosphor film 1008. The metal backing 1009 is fabricated by a method which includes forming the phosphor film 1008 on the face plate substrate 1007, subsequently smoothing the surface of the phosphor film and vacuum-depositing aluminum on this surface. In a case where a phosphor material for low voltages is used as the phosphor film 1008, the metal backing 1009 is unnecessary.

Though not used in this embodiment, transparent electrodes made of a material such as ITO may be provided between the face plate substrate 1007 and the phosphor film 1008.

$D_{x1}$~$D_{xm}$, $D_{y1}$~$D_{yn}$ and Hv represent feed terminals, which have an air-tight structure, for connecting this display panel with electrical circuitry. The feed terminals Dx1~Dxm are electrically connected to the row-direction wires 1003 of the multiple electron beam source, the feed terminals $D_{y1}$~$D_{yn}$ are electrically connected to the column-direction wires 1004 of the multiple electron beam source, and the terminal Hv is electrically connected to the metal backing 1009 of the face plate.

In order to evacuate the interior of the hermetic vessel, an exhaust pipe and a vacuum pump, not shown, are connected after the hermetic vessel is assembled and the interior of the vessel is exhausted to a vacuum of $10^{-7}$ Torr. The exhaust pipe is then sealed. In order to maintain the degree of vacuum within hermetic vessel, a getter film (not shown) is formed at a prescribed position inside the hermetic vessel immediately before or immediately after the pipe is sealed. The getter film is a film formed by heating a getter material, the main ingredient of which is Ba, for example, by a heater or high-frequency heating to deposit the material. A vacuum on the order of $1\times10^{-5}$~$1\times10^{-7}$ Torr is maintained inside the hermetic vessel by the adsorbing action of the getter film.

The foregoing is a description of the basic construction and method of manufacture of the display panel according to this embodiment of the invention.

The method of manufacturing the multiple electron beam source used in the display panel of the foregoing embodiment will be described next. If the multiple electron beam source used in the image display apparatus of this invention is an electron source in which cold cathode elements are wired in the form of a matrix, there is no limitation upon the material, shape or method of manufacture of the cold cathode elements. Accordingly, it is possible to use cold cathode elements such as surface-conduction electron emission elements or cold cathode elements of the FE or MIM type.

Since there is demand for inexpensive display devices having a large display screen, the surface-conduction electron emission elements are particularly preferred as the cold cathode elements. More specifically, with the FE-type element, the relative positions of the emitter cone and gate electrode and the shape thereof greatly influence the electron emission characteristics. Consequently, a highly precise manufacturing technique is required. This is a disadvantage in terms of enlarging surface area and lowering the cost of manufacture. With the MIM-type element, it is required that the insulating layer and film thickness of the upper electrode be made uniform even if they are thin. This also is a disadvantage in terms of enlarging surface area and lowering the cost of manufacture. In this respect, the surface-conduction electron emission element is comparatively simple to manufacture, the surface area thereof is easy to enlarge and the cost of manufacture can be reduced with ease. Further, the inventors have discovered that, among the surface-conduction electron emission elements available, an element in which the electron emission portion or periphery thereof is formed from a film of fine particles excels in its electron emission characteristic, and that the element can be manufactured easily. Accordingly, it may be constructed that such an element is most preferred for used in a multiple electron beam source in an image display apparatus having a high luminance and a large display screen. Accordingly, in the display panel of the foregoing embodiment, use was made of a surface-conduction electron emission element in which the electron emission portion or periphery thereof was formed from a film of fine particles. First, therefore, the basic construction, method of manufacture and characteristics of an ideal surface-conduction electron emission element will be described, and this will be followed by a description of the structure of a multiple electron beam source in which a large number of elements are wired in the form of a matrix.

(Element construction ideal for surface-conduction electron emission elements, and method of manufacturing same)

A planar-type and step-type element are the two typical types of construction of surface-conduction electron emission elements available as surface-conduction electron emission elements in which the electron emission portion or periphery thereof is formed from a film of fine particles.

(Planar-type surface-conduction electron emission element)

Figure 27A:
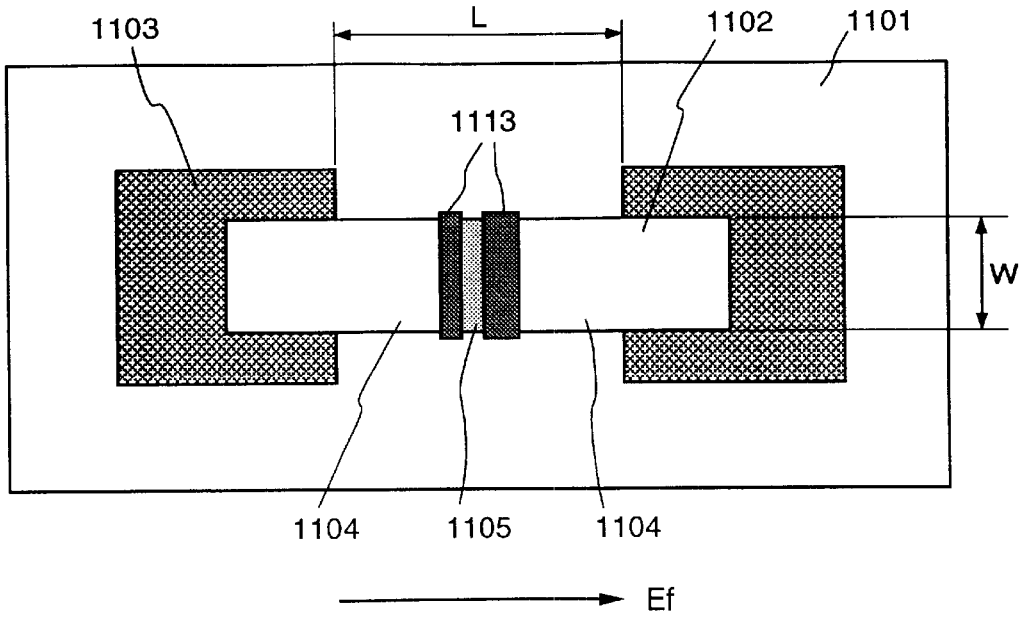
FIG. 27A is a sectional view of a planar-type surface-conduction electron emission element
Figure 27B:
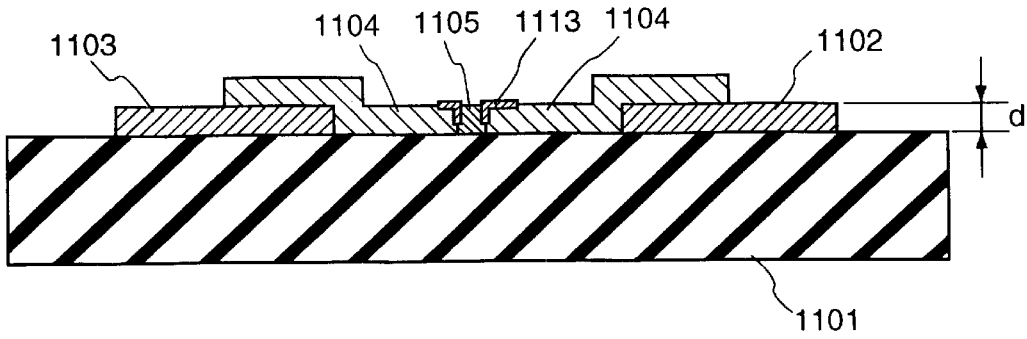
FIG. 27B is a plan view of a planar-type surface-conduction electron emission element

The element construction and manufacture of a planar-type surface-conduction electron emission element will be described first. FIGS. 27A, 27B are plan and sectional views, respectively, for describing the construction of a planar-type surface-conduction electron emission element.

Shown in FIGS. 27A, 27B are a substrate 1101, element electrodes 1102, 1103, an electrically conductive thin film 1104, an electron emission portion 1105 formed by an energization forming treatment, and a thin film 1113 formed by an electrification activation treatment.

Examples of the substrate 1101 are various glass substrates such as quartz glass and soda-lime glass, various substrates of a ceramic such as alumina, or a substrate obtained by depositing an insulating layer such as $SiO_2$ on the various substrates mentioned above.

The element electrodes 1102, 1103, which are provided to oppose each other on the substrate 1101 in parallel with the substrate surface, are formed from a material exhibiting electrical conductivity. Examples of the material that can be mentioned are the metals Ni, Cr, Au, Mo, W, Pt, Ti, Al, Cu, Pd and Ag or alloys of these metals, metal oxides such as $In_2O_3$–$SnO_2$ and semiconductor materials such as polysilicon. In order to form the electrodes, a film manufacturing technique such as vacuum deposition and a patterning technique such as photolithography or etching may be used in combination. However, it is permissible to form the electrodes using another method, such as a printing technique.

The shapes of the element electrodes 1102, 1103 are decided in conformity with the application and purpose of the electron emission element. In general, the spacing L1 between the electrodes may be a suitable value selected from a range of several hundred angstroms to several hundred micrometers. Preferably, the range is on the order of several micrometers to several tens of micrometers in order for the device to be used in a display apparatus. With regard to the thickness d of the element electrodes, a suitable numerical value is selected from a range of several hundred angstroms to several micrometers.

A film of fine particles is used at the portion of the electrically conductive thin film 1104. The film of fine particles mentioned here signifies a film (inclusive of island-shaped aggregates) containing a large number of fine particles as structural elements. If a film of fine particles is examined microscopically, usually the structure observed is one in which individual fine particles are arranged in spaced-apart relation, one in which the particles are adjacent to one another and one in which the particles overlap one another.

The particle diameter of the fine particles used in the film of fine particles falls within a range of from several angstroms to several thousand angstroms, with the particularly preferred range being 10 Å to 200 Å. The film thickness of the film of fine particles is suitably selected upon taking into consideration the following conditions: conditions necessary for achieving a good electrical connection between the element electrodes 1102 and 1103, conditions necessary for carrying out energization forming, described later, and conditions necessary for obtaining a suitable value, described later, for the electrical resistance of the film of fine particles per se. More specifically, the film thickness is selected in the range of from several angstroms to several thousand angstroms, preferably 10 Å to 500 Å.

Examples of the material used to form the film of fine particles are the metals Pd, Pt, Ru, Ag, Au, Ti, In, Cu, Cr, Fe, Zn, Sn, Ta, W and Pb, etc., the oxides PdO, $SnO_2$, $In_2O_3$, PbO and $Sb_2O_3$, etc., the borides $HfB_2$, $ZrB_2$, $LaB_6$, $CeB_6$, $YB_4$ and $GdB_4$, the carbides TiC, ZrC, HfC, TaC, SiC and WC, etc., the nitrides TiN, ZrN and HfN, etc., the semiconductors Si, Ge, etc., and carbon. The material may be selected appropriately from these.

As mentioned above, the electrically conductive thin film 1104 is formed from a film of fine particles. The sheet resistance is set so as to fall within the range of from $10^3$ to $10^7$ Ω/sq.

Since it is preferred that the electrically conductive thin film 1104 come into good electrical contact with the element electrodes 1102, 1103, the adopted structure is such that the film and the element electrodes partially overlap each other. As for the methods of achieving this overlap, one method is to build up the device from the bottom in the order of the substrate, element electrodes and electrically conductive film, as shown in the example of FIG. 27B. Depending upon the case, the device may be built up from the bottom in the order of the substrate, electrically conductive film and element electrodes.

The electron emission portion 1105 is a fissure-shaped portion formed in part of the electrically conductive thin film 1104 and, electrically speaking, has a resistance higher than that of the surrounding conductive thin film. The fissure is formed by subjecting the electrically conductive thin film 1104 to an energization forming treatment, described later. There are cases in which fine particles having a particle diameter of several angstroms to several hundred angstroms are placed inside the fissure. It should be noted that since it is difficult to illustrate, finely and accurately, the actual position and shape of the electron emission portion, only a schematic illustration is given in FIGS. 27A and 27B.

The thin film 1113 comprises carbon or a carbon compound and covers the electron emission portion 1105 and its vicinity. The thin film 1113 is formed by carrying out an electrification activation treatment, described later, after the energization forming treatment.

The thin film 1113 is one or a mixture of single-crystal graphite, polycrystalline graphite or amorphous carbon. The film thickness preferably is less than 500 Å, especially less than 300 Å.

It should be noted that since it is difficult to precisely illustrate the actual position and shape of the thin film 1113, only a schematic illustration is given in FIGS. 27A and 27B. Further, in the plan view of FIG. 27A, the element is shown with part of the thin film 1113 removed.

The desired basic construction of the element has been described. The following element was used in this embodiment:

Soda-lime glass was used as the substrate 1101, and a thin film of Ni was used as the element electrodes 1102 and 1103. The thickness d of the element electrodes was 1000 Å, and the electrode spacing L was 2 μm. Pd or PdO was used as the main ingredient of the film of fine particles, the thickness of the film of fine particles was about 100 Å, and the width W was 100 μm.

The method of manufacturing the preferred planar-type of the surface-conduction electron emission element will now be described.

FIGS. 28A~28E are sectional views for describing the process steps for manufacturing the surface-conduction electron emission element. Portions similar to those in FIG. 27 are designated by like reference numerals.

Figure 28A:
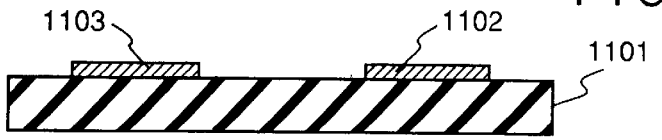
FIG. 28A is a diagram illustrating a step for manufacturing planar-type surface-conduction electron emission elements.

(1) First, the element electrodes 1102, 1103 are formed on the substrate 1101, as shown in FIG. 28A.

With regard to formation, the substrate 1101 is cleansed sufficiently in advance using a detergent, pure water or an organic solvent, after which the element electrode material is deposited. (An example of the deposition method used is a vacuum film forming technique such as vapor deposition or sputtering.) Thereafter, the deposited electrode material is patterned using photolithography to form the pair of electrodes 1102, 1103 shown in FIG. 28A.

Figure 28B:
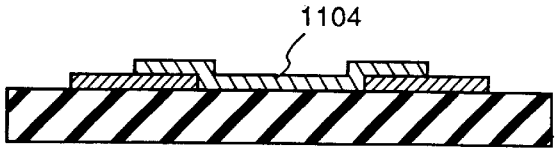
FIG. 28B is a diagram illustrating a step for manufacturing planar-type surface-conduction electron emission elements.

(2) Next, the electrically conductive thin film 1104 is formed, as shown in FIG. 28B. With regard to formation, the substrate of FIG. 28A is coated with an organic metal solution, the latter is allowed to dry, and heating and calcination treatments are applied to form a film of fine particles. Patterning is then carried out by photolithographic etching to obtain a prescribed shape. The organic metal solution is a solution of an organic metal compound in which the main element is the material of the fine particles used in the electrically conductive film. (Specifically, Pd was used as the main element in this embodiment. Further, the dipping method was employed as the method of application in this embodiment. However, other methods which may be used are the spinner method and spray method.)

Further, besides the method of applying the organic metal solution used in this embodiment as the method of forming the electrically conductive thin film made of the film of fine particles, there are cases in which use is made of vacuum deposition and sputtering or chemical vapor deposition.

Figure 28C:
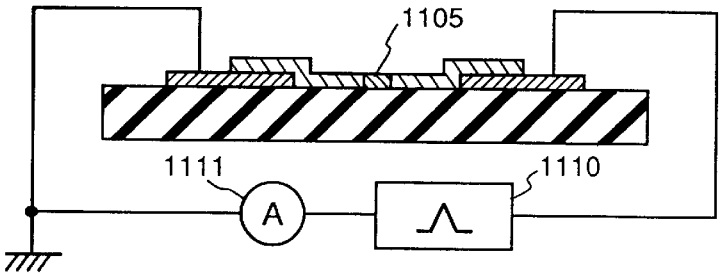
FIG. 28C is a diagram illustrating a step for manufacturing planar-type surface-conduction electron emission elements.

(3) Next, as shown in FIG. 28C, a suitable voltage is applied across the element electrodes 1102 and 1103 from a forming power supply 1110, whereby an energization forming treatment is carried out to form the electron emission portion 1105.

The energization forming treatment includes passing a current through the electrically conductive thin film 1104, which is made from the film of fine particles, to locally destroy, deform or change the property of this portion, thereby obtaining a structure ideal for performing electron emission. At the portion of the electrically conductive film, made of the film of fine particles, changed to a structure ideal for electron emission (i.e., the electron emission portion 1105), a fissure suitable for a thin film is formed. When a comparison is made with the situation prior to formation of the electron emission portion 1105, it is seen that the electrical resistance measured between the element electrodes 1102 and 1103 after formation has increased to a major degree.

Figure 29:
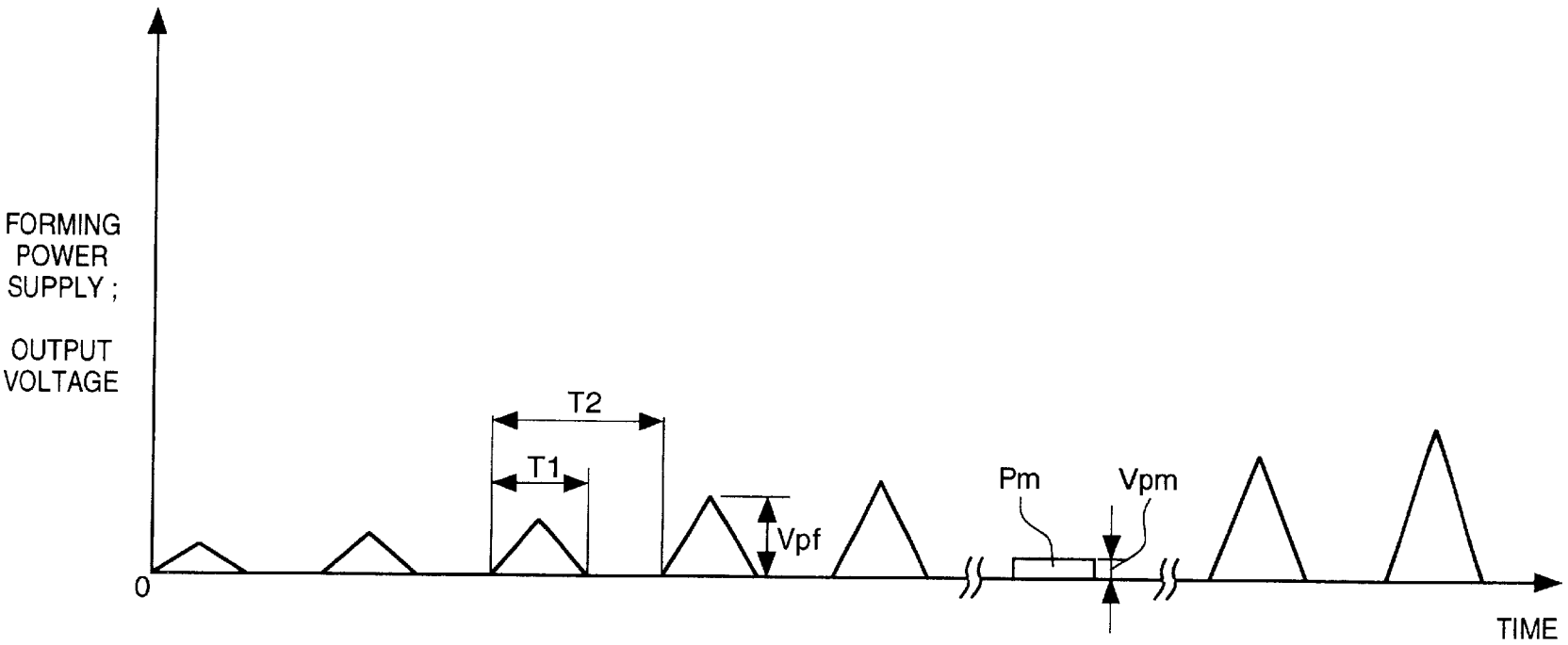
FIG. 29 is a diagram showing an applied voltage waveform for an energization forming treatment.

In order to give a more detailed description of the electrification method, an example of a suitable voltage waveform supplied from the forming power supply 1110 is shown in FIG. 29. In a case where the electrically conductive film made of the film of fine particles is subjected to forming, a pulsed voltage is preferred. In the case of this embodiment, triangular pulses having a pulse width T1 were applied consecutively at a pulse interval T2, as illustrated in the Figure. At this time, the peak value Vpf of the triangular pulses was gradually increased. A monitoring pulse Pm for monitoring the formation of the electron emission portion 1105 was inserted between the triangular pulses at a suitable spacing and the current which flows at such time was measured by an ammeter 1111.

In this embodiment, under a vacuum of, say, $10^{-5}$ Torr, the pulse width T1 and pulse interval T2 were made 1 msec and 10 msec, respectively, and the peak voltage Vpf was elevated at increments of 0.1 V every pulse. The monitoring pulse Pm was inserted at a rate of once per five of the triangular pulses. The voltage Vpm of the monitoring pulses was set to 0.1 V so that the forming treatment would not be adversely affected. Electrification applied for the forming treatment was terminated at the stage that the resistance between the terminal electrodes 1102, 1103 became $1\times10^{6}$ Ω, namely at the stage that the current measured by the ammeter 1111 at application of the monitoring pulse fell below $1\times10^{-7}$ A.

The method described above is preferred in relation to the surface-conduction electron emission element of this embodiment. In a case where the material or film thickness of the film consisting of the fine particles or the design of the surface-conduction electron emission element such as the element-electrode spacing L is changed, it is desired that the conditions of electrification be altered accordingly.

Figure 28D:
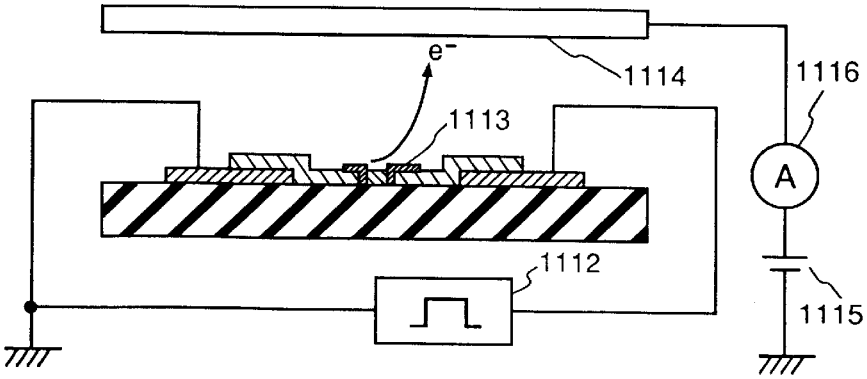
FIG. 28D is a diagram illustrating a step for manufacturing planar-type surface-conduction electron emission elements.

(4) Next, as shown in FIG. 28D, a suitable voltage from an activating power supply 1112 was impressed across the element electrodes 1102, 1103 to apply an electrification activation treatment, thereby improving the electron emission characteristic.

This electrification activation treatment involves subjecting the electron emission portion 1105, which has been formed by the above-described energization forming treatment, to electrification under suitable conditions and depositing carbon or a carbon compound in the vicinity of this portion. (In the Figure, the deposit consisting of carbon or carbon compound is illustrated schematically as a member 1113.) By carrying out this electrification activation treatment, the emission current typically can be increased by more than 100 times, at the same applied voltage, in comparison with the current before application of the treatment.

More specifically, by periodically applying voltage pulses in a vacuum ranging from $10^{-4}$ to $10^{-5}$ Torr, carbon or a carbon compound in which an organic compound present in the vacuum serves as the source is deposited. The deposit 1113 is one or a mixture of single-crystal graphite, polycrystalline graphite or amorphous carbon. The film thickness is less than 500 Å, preferably less than 300 Å.

Figure 30A:
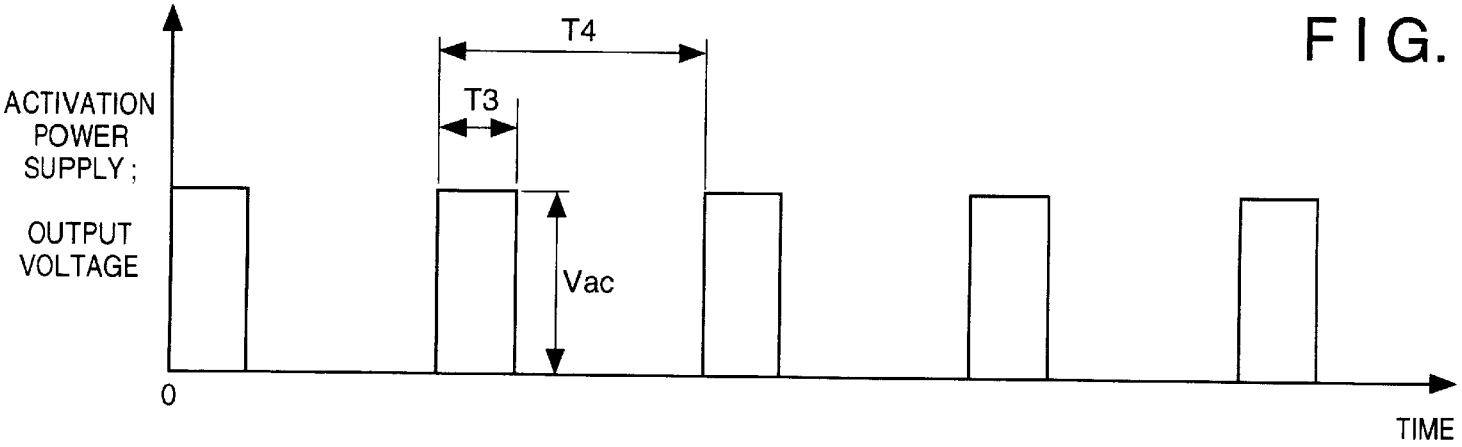
FIG. 30A is a diagram showing an applied voltage waveform for an electrification activation treatment.

In order to give a more detailed description of the electrification method for activation, an example of a suitable waveform supplied by the activation power supply 1112 is illustrated in FIG. 30A. In this embodiment, the electrification activation treatment was conducted by periodically applying rectangular waves of a fixed voltage. More specifically, the voltage Vac of the rectangular waves was made 14 V, the pulse width T3 was made 1 msec, and the pulse interval T4 was made 10 msec. The electrification conditions for activation mentioned above are desirable conditions in relation to the surface-conduction electron emission element of this embodiment. In a case where the design of the surface-conduction electron emission element is changed, it is desired that the conditions be changed accordingly.

Numeral 1114 in FIG. 28D denotes an anode electrode for capturing the emission current Ie obtained from the surface-conduction electron emission element. The anode electrode is connected to a DC high-voltage power supply 1115 and to an ammeter 1116. (In a case where the activation treatment is carried out after the substrate 1101 is installed in the display panel, the phosphor surface of the display panel is used as the anode electrode 1114.)

Figure 30B:
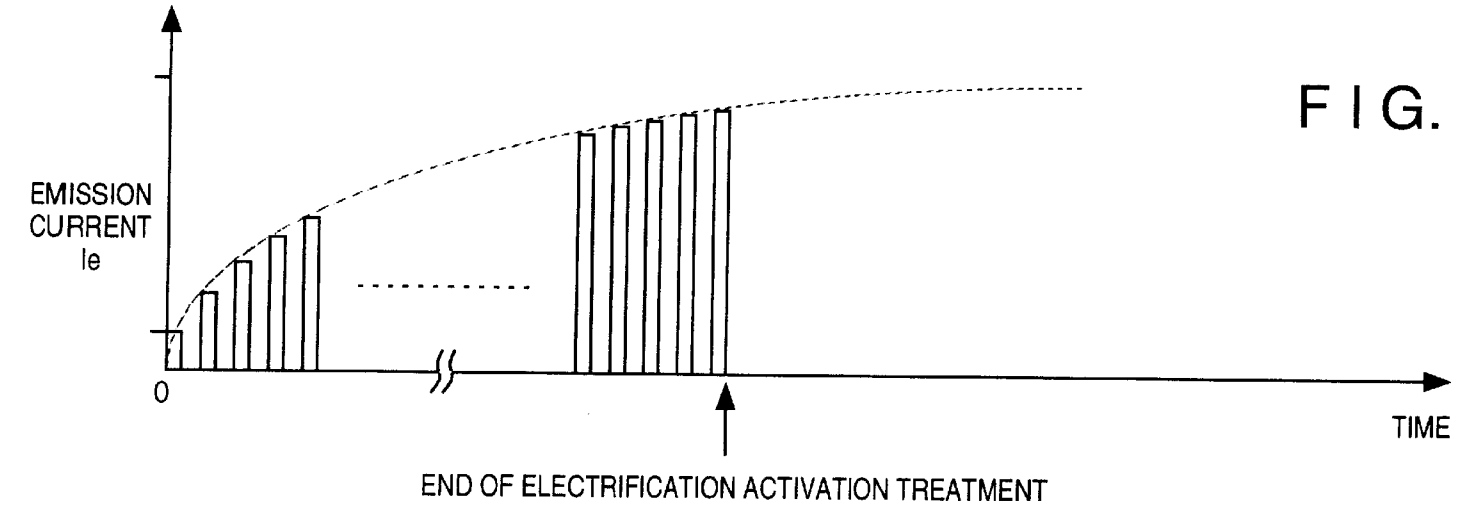
FIG. 30B is a diagram showing emission current at the time of the electrification activation treatment.

During the-time that the voltage is being supplied from the activation power supply 1112, the emission current Ie is measured by the ammeter 1116 to monitor the progress of the electrification activation treatment, and the operation of the activation power supply 1112 is controlled. FIG. 30B illustrates an example of the emission current Ie measured by the ammeter 1116. When the pulsed voltage starts being supplied by the activation power supply 1112, the emission current Ie increases with the passage of time but eventually saturates and then almost stops increasing. At the moment the emission current Ie thus substantially saturates, the application of voltage from the activation power supply 1112 is halted and the activation treatment by electrification is terminated.

It should be noted that the above-mentioned electrification conditions are desirable conditions in relation to the surface-conduction electron emission element of this embodiment. In a case where the design of the surface-conduction electron emission element is changed, it is desired that the conditions be changed accordingly.

Figure 28E:
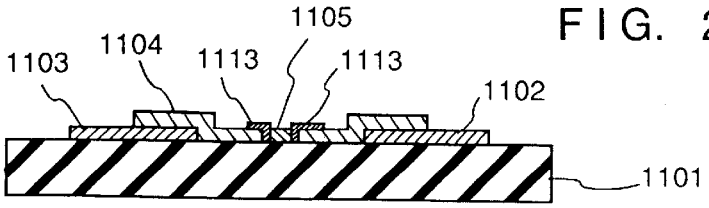
FIG. 28E is a diagram illustrating a step for manufacturing planar-type surface-conduction electron emission elements.

Thus, the planar-type surface-conduction electron emission element shown in FIG. 28E is manufactured as set forth above.

(Step-type surface-conduction electron emission element)

Next, one more typical construction of a surface-conduction electron emission element in which the electron emission portion or its periphery is formed from a film of fine particles, namely the construction of a step-type surface-conduction electron emission element, will be described.

Figure 31:
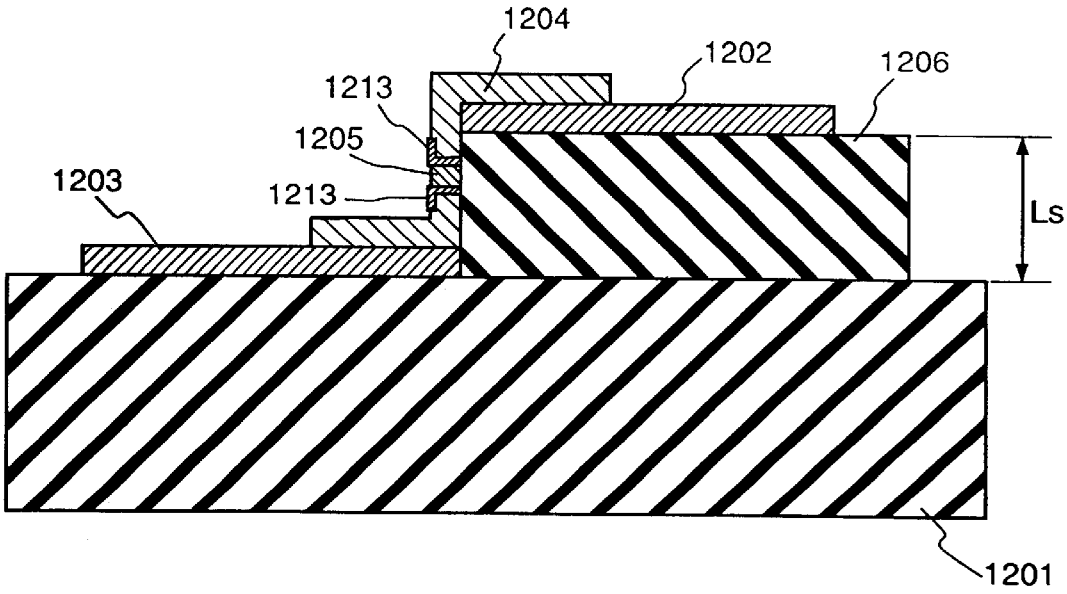
FIG. 31 is a sectional view of a step-type surface-conduction electron emission element.

FIG. 31 is a schematic sectional view for describing the basic construction of the step-type element. Numeral 1201 denotes a substrate, 1202 and 1203 element electrodes, 1206 a step forming member, 1204 an electrically conductive thin film using a film of fine particles, 1205 an electron emission portion formed by an energization forming treatment, and 1213 a thin film formed by an electrification activation treatment.

The step-type element differs from the planar-type element in that one element electrode (1202) is provided on the step forming member 1206, and in that the electrically conductive thin film 1204 covers the side of the step forming member 1206. Accordingly, the element-electrode spacing L in the planar-type surface-conduction electron emission element shown in FIG. 18 is set as the height Ls of the step forming member 1206 in the step-type element. The substrate 1201, the element electrodes 1202, 1203 and the electrically conductive thin film 1204 using the film of fine particles can consist of the same materials mentioned in the description of planar-type element. An electrically insulating material such as $SiO_2$ is used as the step forming member 1206.

A method of manufacturing the step-type surface-conduction electron emission element will now be described. FIGS. 32A~32F are sectional views for describing the manufacturing steps. The reference characters of the various members are the same as those in FIG. 31.

Figure 32A:
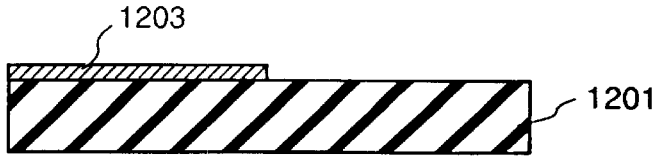
FIG. 32A is a diagram illustrating a step for manufacturing step-type surface-conduction electron emission elements.

(1) First, the element electrode 1203 is formed on the substrate 1201, as shown in FIG. 32A.

Figure 32B:
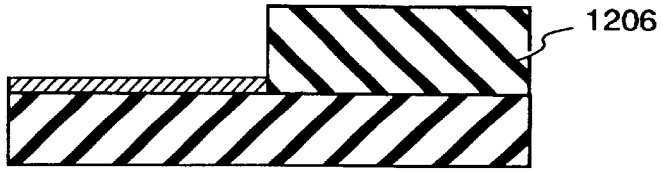
FIG. 32B is a diagram illustrating a step for manufacturing step-type surface-conduction electron emission elements.

(2) Next, an insulating layer for forming the step forming member is built up, as shown in FIG. 32B. It will suffice if this insulating layer is formed by building up $SiO_2$ using the sputtering method. However, other film forming methods may be used, such as vacuum deposition or printing, by way of example.

Figure 32C:
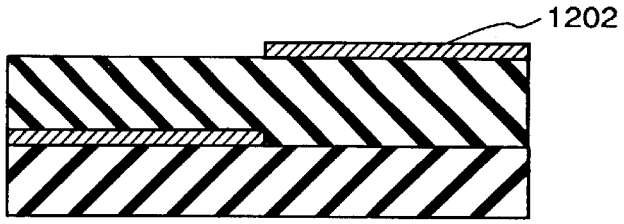
FIG. 32C is a diagram illustrating a step for manufacturing step-type surface-conduction electron emission elements.

(3) Next, the element electrode 1202 is formed on the insulating layer, as shown in FIG. 32C.

Figure 32D:
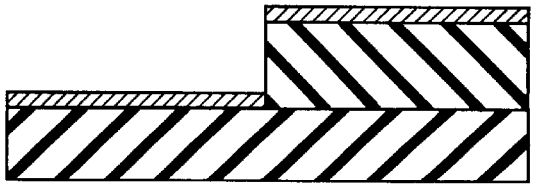
FIG. 32D is a diagram illustrating a step for manufacturing step-type surface-conduction electron emission elements.

(4) Next, part of the insulating layer is removed as by an etching process, thereby exposing the element electrode 1203, as shown in FIG. 32D.

Figure 32E:
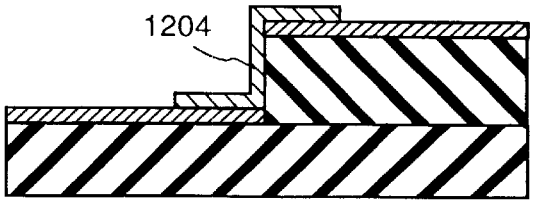
FIG. 32E is a diagram illustrating a step for manufacturing step-type surface-conduction electron emission elements.

(5) Next, the electrically conductive thin film 1204 using the film of fine particles is formed, as shown in FIG. 32E. In order to form the electrically conductive thin film, it will suffice to use a film forming technique such as painting in the same manner as in the case of the planar-type element.

(6) Next, an energization forming treatment is carried out in the same manner as in the case of the planar-type element, thereby forming the electron emission portion. (It will suffice to carry out a treatment similar to the planar-type energization forming treatment described using FIG. 28C.)

(7) Next, as in the case of the planar-type element, the electrification activation treatment is performed to deposit carbon or a carbon compound on the vicinity of the electron emission portion. (It will suffice to carry out a treatment similar to the planar-type electrification activation treatment described using FIG. 28D.)

Figure 32F:
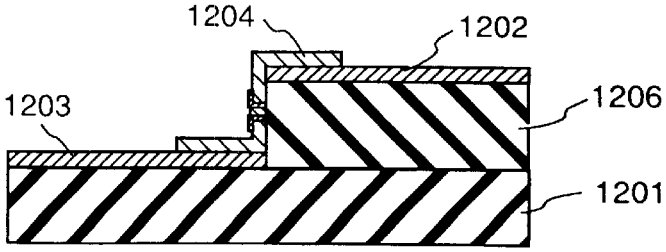
FIG. 32F is a diagram illustrating a step for manufacturing step-type surface-conduction electron emission elements.

Thus, the step-type surface-conduction electron emission element shown in FIG. 32F is manufactured as set forth above.

(Characteristics of surface-conduction electron emission element used in display apparatus)

The element construction and method of manufacturing the planar- and step-type surface-conduction electron emission elements have been described above. The characteristics of these elements used in a display apparatus will now be described.

FIG. 23 illustrates a typical example of an (emission current Ie) vs. (applied element voltage Vf) characteristic and of an (element current If) vs. (applied element voltage Vf) characteristic of the elements used in a display apparatus. These characteristics are changed by changing the design parameters such as the size and shape of the elements.

The elements used in this display apparatus have the following three features in relation to the emission current Ie:

First, when a voltage greater than a certain voltage (referred to as a threshold voltage Vth) is applied to the element, the emission current Ie suddenly increases. When the applied voltage is less than the threshold voltage Vth, on the other hand, almost no emission current Ie is detected. In other words, the element is a non linear element having the clearly defined threshold voltage Vth with respect to the emission current Ie.

Second, since the emission current Ie varies in dependence upon the voltage Vf applied to the element, the magnitude of the emission current Ie can be controlled by the voltage Vf.

Third, since the response speed of the current Ie emitted from the element is high in response to a change in the voltage Vf applied to the element, the amount of charge of the electron beam emitted from the element can be controlled by the length of time over which the voltage Vf is applied.

By virtue of the foregoing characteristics, surface-conduction electron emission elements are ideal for use in a display apparatus. For example, in a display apparatus in which a number of elements are provided to correspond to pixels of a displayed image, the display screen can be scanned sequentially to present a display if the first characteristic mentioned above is utilized. More specifically, a voltage greater than the threshold voltage Vth is suitably applied to driven elements in conformity with a desired light-emission luminance, and a voltage less than the threshold voltage Vth is applied to elements that are in an unselected state. By sequentially switching over elements driven, the display screen can be scanned sequentially to present a display.

Further, by utilizing the second characteristic or third characteristic, the luminance of the light emission can be controlled. This makes it possible to present a grayscale display.

(Structure of multiple electron beam source having number of elements wired in form of simple matrix>Described next will be the structure of a multiple electron beam source obtained by arraying the aforesaid surface-conduction electron emission elements on a substrate and wiring the elements in the form of a matrix.

Figure 33:
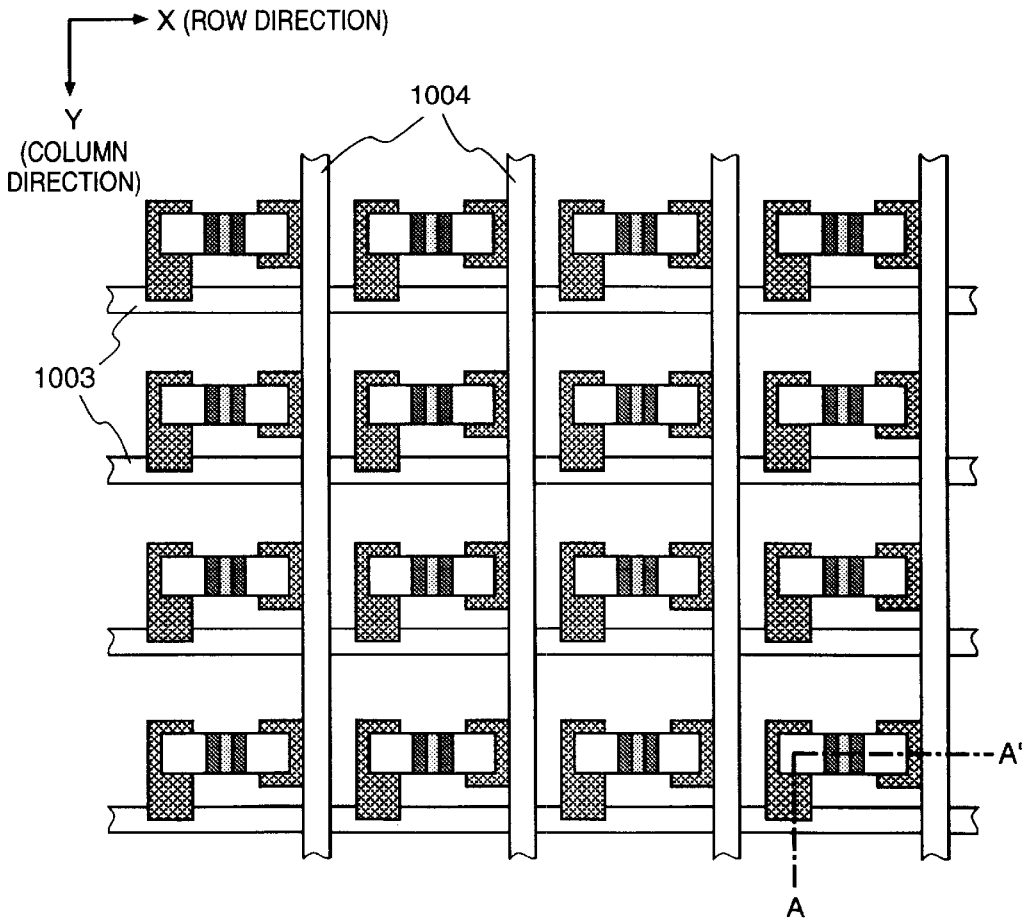
FIG. 33 is plan view showing the substrate of a multiple electron source.

FIG. 33 is a plan view of a multiple electron beam source used in the display panel of FIG. 12. Here surface-conduction electron emission elements similar to the type shown in FIG. 27 are arrayed on the substrate and these elements are wired in the form of a matrix by the row-direction wiring electrodes 1003 and column-direction wiring electrodes 1004. An insulating layer (not shown) is formed between the electrodes at the portions where the row-direction wiring electrodes 1003 and column-direction wiring electrodes 1004 intersect, thereby maintaining electrical insulation between the electrodes.

Figure 34:
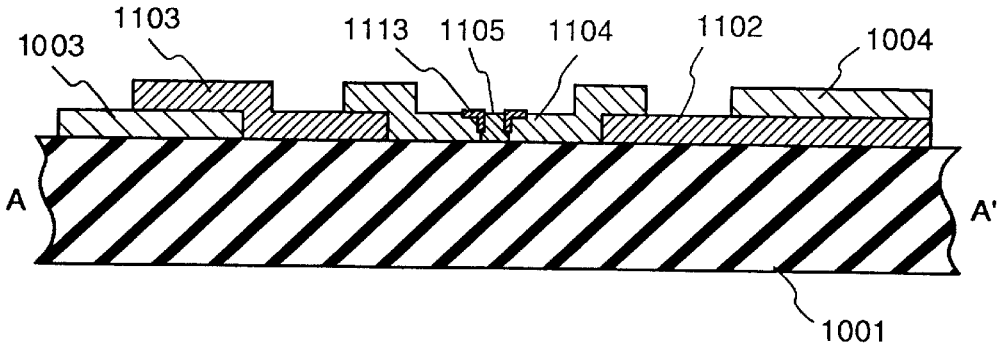
FIG. 34 is sectional view showing the substrate of a multiple electron source.

FIG. 34 is a sectional view taken along line A–A' of FIG. 33.

It should be noted that the multiple electron source having this structure is manufactured by forming the row-direction wiring electrodes 1003, column-direction wiring electrodes 1004, inter-electrode insulating layer (not shown) and the element electrodes and electrically conductive thin film of the surface-conduction electron emission elements on the substrate in advance, and then applying the energization forming treatment and electrification activation treatment by supplying current to each element via the row-direction wiring electrodes 1003 and column-direction wiring electrodes 1004.

Second Embodiment

A second embodiment of the present invention will now be described with reference to FIG. 19.

The structure of the surface-conduction electron emission elements and panel in the second embodiment is the same as that of the first embodiment.

Figure 19:
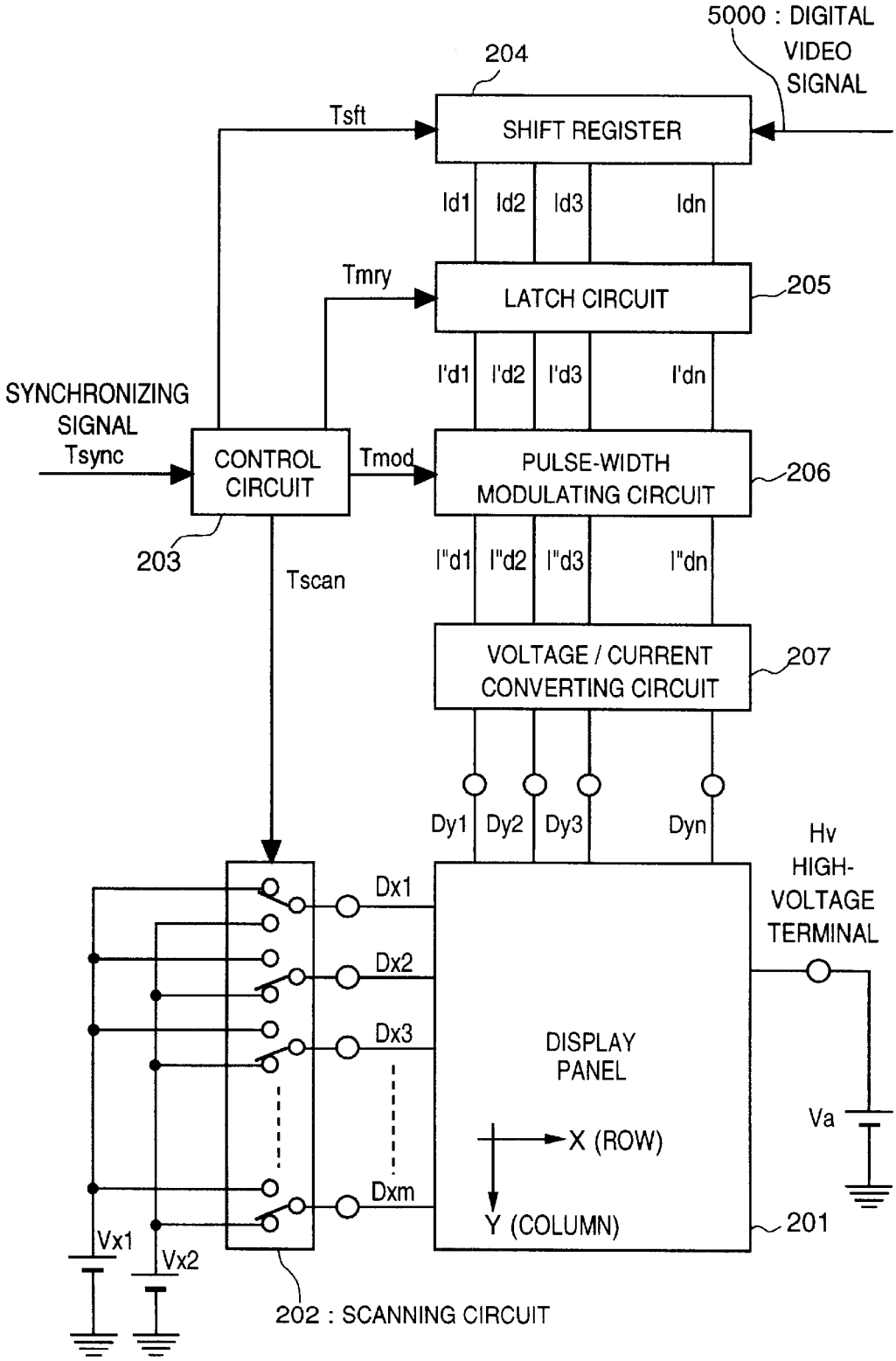
FIG. 19 is a diagram showing the construction of an image display apparatus according to a second embodiment.

In FIG. 19, numeral 201 denotes a display panel in which the aforementioned surface-conduction electron emission elements are arranged in the form of a matrix. This panel is the same as the panel 101 described in the first embodiment.

Further, a scanning circuit 202, control circuit 203, shift register 204 and latch circuit 205 are identical with the scanning circuit 102, control circuit 103, shift register 104 and latch circuit 105 described in the first embodiment.

Numeral 206 denotes a pulse-width modulating circuit which generates a signal having a pulse width conforming to the latched data. The pulse-width modulating circuit 206 is controlled by a timing signal Tmod, which signifies a request for modulating in row units, from the control circuit 203.

Numeral 207 denotes a voltage/current converting circuit, which identical with that of the first embodiment.

Figure 20A:
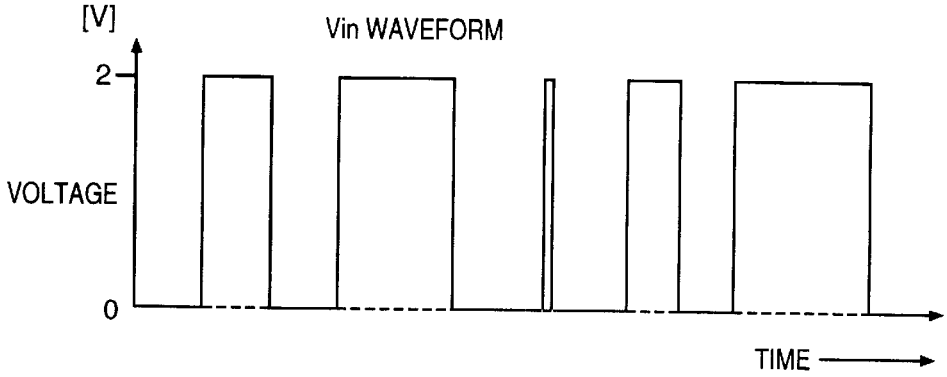
FIG. 20A is a diagram showing a pulse-width-modulated signal waveform, which is input to the voltage/current converting circuit of the second embodiment.
Figure 20B:
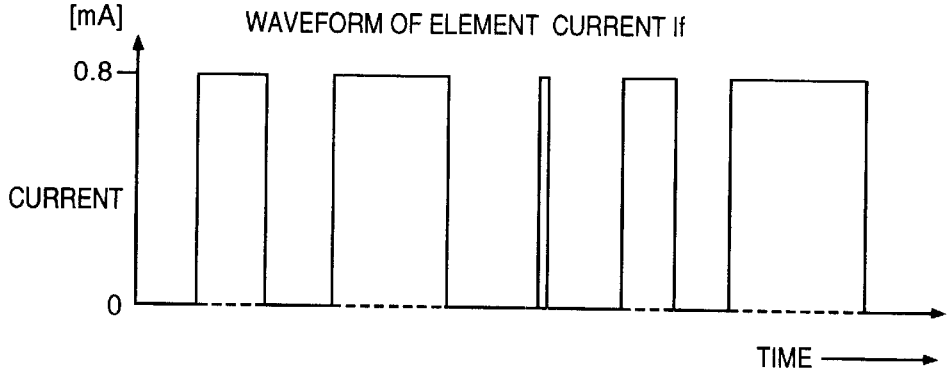
FIG. 20B is a diagram showing the waveform of an output current from the voltage/current converting circuit of the second embodiment.
Figure 20C:
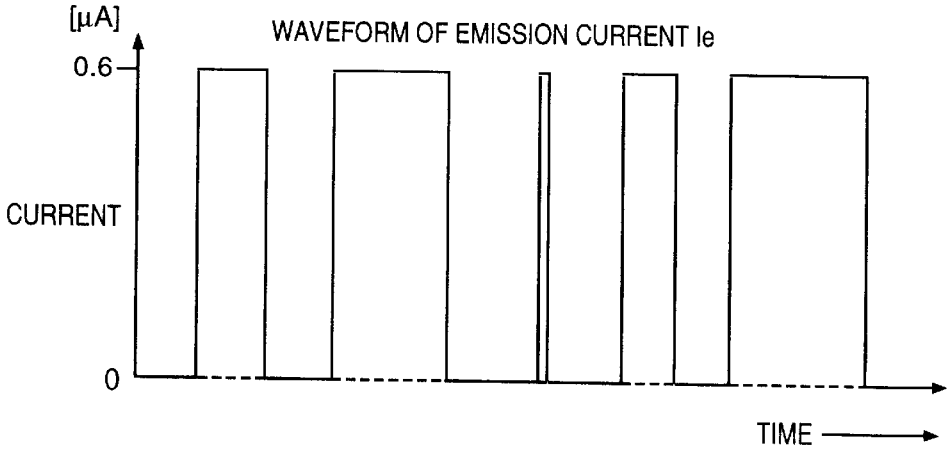
FIG. 20C is a diagram showing the waveform of an emission current from an electron emission element according to the second embodiment.

The manner in which actual input waveforms from the pulse-width modulating circuit 206 are converted by the voltage/current converting circuit 207 is shown in FIGS. 20A~20C. FIG. 20A illustrates the input voltage waveform, FIG. 20B the waveform of the current which flows into an element, and FIG. 20C the waveform of current emitted.

By virtue of the arrangement described above, it is possible to improve upon the leakage current fluctuation in this embodiment as well, thus making it possible to perform drive at a substantially uniform distribution. As a result, a high-quality image having little luminance distribution can be formed.

In this embodiment, a digital video signal (indicated at numeral 5000 in FIG. 19), which readily lends itself to data processing, is used as the input video signal. However, this does not impose a limitation upon the invention, for an analog video signal may be used.

Further, in this embodiment, the shift register 204, which is convenient in terms of processing a digital signal, is employed in the serial/parallel conversion processing. However, this does not impose a limitation upon the invention. For example, by controlling storage addresses in such a manner that these addresses are changed in successive fashion, use may be made of an random-access memory having a function equivalent to that of the shift register.

By virtue of the arrangement described above, it is possible to improve upon the problem of inconstant leakage current. This makes it possible to perform drive at a substantially uniform distribution in relation to the amount of electron emission from each electron source. As a result, a high-quality image having little luminance distribution can be formed.

The display apparatus of this embodiment can be applied widely in a television apparatus and in a display apparatus connected directly or indirectly to various image signal sources such as computers, image memories and communication networks. The image display apparatus is well suited to large-screen displays that display images having a large capacity.

The present invention is not limited solely to applications in which there is direct viewing by a human being. The present invention may be applied to a light source of an apparatus which records a light image on a recording medium by light, as in the manner of a so-called optical printer.

In this embodiment, the invention is applied to surface-conduction electron emission elements which, because of their structure and ease of manufacture, are the best suited of the cold cathode electron sources for application to a display apparatus. However, the applicable is applicable to other cold cathode electron sources as well.

Third Embodiment

Figure 21:
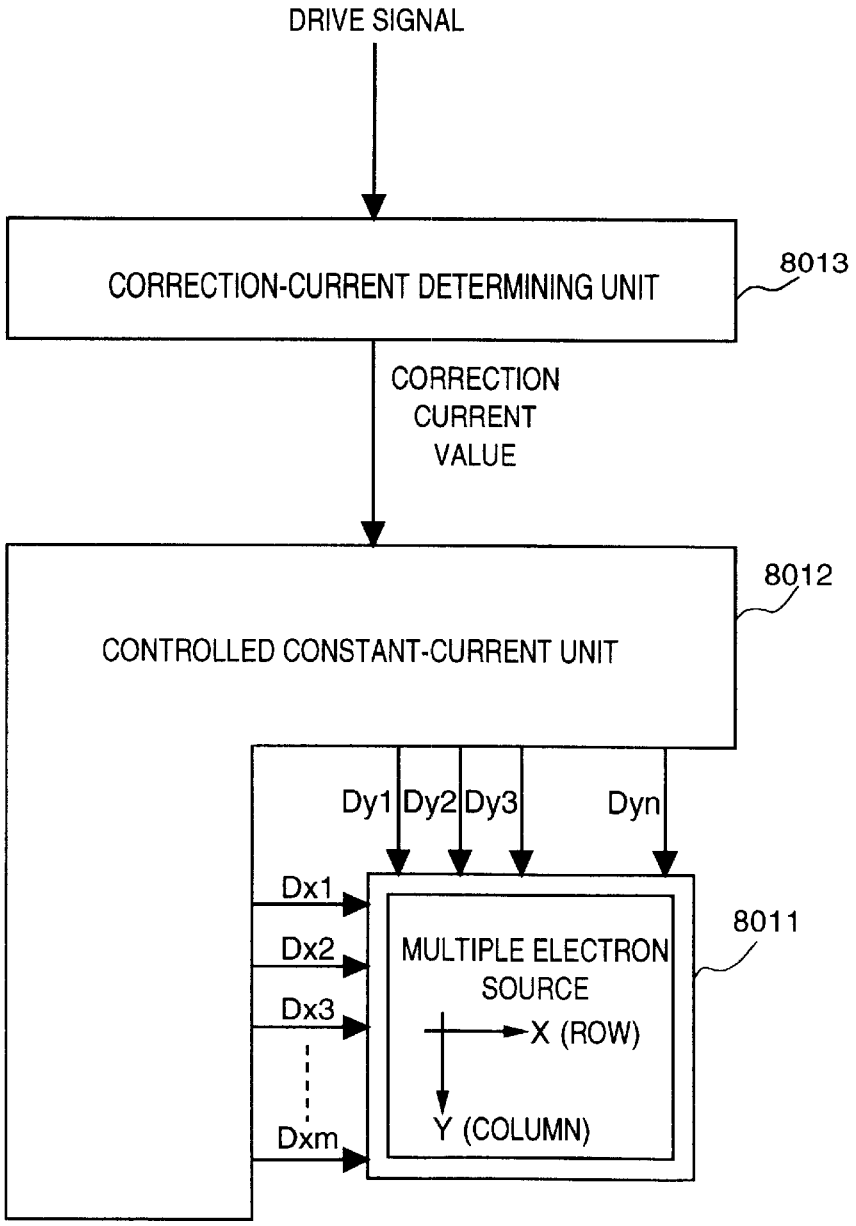
FIG. 21 is a diagram showing an arrangement for driving a multiple electronic source according to a third embodiment.

A third embodiment will now be described with reference to FIG. 21. Shown in FIG. 21 are an electron generating device 8011 having a plurality of elements, a controlled constant current unit 8012 for passing a constant current, a correction-current determining unit 8013, and column wires $D_{y1}$, $D_{y2}$, . . . , $Dy_n$ and row wiring terminals $D_{x1}$, $D_{x2}$, . . . , $D_{xm}$ of the electron generating device 8011.

The correction-current determining unit 8013 corrects a drive signal and produces a correction current waveform. The correction current waveform is used by the controlled constant-current unit 8012 to decide currents to be passed through the terminals $D_{y1}$, $D_{y2}$, . . . , $D_{yn}$ or $D_{x1}$, $D_{x2}$, . . . , $D_{xm}$ The correction-current determining unit 8013 can include a LUT (look-up table) for storing a variance in leakage current which flows into elements other than a selected element of a column wire or row wire, and an arithmetic circuit which produces a correction current for adding this leakage current to the current of the selected element. Further, the correction-current determining unit 8013 can include a current monitoring circuit which measures a leakage current, and a correction-data creating circuit for creating a LUT (look-up table). Furthermore, the correction-current determining unit 8013 can include a LUT (look-up table) for storing leakage resistance, namely the resistance of a leakage current component in a column wire or row wire, and a voltage monitoring circuit for measuring the potential of the terminals $D_{y1}$, $D_{y2}$, . . . , $D_{yn}$ or $D_{x1}$, $D_{x2}$, . . . , $D_{xm}$.

In order to decide the correction current, use may be made of a LUT storing leakage current, a LUT storing wiring resistance of a leakage current component, or a LUT storing electron-beam generation efficiency of an element.

The controlled constant-current unit 8012 includes a controlled current source which drives current through a column wire or row wire, based on a correction current waveform outputted by the correction current determining unit. When the correction current waveform is outputted as a voltage signal, a V/I converting circuit can be used as the controlled current source. The V/I converting circuit may be a current mirror circuit which constructs a controlled constant-current source, a circuit having a Darlington-connected transistor, a constant-current diode, etc. Further, the correction current waveform can be set for each respective column wire or row wire.

Examples of the cold cathode elements are surface-conduction electron emission elements or field emitter (FE) elements which generate electrons when a voltage is applied thereto. It is believed to be easier for a current to flow through a surface-conduction electron emission element than through an FE element. For this reason, major advantages are obtained by applying the present invention to surface-conduction electron emission elements.

An image display apparatus to which the present invention is applied can be used in a television or computer monitor and is particularly well suited to large-screen displays.

By using the controlled constant-current unit 8012 of this embodiment, the e,ossopm current fluctuation due to the leakage current fluctuation mentioned above can be prevented. By using the LUT storing element electron-beam generation efficiency and the correction-data creating circuit in the correction-current determining unit 8013, the variance in electron emission quantity, which depends upon the particular element can be corrected. By using the LUT storing leakage current and the correction-data creating circuit of the correction-current determining unit 8013, leakage current to half-selected elements can be compensated for while correcting for a disparity in leakage current for each wire mentioned above, thus making it possible to obtain an electron-emission quantity in line with the video luminance signal. Furthermore, by using the LUT storing leakage resistance and the voltage monitoring circuit of the correction-current determining unit 8013, it is possible to prevent a variation in the strength of electron beams, which are emitted from the cold cathode elements, owing to the pattern of the display image mentioned above.

Thus, by using the electron generating device of this embodiment, a constant current can be passed through the elements. Since the constant current is the optimum constant current for a selected element, it is possible to obtain an amount of emission electron current that is uniform for each element.

Furthermore, by using the image display apparatus of this embodiment, an optimum current flows through the selected element. As a result, there is obtained an image display apparatus in which there is no variance in the amount of electron-beam emission of each element and, hence, no non-uniformity in brightness.

Fourth through eighth embodiments described next are examples of an image display apparatus. A multiple electron source composed of surface-conduction electron emission elements is used as the electron source of an image display apparatus. Pixels and surface-conduction electron emission elements are in one-to-one correspondence. Consequently, the surface-conduction electron emission elements include surface-conduction electron emission elements corresponding to red pixels, surface-conduction electron emission elements corresponding to blue pixels and surface-conduction electron emission elements corresponding to green pixels. If a current is passed through a selected surface-conduction electron emission element, the pixel corresponding thereto emits light. Accordingly, if image processing is executed and a plurality of surface-conduction electron emission elements are selected, an image display can be presented without deflecting electrons, as is done in a CRT-type image display apparatus. When a plurality of surface-conduction electron emission elements in a multiple electron source are selected, a current is passed through the column wiring or row wiring connected to each of these elements. At this time a constant current which does not change in one horizontal scanning interval is passed through the column wiring.

In the fourth through eighth embodiments, the invention is described with regard to a color-image display apparatus in which one surface-conduction electron emission element corresponds to one pixel of a respective one of the colors R, G, B. However, the invention may be applied to any device so long as it is one based upon the technical concept of the electron generating device of the present invention. For example, the invention may be used not only as a color-image display apparatus but also as a monochromatic image display apparatus or as a light source for forming the image in an optical printer. Further, the invention may also be used as an exposure device for positive-type or negative-type resist. Furthermore, the cold cathode elements are not limited to surface-conduction electron emission elements.

Further, with regard to drive of the image display according to the fourth through eighth embodiments, a description is given of simultaneous drive of the elements in one row, in which one row is lit continuously during the time (1 H) that one row is being scanned for the purpose of obtaining a bright display by buying ON time for the pixels.

Though the correction calculations are performed after making a conversion to a serial signal, these calculations may be performed using a parallel signal. When correction calculations are performed using a parallel signal, the output current of the V/I converting circuit may be changed by changing the resistance values of the resistors in the V/I converting circuit. According to the fourth through eighth embodiments, the V/I converting circuit is disposed in the column wiring and a constant current is passed through the column wiring.

In the fourth through sixth embodiments, correction of a variance in the leakage current of column wiring using a LUT 1 and correction of a variance in electron emission efficiency using a LUT 2 are performed simultaneously. However, the correction of a variance in the leakage current and correction of a variance in electron emission efficiency may be performed simultaneously. In the seventh and eighth embodiments, the potential of column wiring is measured when the image display is being driven and the current that is to be passed through the column wiring is decided based upon this potential in order to compensate for a change in voltage of the column wiring due to the number of elements lit in the same row. These embodiments may also be adapted to correct the electron emission efficiency of the elements by using the LUT 2 in the manner set forth through sixth embodiments.

Fourth Embodiment

The general features of the fourth embodiment will now be described first. This will be followed by a description of a method of creating the LUT 1, which stores the leakage current of each column wire, and the LUT 2, which stores the electron emission efficiency of each element. Described in detail next will be the actual drive of the image display.

{4-1. General features of the fourth embodiment}

In the fourth embodiment, a current, which is obtained by adding the leakage current of a column wire and a current which is compensation for a variance is electron emission efficiency of an individual element, is used as a constant current passed through the column wire. An image luminance signal for displaying video is represented by the pulse width of this constant current.

Figure 22:
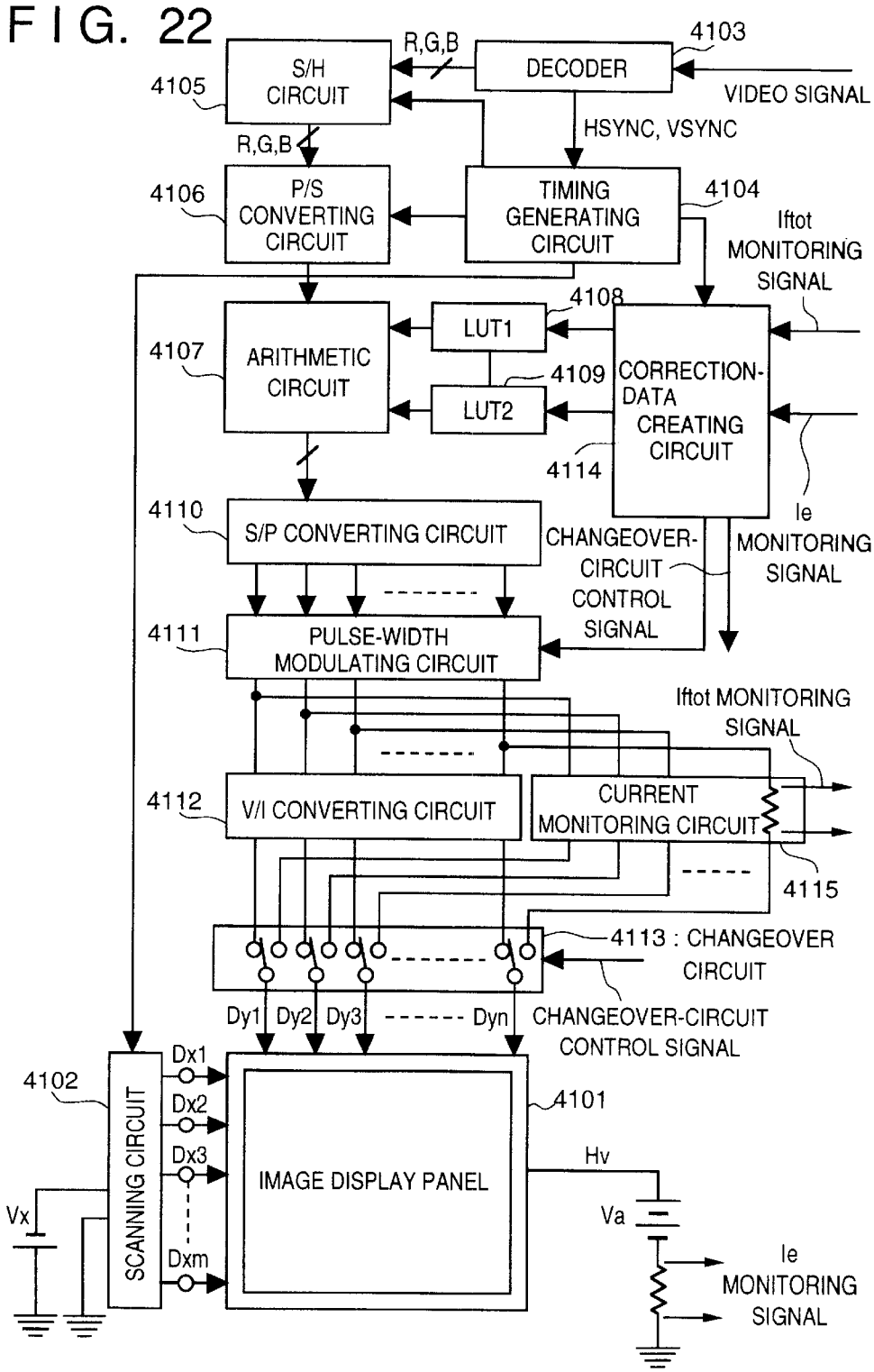
FIG. 22 is a diagram showing an arrangement for driving a multiple electronic source according to fourth and sixth embodiments.

FIG. 22 is a diagram which best shows the features of this embodiment. This illustrates the flow of a video signal from entry of the signal to delivery of the signal to a multiple electron source. In FIG. 22, numeral 4101 denotes an image display panel beneath which a multiple electron source is disposed. A face plate connected to a high-voltage source Va is placed above the multiple electron source so as to accelerate electrons generated by the multiple electron source. $D_{x1}$~$D_{xm}$ represent row wires of the multiple electron source, and $D_{y1}$~$D_{yn}$ represent column wires of the multiple electron source. The terminals of these wires are connected to an external electric circuit.

A scanning circuit 4102 is internally equipped with m-number of switching elements connected to respective ones of the wires $D_{x1}$~$D_{xm}$. On the basis of a control signal Tscan outputted by a timing signal generating circuit 4104, the m-number of switching elements successively switch the voltages of the wires $D_{x1}$~$D_{xm}$ from a non-selection voltage Vns to a selection voltage Vs. Assume now that the selection voltage Vs is a voltage Vx of a DC power supply and that the non-selection voltage Vns is 0 V (ground level). FIG. 23 is a graph showing the relationship between the element voltage Vf and element current If of a surface-conduction electron emission element used in this embodiment, or the relationship between the element voltage Vf and emission current Ie of the surface-conduction electron emission element. As shown in FIG. 23, the surface-conduction electron emission element is such that the element current If starts rising from an element voltage of 7 V, which is just ahead of a threshold voltage Vth of 8 V. Accordingly, the voltage Vx of the DC voltage source is set in such a manner that a constant voltage of −7 V is outputted to a row wire to be selected.

The flow of a video signal will now be described next. An entered composite video signal is separated into luminance signals (R, G, B) of the three primary colors, a horizontal synchronizing signal (HSYNC) and a vertical synchronizing signal (VSYNC) by a decoder 4103. A timing generator 4104 generates various timing signals synchronized to the HSYNC and VSYNC signals. The R, G, B luminance signals are sampled and held at a suitable timing by an S/H (sample-and-hold) circuit 4105. The signals held in the S/H circuit 4105 are applied to a parallel/serial (P/S) converter 4106, which converts the signals to a serial signal arrayed in a numerical order corresponding to the array of each of the R, G, B phosphors of the image display apparatus. This serial video signal is outputted to an arithmetic circuit 4107. The latter combines this serial video signal with a signal from a LUT 1, in which values of leakage currents that flow into half-selected elements are stored upon being measured in advance, and an signal from a LUT 2, in which electron emission efficiencies of respective elements with regard to applied voltages are stored. Next, the serial video signal is converted to a parallel video signal of each and every row by an S/P (serial/parallel) converting circuit 4110.

Next, a pulse-width modulating circuit 4111 generates constant-voltage drive pulses having a pulse width (pulse-application time) corresponding to the video signal intensity. A variance in the efficiency of each element is reflected in the pulse height (voltage value of the pulse). The constant-voltage drive pulses are converted to constant-current pulses by a V/I converting circuit 4112. Finally, the constant-current pulses are applied surface-conduction electron emission elements in the multiple electron source, through the terminals of the column-direction wires $D_{y1}$~$D_{yn}$ of the multiple electron source, by a changeover circuit 4113. In a column to which a constant-current pulse has been supplied, only the surface-conduction electron emission element in the row to which the scanning circuit 4102 has been sent will emit an electron beam. Only the phosphor of the pixel (dot) in the image display apparatus that corresponds to the surface-conduction electron emission element emitting the electron beam emits light. Thus, the row to which the scanning circuit 4102 applies the selection pulse is successively scanned, thereby making it possible to display a two-dimensional image.

{4-2. Creation of LUTs}

The LUTs are created because the compensating values differ for each element. When an element is selected, therefore, each compensating value corresponding to the selected element is read out of the LUT in special fashion. A LUT is a semiconductor memory such as a RAM or ROM from which data can be read out at high speed in conformity with the image display. The leakage current of a column wire which prevails when each element is selected is stored in the LUT 1. The electron emission efficiency of each element is stored in the LUT 2.

Figure 24A:
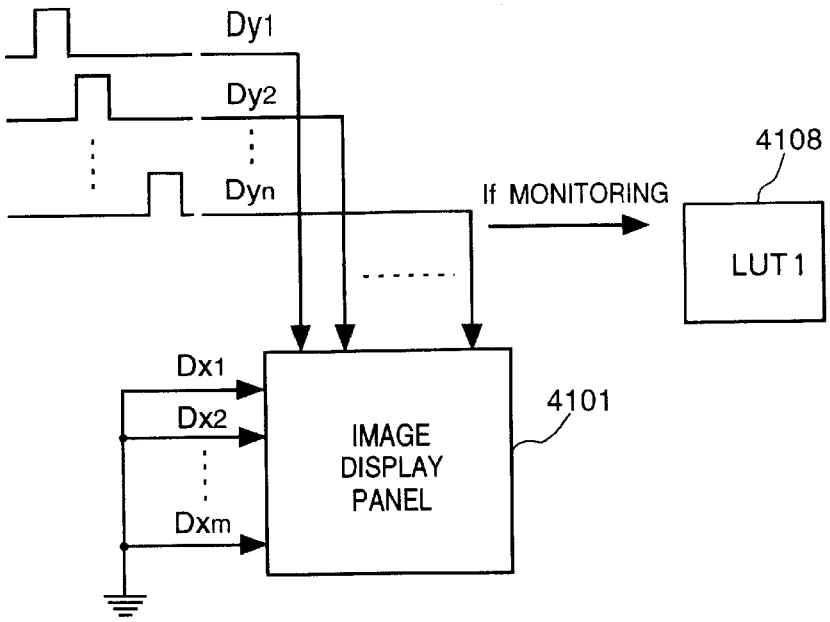
FIG. 24A is a schematic view showing a method of creating a LUT in fourth through seventh embodiments.

A procedure for creating the LUT 1 after the completion of the image display apparatus will be described first. FIG. 24A illustrates a procedure for creating the LUT 1, in which the leakage currents of column wires are stored in advance. When the LUT 1 is created, the outputs $D_{x1}$, $D_{x2}$, . . . , $D_{xm}$ of the scanning circuit 4102 are all made 0 V. Under these conditions, the pulse-width modulating circuit 4111 generates a voltage pulse having a voltage value Vd:try, which is a selection voltage (e.g., 7.5 V, which is a voltage below the threshold value), and applies this voltage pulse to the terminals from $D_{y1}$ to $D_{yn}$ in succession. Under the application voltage Vd:try, any element whatsoever is in the half-selected state and therefore does not light. The timing generating circuit 4104 performs timing control conforming to the data at the time of LUT creation. At this time a correction-data creating circuit 4114 generates a control signal in such a manner that the output of the pulse-width modulating circuit 4111 is applied to the terminals $D_{y1}$, $D_{y2}$, . . . ,b $D_{yn}$ of the image display panel 4101 via a current monitoring circuit 4115. The latter detects the element current If, which flows into each column wire, using a monitor resistor within the current monitor circuit 4115.

The current which flows into a column wire N (where N has any value of from 1 to n) measured by the current monitoring circuit 4115 is the sum of the sum total of element currents, which flow when the voltage Vd:try is applied to m-number of surface-conduction electron emission elements residing on the column wire N, and a current, such as leakage current from the column wire, which flows through portions other than the elements. In other words, if we let If:try:leak(N) represent a current which flows through the column wire N when all elements in the column wire N are in the half-selected state, we have $$\text{If:try:leak}(N) = \text{Iout:leak} + \sum_{k=1}^{m} \text{If}\{Vd:\text{try}(K, N)\} \quad (1\text{-}1)$$

[where Iout:leak is leakage current from the column wire ascribable to portions other than the elements, and If{Vd:try (K,N)} is the element current of an element (K,N) when the voltage Vd:try is applied to the terminal DyN].

At the time of actual drive of an image display, how the selection voltage should be applied to a column wire or row wire is considered. When the image display is actually driven, selected elements are scanned one row at a time in the vertical direction. This means that there is only one selected element in the column wire when the image display is driven. Accordingly, in drive of the image display, assume that the scanning circuit 102 applies the selection voltage Vs (<0) only to the row wire M to scan the row wire M. At this time the current which flows into the column wire N is the sum of the current If{(Vd−Vs)(M,N)} which flows into a selected element and all currents If{Vd(k,N)} (k≈M) which flow into elements other than the selected element. Accordingly, if we let If:tot(M,N) represent the current which flows into the column wire N when the row wire M is being scanned in drive of the image display, then we have $$\text{If:tot}(M, N) = \text{Iout:leak} + \sum_{k=1}^{m} \text{If}\{Vd(k, N)\}(k \neq M) + \text{If}\{(Vd - Vs)(M, N)\} \quad (1\text{-}2)$$

where the sum ΣIf{Vd(k,N)} (k≈M) of the currents which flow into elements other than the selected element corresponds to the leakage current. Accordingly, we let If:leak(N) represent the leakage current of the column wire N when the row wire M is being scanned in drive of the image display, then we have $$\text{If:leak}(N) = \text{Iout:leak} + \sum_{k=1}^{m} \text{If}\{Vd(k, N)\}(k \neq M) \quad (1\text{-}3)$$

It should be noted that when Vd<Vth (threshold voltage) <Vd−Vs holds, If{Vd(k,N)} is a negligibly small value in comparison with If{(Vd−Vs) (M,N)}, as evident from the Vf−If characteristic of the surface-conduction electron emission element in FIG. 23. Further, in an image display apparatus actually used, it is noteworthy that m is greater than 100. This means that If:try:leak(N) of (1-1) and If:leak (N) of (1-3) may be construed as being essential equal. It does not matter even if the leakage current is made If:try:leak(N). Accordingly, If:try:leak(N) will be adopted as the leakage current If:leak(N) hereinafter.

In actuality, a trace current flows even if only the half-selection voltage Vd (since the voltage of the row wire is zero, Vd=Vf holds) is applied to each element. This means that if the size of the matrix is enlarged so that m or n exceeds 100, If:leak(N) will become a large current that is not negligible. As a result of this current, the current which is to flow into a selected element (to which Vf is applied) will flow into the other elements in the half-selected state and there is a possibility that an electron beam conforming to the video luminance signal will be incapable of being emitted from the selected element.

In this embodiment, therefore, If:leak(N) is passed through the column wire N in addition to a current If:eff(N) passed through the selected element, thereby compensating If:eff(N). To this end, it is convenient to store If:leak(N) in the LUT 1 in advance. Accordingly, the LUT 1 is given an address space of 1×n and values of If:leak(N) measured n times are stored at respective addresses of the LUT. For example, If:leak(k) is stored at address (1,k). When an image is displayed and a current is passed through a selected element in the row column N, the value of If:leak(N) is called from the LUT 1 and passed through the column wire in addition to the current passed through the selected element. For example, when the selection current If:eff(N) is passed through the selected element ((M,N), If:leak(N) that has been stored in the LUT 1 is used to pass the following current into the column line N:

$$\text{If:tot}(N)=\text{If:eff}(M,N)+\text{If:leak}(N) \quad (1\text{-}4)$$

When If:leak(N) is measured, the leakage current through elements other than the selected element (M,N) may be measured accurately by the measurement method used to obtain Equation (1-3), and the value of If:leak(M,N) close to the leakage current at the time of the actual image display may be measured. At this time a LUT having an address space of m×n is prepared and If:leak(M,N) of the selected element (M,N) is stored at address (M,N) as LUT 1. If this is done, a more accurate correction can be applied. In actuality, however, If:leak(M,N) does not vary that much due to M. Therefore, it is effective to assume that If:leak (M,N)=If:leak(N) holds, make the necessary address space 1×n as mentioned above, thereby reducing the address space and the number of access operations.

The description thus far is premised upon the fact that the leakage current If:leak(N) of each column wire N is adopted as the quantity stored in LUT 1, and the leakage current If:leak(N) is added as an offset (compensation) to the selected element current If:eff(N) when an image is displayed. However, the leakage current If:leak(N) varies depending upon the voltage applied to the wiring, though the amount of variation is very small. Further, when the change in the applied voltage is sufficiently small, the relationship between the applied voltage Vf and the leakage current If:leak(N) can be construed as being ohmic. Accordingly, it is also effective to store the admittance of each column wire in LUT 1, calculate the leakage current If:leak(N) from this admittance when an image is displayed and add the calculated leakage current If:leak(N) to the selected element current If:eff(N).

Figure 24B:
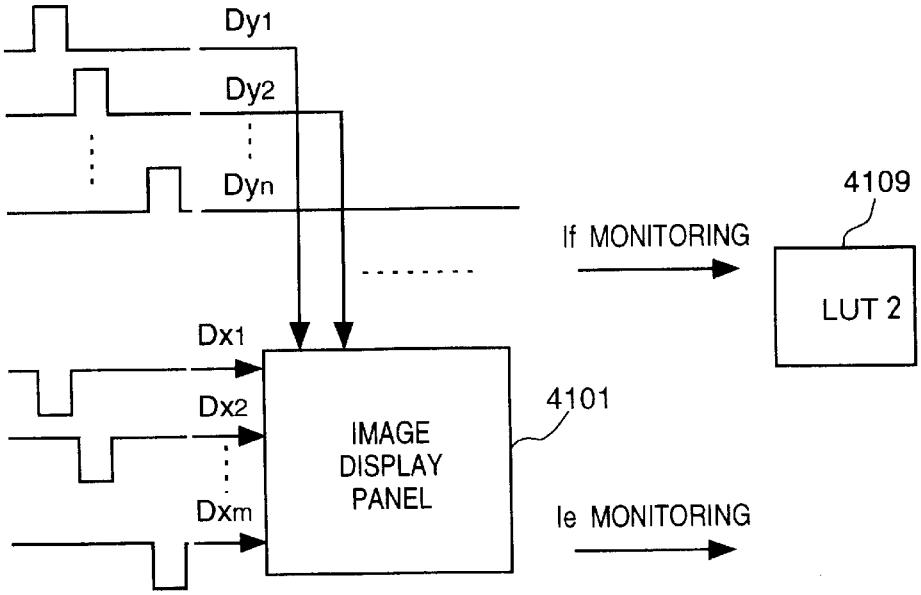
FIG. 24B is a schematic view showing a method of creating a LUT in fourth through seventh embodiments.

A method of fabricating the LUT 2 for storing the electron emission efficiency of each element will be described next. FIG. 24B is a diagram illustrating a method of fabricating the LUT 2. When the LUT 2 is created, the selection voltage Vs (<0) are successively applied to the row wires, in the same manner as when an image is displayed, at the terminals $D_{x1}$, $D_{x2}$, . . . , $D_{xm}$ of the row wires, which are the outputs of the scanning circuit 4104. On the other hand, constant-voltage pulses having a voltage value Vd are successively applied to the terminals $D_{y1}$ to $D_{yn}$ of the column wires by the pulse-width modulating circuit without the intermediary of the V/I converting circuit 4112. This differs from the operation performed when an image is displayed. By adopting this arrangement, a voltage of (Vd−Vs) is applied as the selection voltage Vf to the selected element (M,N) of the column wire N if the voltage drop is negligible. Further, a voltage of Vd, which is substantially the half-selection voltage, is applied to elements other than the selected element (M,N) of the column wire N. Accordingly, if we let If:try:tot(N) represent the total current which flows into the column wire N, we have $$\text{If:try:tot}(N) = \text{Iout:leak} + \sum_{k=1}^{m} \text{If}\{Vd:(k,N)\}(k \neq M) + \text{If}\{(Vd - Vs)(M,N)\} \quad (2\text{-}1)$$

The correction-data creating circuit 4114 creates correction data by calculating the electron emission efficiency of the each element based upon monitoring of the currents If and Ie sensed for each element. This procedure is described below.

The total current If:try:tot(N) which flows into the column wire N is also represented by $$\text{If:try:tot(N)=If:leak(N)+If}\{(\text{Vd}-\text{Vs})(\text{M,N})\} \quad (2\text{-}2)$$

in the same manner as If:tot(N) in Equation (1-2). This If:try:tot(N) can be measured using the current monitoring circuit 4115.

If we let If:try:eff(M,N) represent the current which flows into the selected element in FIG. 24B, then we have $$\text{If:try:eff(M,N)=If}\{(\text{Vd}-\text{Vs})(\text{M,N})\} \quad (2\text{-}3)$$

The electron emission current Ie(M,N) per selection current If:try:eff(M,N) is referred to as the electron emission efficiency. The electron emission current Ie(M,N) is measured by the current monitoring circuit, which is for measuring the electron emission current, placed above the multiple electron source. Accordingly, if we let η(M,N) represent the electron emission efficiency of the element (M,N), we have $$\begin{aligned}\eta(M,N) &= Ie(M,N)/\text{If:try:eff}(M,N) \\ &= Ie(M,N)/\{\text{If:try:tot}(N) - \text{If:leak}(N)\}\end{aligned} \quad (2\text{-}4)$$

Since If:leak(M,N) is called from LUT 1, the electron emission efficiency η(M,N) is stored in LUT 2 in an address space of m×n.

A similar correction can be made using luminance efficiency η' of each pixel (M,N) of the image display panel instead of the emission efficiency η(M,N). Luminance Wlum(M,N) of each pixel corresponding to a surface-conduction electron emission element (M,N) is measured using a device capable of measuring luminance pixel by pixel. The luminance efficiency η'(M,N) of each pixel is represented using the selection current If:eff(M,N) which essentially flows into the surface-conduction electron emission element (M,N) and the luminance Wlum(M,N) of each pixel corresponding to this surface-conduction electron emission element (M,N). The luminance efficiency η'(M,N) can be defined as follows:

$$\eta'(\text{M,N})=\text{Wlum(M,N)/If:eff(M,N)} \quad (2\text{-}5)$$

When the luminance efficiency η'(M,N) is stored in the LUT 2 instead of the electron emission efficiency η, the light-emission efficiency of the phosphor of each pixel also can be subjected to a correction. At this time the luminance efficiency η'(M,N) is merely substituted for the electron emission efficiency η(M,N) of Equation (2-4); the other operations are the same as when the electron emission efficiency η'(M,N) was stored in LUT 2.

Figure 24C:
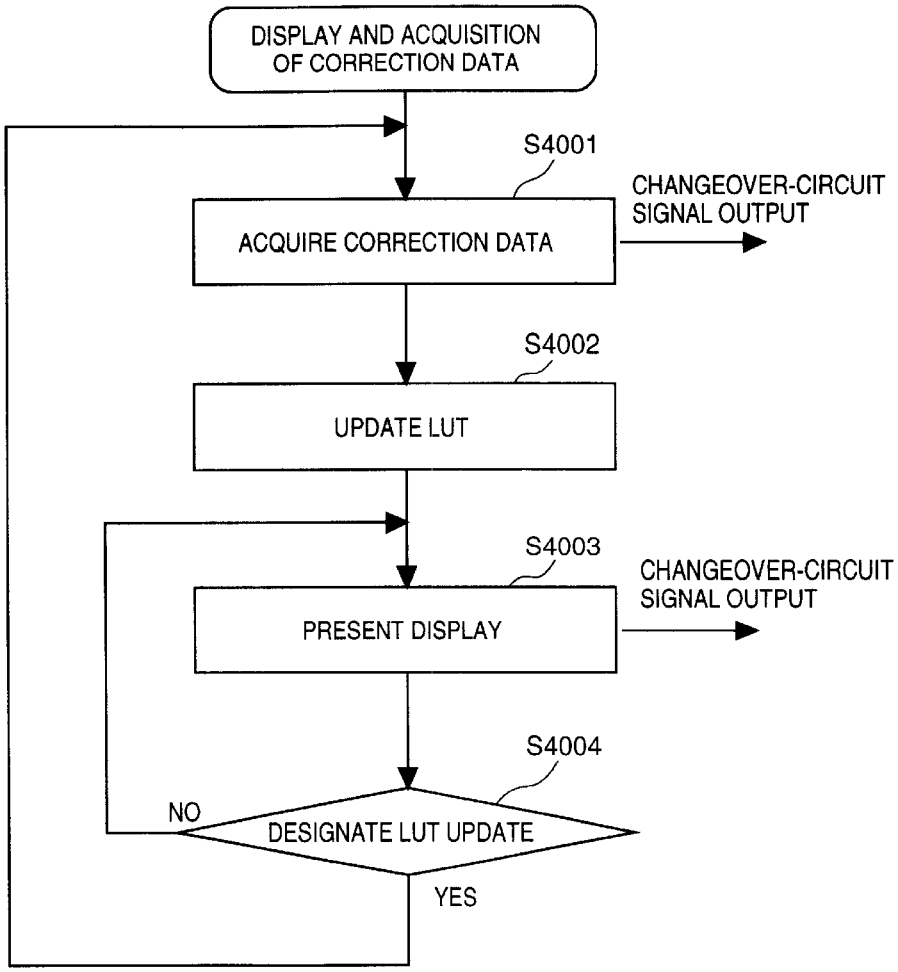
FIG. 24C is a flowchart illustrating a method of creating a LUT in fourth through seventh embodiments.

Not only can the creation of LUT 1 or LUT 2 be performed prior to shipping of the image display apparatus but the LUTs may be re-created when the user introduces power to the apparatus or in the retrace interval of the vertical synchronizing signal (VSYNC) upon elapse of a fixed period of time from display of an image. FIG. 24C is a flowchart for describing a procedure in a case where the LUT 1 is re-created when power is introduced and upon elapse of a fixed period of time from display of an image. First, a signal for changing over the changeover circuit 4113 is generated and each column is measured by the method described above using FIG. 24A (step 4001). The LUT 1 is then created (step S4002). Next, the image is displayed based upon this LUT 1 (step S4003). The second creation of the LUT is performed by sending a LUT-1 update designation signal to the changeover circuit 4113 during the retrace interval of the vertical synchronizing signal (VSYNC), connecting terminals $D_{y1} \ldots Dy_n$ of the respective column wires to the current monitoring circuit 4115 and measuring the leakage current of each column wire by the method described above with reference to FIG. 24A (step S4001). The image is then displayed based upon the new LUT 1 (step S4003). It goes without saying that issuance of the LUT-1 update designation signal is not limited to every retrace interval of the vertical synchronizing signal VSYNC buy may be performed over longer intervals in order to reduce power consumption. It will suffice if re-creation of the LUT 2 is performed when, say, power is introduced to the apparatus. By thus creating the LUTs at fixed intervals, it is also possible to compensate for a change in characteristics caused by aging of the elements, thus making it possible to present a uniform display which is stable over a long period of time.

{4-3. Drive of Image Display}

Figure 25:
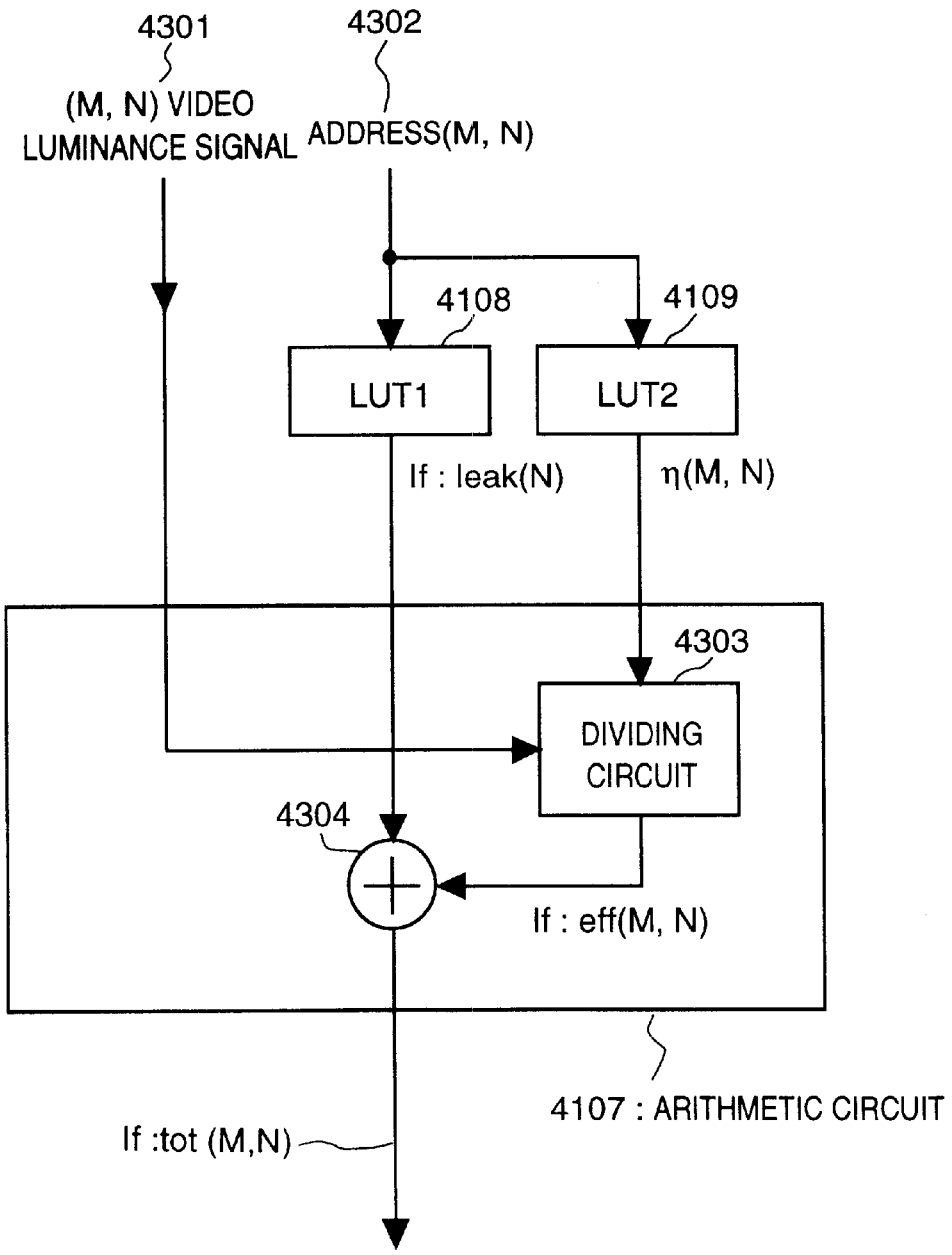
FIG. 25 is a diagram showing an arithmetic circuit according to the fourth embodiment.

Actual drive of an image display in which current passed through a column wire is compensated for by using the LUTs 1 and 2, created as set forth above, will now be described in detail. FIG. 25 is a diagram showing the arithmetic circuit 4107. A video luminance signal enters the arithmetic circuit 4107 from the P/S converting circuit 4106. Assume that a video luminance signal 4301 for lighting the element (M,N) enters at a certain timing. At this time the timing generating circuit 4104 issues an instruction for accessing the address (1,N) of LUT 1 and the address (M,N) of LUT 2 to fetch the correction current quantity If:leak(N) from LUT 1 and the electron emission efficiency η(M,N) from LUT 2. The selection current If:eff(M,N) [=Ie(M,N)/η(M,N)] is obtained from the fetched electron emission efficiency η(M,N) and set reference value Ie of electron emission current. The current If:tot(M,N) [=If:leak(N)+If:eff(M,N)] passed through the column wire N when the element (M,N) is lit is calculated from the obtained If:eff(M,N) and the fetched If:leak(N). This operation is performed by a dividing circuit 4303 and an adder 4304. The signal If:tot(M,N) thus obtained is delivered to the S/P converting circuit 4110. The S/P converting circuit 4110 stores one line of the signal If:tot(M,N) which is sent successively in sync with the HSYNC signal. Furthermore, the pulse-width modulating circuit 4111 converts If:tot(M,N) to a pulse-width modulated signal and distributes this signal to each of the n-number of wires. The distributed n-number of pulse-width modulated signals are supplied to the panel via the V/I converting circuit 4112.

The V/I converting circuit 4112 is a circuit for controlling the current passed through a selected surface-conduction electron emission element in dependence upon the pulse of the entered modulated signal. FIG. 15, which has already been described, shows the internal construction of the circuit 4112. The V/I converting circuit 4112, which is equivalent to the circuit 107 in FIG. 15, is equipped with the V/I converters 301 the number of which is equal to the number (n) of column wires. The outputs of the V/I converting circuit 4112 are connected to the terminals ($D_{y1}$, $D_{y2}$, . . . , $D_{yn}$) of the column wires. FIG. 16, which has already been described, illustrates the internal circuitry of each V/I converter 301.

By way of example, the demand value Ie of the electron emission current is assumed at 1 $\mu$A. If the electron emission efficiency $\eta$(M,N) read out of LUT 2 is 0.1% and the leakage current If:leak(N) of the column wire N read out of LUT 1 is 0.5 mA at this time, then the drive current signal of the column wire N is obtained in accordance with the following equation:

$$\begin{aligned} \mathrm{If:tot}(M,N) &= \mathrm{if:leak}(N) + \mathrm{If:eff}(M,N) \\ &= \mathrm{If:leak}(N) + Ie/\eta(M,N) \\ &= 0.5\ \mathrm{mA} + 1\mu A/0.1\% \\ &= 1.5\ \mathrm{mA} \end{aligned} \tag{3}$$

Figure 26A:
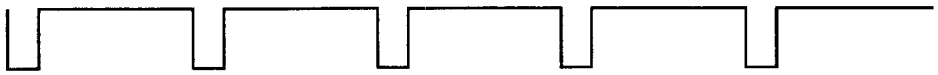
FIGS. 26A to 26G are waveform diagrams of waveforms associated with wiring of a first column according to the fourth embodiment.
Figure 26B:
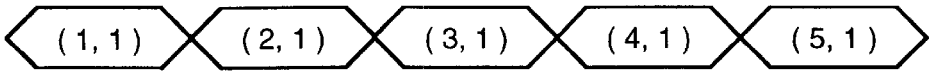
Figure 26C:
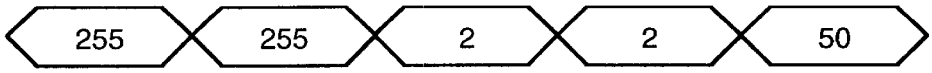
Figure 26D:
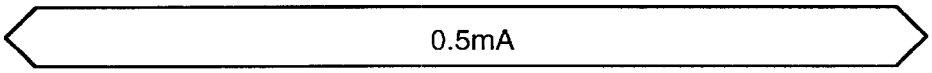
Figure 26E:
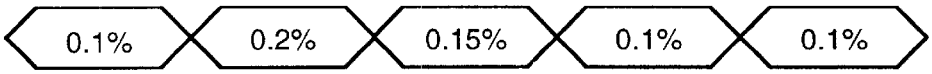
Figure 26F:
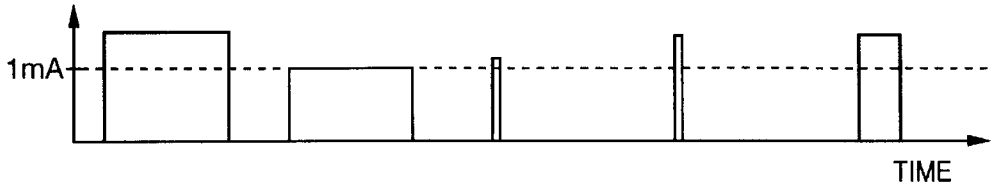
Figure 26G:
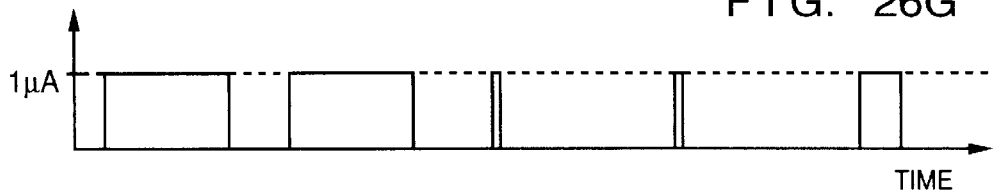

If, when the element (M,N) has been selected, the current of 1.5 mA thus found is passed through the column wire N as a constant current, then electrons are emitted from the element (M,N) in the amount of 1 $\mu$A. FIGS. 26A to 26G are diagrams showing the current passed through a certain column wire, the data in a LUT relating to this column wire, etc. Attention will be directed toward the first column wire of the image display panel to describe a temporal change in data in the circuitry or wiring associated with the first column wire. Here FIG. 26A represents a synchronizing signal, FIG. 26B, the number of a selected element to be lit (this number also represents the number of the LUT1 and LUT 2 accessed), FIG. 26C, a video luminance signal of a selected pixel, FIG. 26D, the reactive current waveform of the first column wire from LUT 1, FIG. 26E, the electron emission efficiency $\eta$(M,N) of each address from the LUT 2, FIG. 26F, the magnitude of the current If:tot(M,1) passed through the wiring of the first column wire, and FIG. 26G, the electron emission current Ie of the selected surface-conduction electron emission element (M,1) (M=1, 2, 3, 4, 5). By performing the calculation of Equation (3), a current waveform [of the kind shown in FIG. 26F] corresponding to each element can be calculated. By performing a correction of current waveform of the kind shown at FIG. 26F, an uniform electron emission current of the kind shown at FIG. 26G is obtained.

{4.4 Effects of Fourth Embodiment}

By passing the leakage current of each column wire stored in LUT 1 through each column wire in conformity with the selection current, it is possible to compensate for the amount of current which flows through unselected elements. Further, a variance in the efficiency of each element can be corrected by using the electron emission efficiency of each surface-conduction electron emission element, or the luminance efficiency of each pixel, which is stored in LUT 2. Therefore, even if a multiple electron source having many electron sources is wired in the form of a matrix, a desired quantity of electron beams can be generated from each electron source. As a result, an image display apparatus using this multiple electron source provides an attractive image that is free of uneven luminance.

Fifth Embodiment

Figure 35:
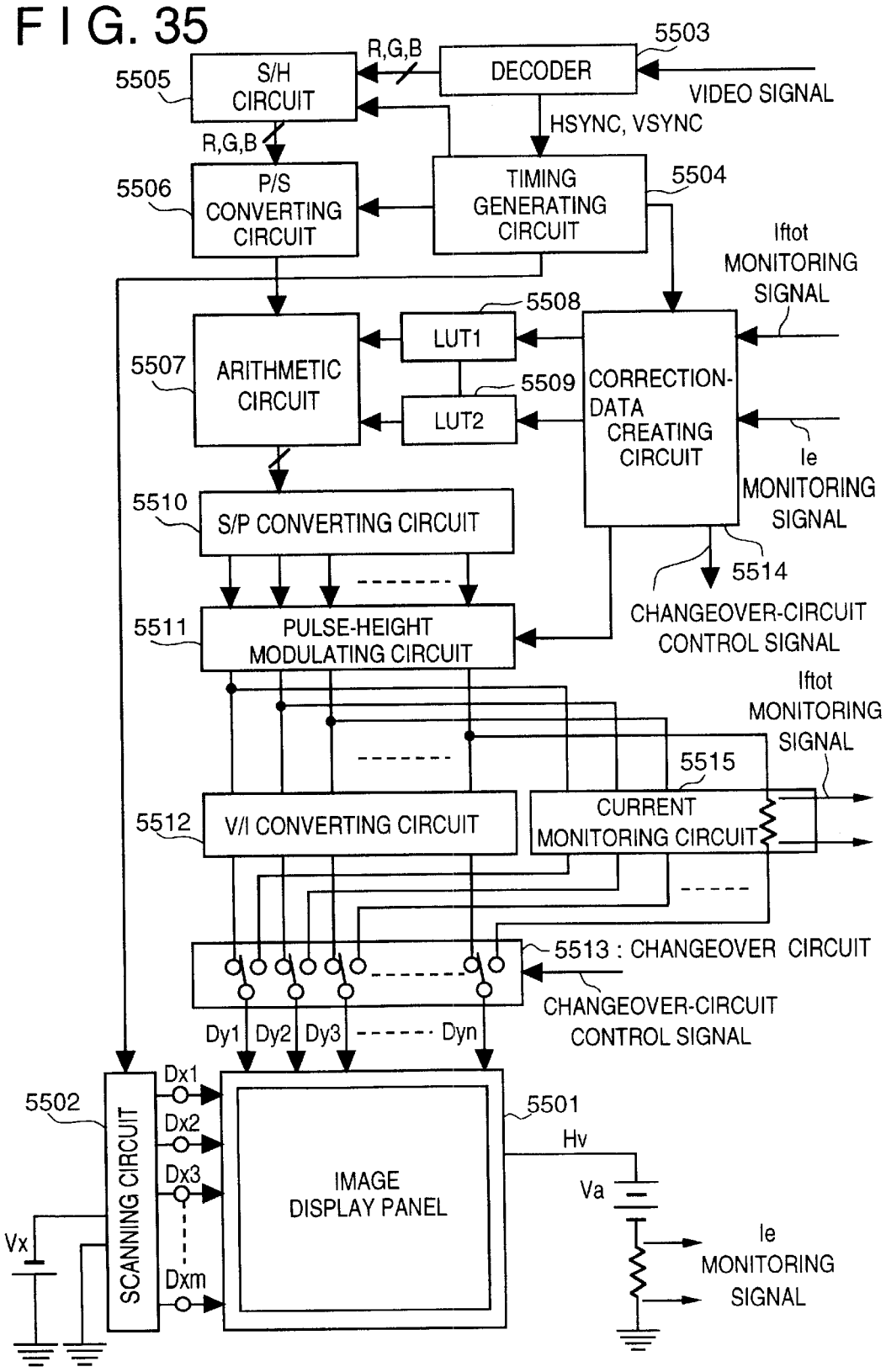
FIG. 35 is a diagram showing the flow of a video luminance signal according to a fifth embodiment.

In the fifth embodiment, the pulse width of current applied to a column wire is held constant at all times. This means that a pulse-width modulating circuit is unnecessary. FIG. 35 illustrates the flow of a video signal in the fifth embodiment of the invention from entry of the signal to a decoder 5503 to delivery of the signal to an image display panel 5501. In this embodiment, the structure of the surface-conduction electron emission elements and panel, the method of creating LUT 1, the method of creating LUT 2 and the V/I converting circuit, etc., are the same as in the fourth embodiment. The fifth embodiment differs from the fourth embodiment in the provision of an arithmetic circuit 5507 and pulse-height converting circuit 5511. The pulse-height converting circuit 5511 outputs pulses having a fixed duration but a pulse height that is commensurate with the output data from the S/P converting circuit 5510.

Figure 36:
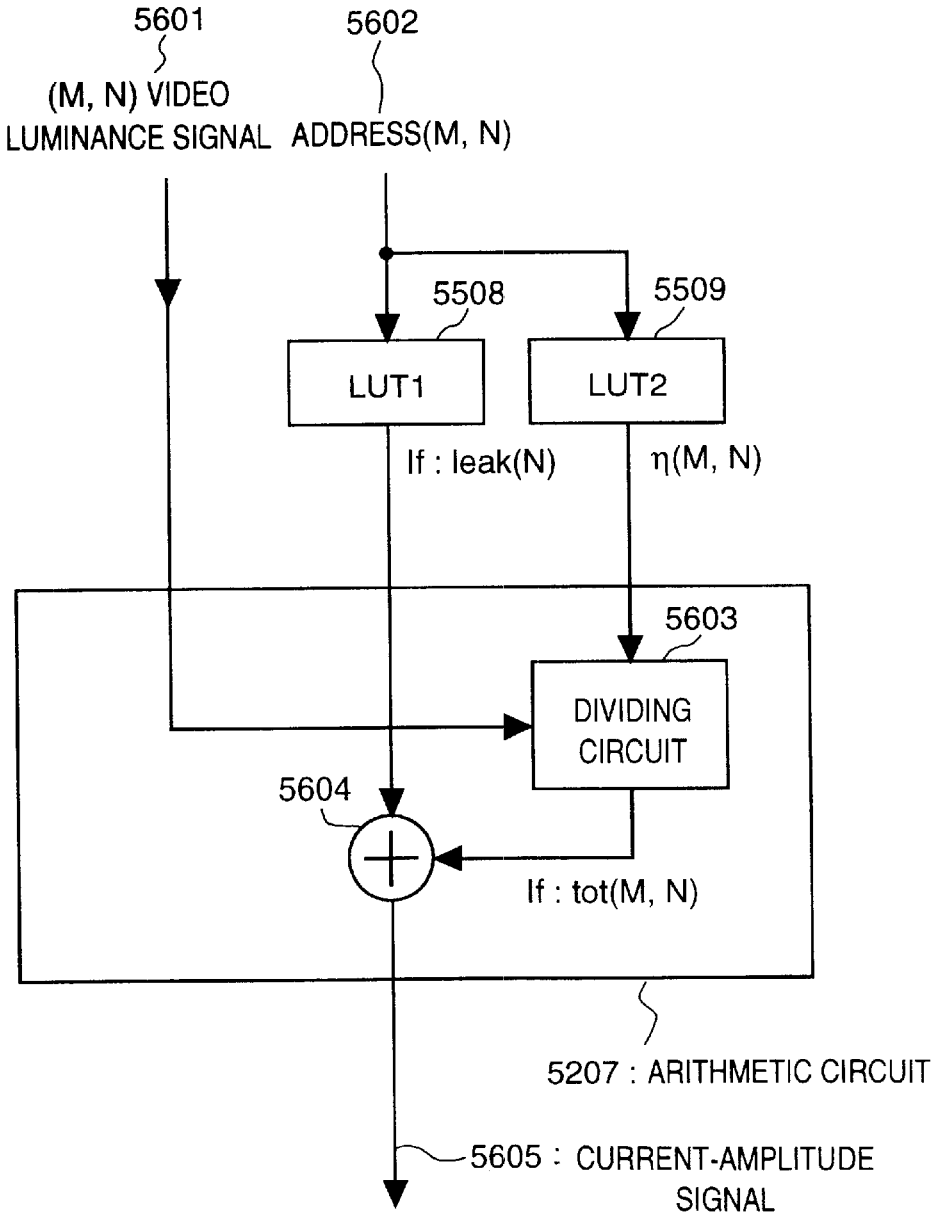
FIG. 36 is a diagram showing an arithmetic circuit according to the fifth embodiment.

FIG. 36 illustrates the flow of data in the arithmetic circuit 5507. A video luminance signal enters the arithmetic circuit 5505 from a P/S converting circuit 5506. Assume that a display is presented on the pixel (M,N) at a certain timing. The timing generating circuit issues an instruction for accessing the address (1,N) of LUT 1 and the address (M,N) of LUT 2 to fetch the correction current quantity If:leak(N) from LUT 1 and the electron emission efficiency $\eta$(M,N) from LUT 2. A signal If:eff(M,N) (=Ie·L)/{$\eta$(M,N)·(R−1)}) is obtained from the electron emission efficiency $\eta$(M,N) fetched from LUT 2, the set reference value Ie of electron emission current, luminance resolution R and a luminance signal L. The current If:tot(M,N) [=If:leak(N)+If:eff(M,N)] passed through the wire of column N when the element (M,N) is lit is calculated from the obtained If:eff(M,N) and If:leak(N) fetched from LUT 1. This operation is performed by a dividing circuit 5603 and an adder 5604. The current amplitude signal If:tot(M,N) thus obtained is delivered to the S/P converting circuit 5110. The S/P converting circuit 5110 converts the current amplitude signal If:tot(M,N) to parallel and distributes this signal to each of the n-number of wires. The distributed n-number of controlled constant-current signals are supplied to the panel via the V/I converting circuit 5112.

By way of example, consider a situation in which the luminance signal has a resolution of 256 gray levels and the electron emission current Ie (the set reference value Ie) from each element is set at 1 $\mu$A. The luminance resolution is 256 gray levels. In such case the luminance signal will have a maximum value of 255 and a minimum value of 0. Assume that a luminance signal which causes the pixel to emit maximum light (255) arrives when the electron emission efficiency $\eta$(M,N) is 0.1% and the leakage current If:leak (N) of wire column N is 0.5 mA at address (M,N). In such case a current amplitude signal 5605, which is the amplitude of the driving current signal, is decided in accordance with the following equation:

$$\begin{aligned} \mathrm{If:tot}(M,N) &= \mathrm{if:leak}(N) + \mathrm{If:eff}(M,N)/L\times(R-1) \\ &= \mathrm{If:leak}(N) + Ie/\eta(M,N)/255\times 255 \\ &= 0.5\ \mathrm{mA} + 1\ \mu\mathrm{A}/0.1\%/255\times 255 \\ &= 1.5\ \mathrm{mA} \end{aligned} \tag{4}$$

Figure 37A:
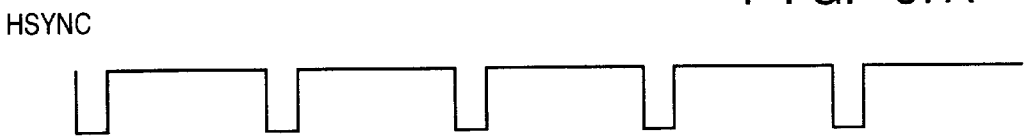
FIGS. 37A to 37G are waveform diagrams of waveforms associated with wiring of a first column according to the fifth embodiment.
Figure 37B:
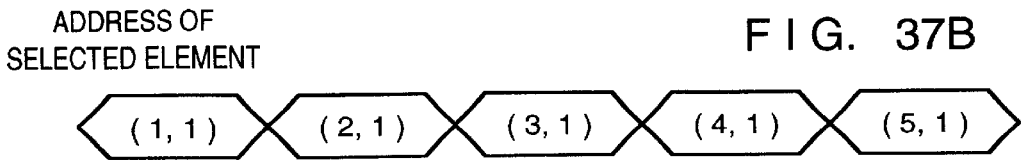
Figure 37C:
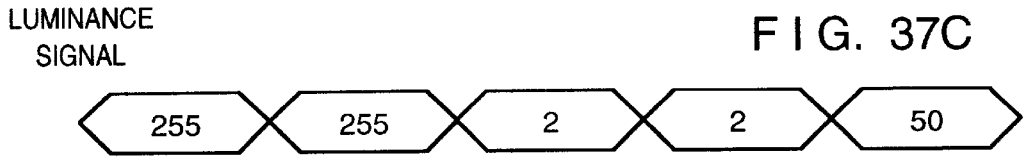
Figure 37D:
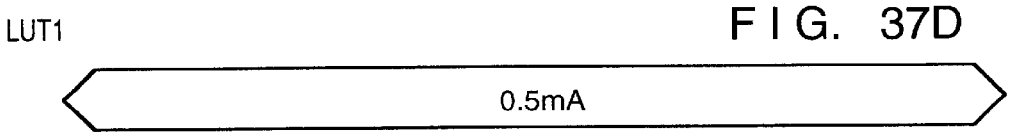
Figure 37E:
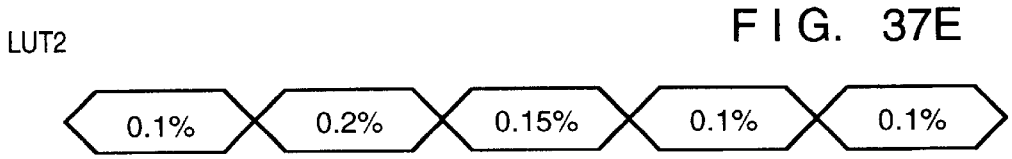
Figure 37F:
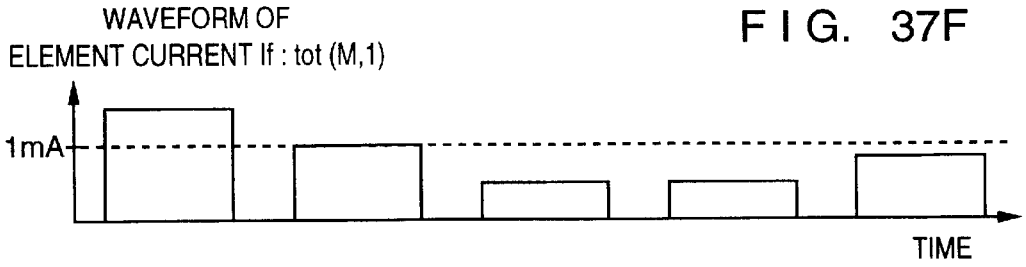
Figure 37G:
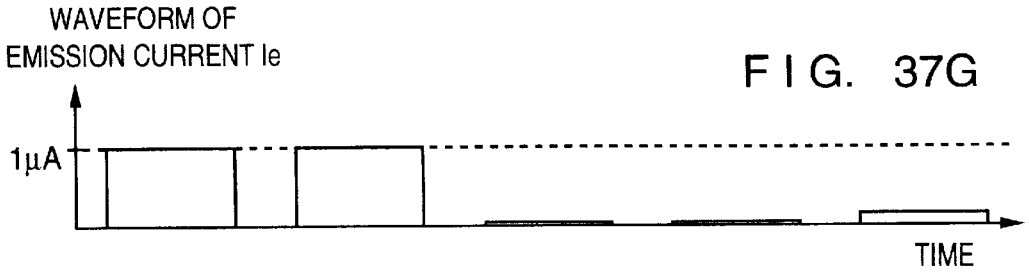

If, when the element (M,N) has been selected, the current of 1.5 mA thus found is passed through the column wire N as a constant current, then electrons are emitted from the element (M,N) in the amount of 1 $\mu$A. FIGS. 37A to 37G are diagrams showing the kind of waveform into which the actual input waveform from the pulse-height modulating circuit 5511 is converted. Attention will be directed toward the first column wire of the image display panel 5501 to describe a temporal change in data in the circuitry or wiring associated with the first column wire. Here FIG. 37A represents a synchronizing signal HSYNC, FIG. 37B, the number of a selected element to be lit (this number also represents the LUT1 and LUT 2 accessed), FIG. 37C, a video luminance signal of a selected pixel, FIG. 37D, the reactive current waveform of the first column wire read out of LUT 1, FIG. 37E, the electron emission efficiency η(M, N) of the selected element (M,N) read out of the LUT 2, FIG. 37F, the magnitude of the current If:tot(M,1) passed through the first column wire, and FIG. 37G, the electron emission current Ie of the selected surface-conduction electron emission element (M,1) (M=1, 2, 3, 4, 5). By performing the calculation of Equation (4), a current waveform [of the kind shown in FIG. 37F] corresponding to each element can be calculated. By performing a correction of current waveform of the kind shown in FIG. 37F, an electron emission current of the kind shown in FIG. 37G is obtained for each luminance signal. This signal includes a correction for variance in each element.

Sixth Embodiment

Figure 38:
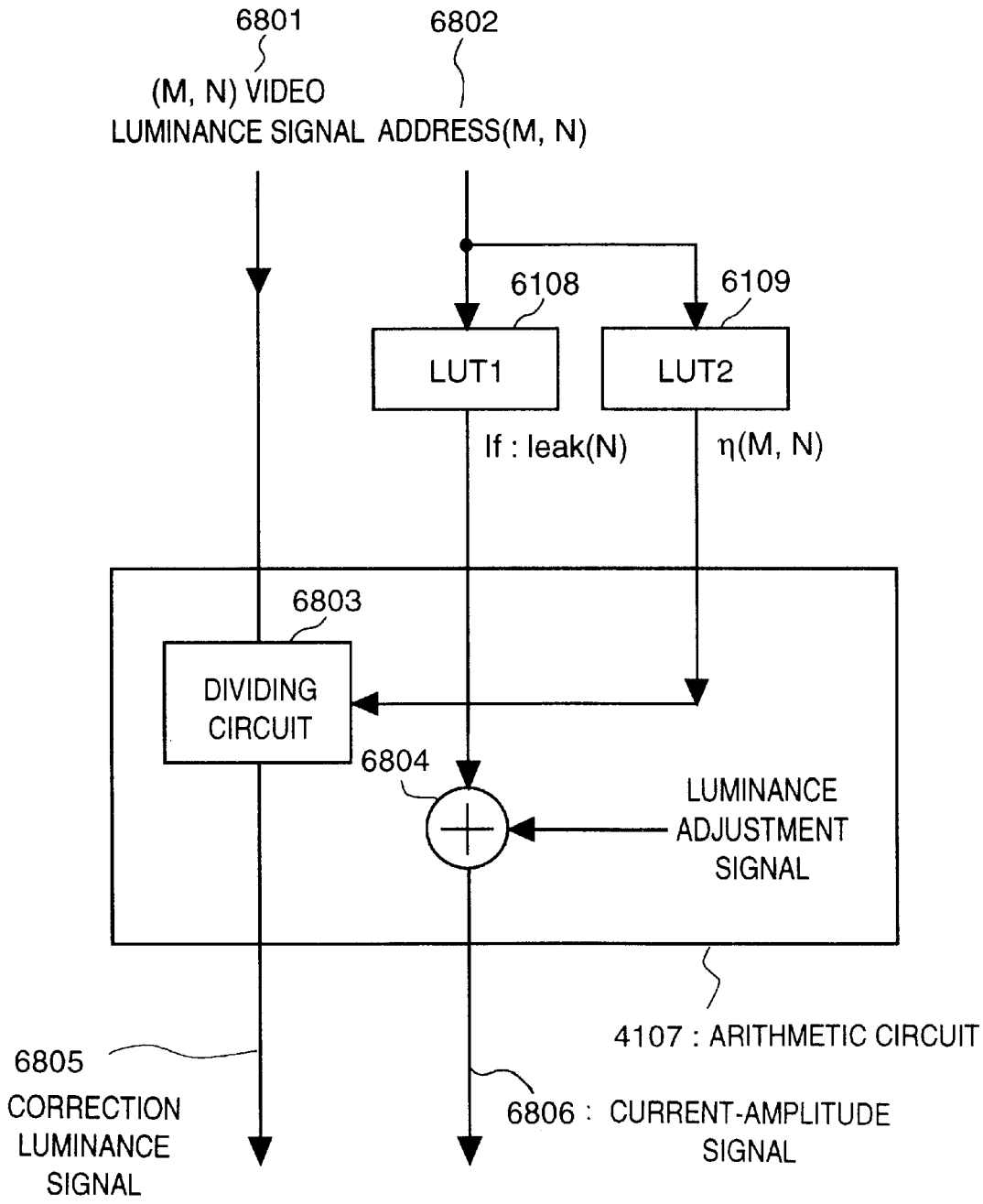
FIG. 38 is a diagram showing an arithmetic circuit according to a sixth embodiment.

In the sixth embodiment, the luminance signal of an image compensated for a variance in electron emission efficiency η(M,N) of each element stored in LUT 2 is represented by time during which current is passed into each element, and a correction for a disparity in leakage current due to each column wire is performed based upon the amount of current passed through each element. The flow of signal processing is shown in FIG. 22, which was used in the fourth embodiment. This embodiment differs from the fourth embodiment in the arithmetic circuit 4107 and the modulating circuit 4111. FIG. 38 is a diagram showing an arrangement of the arithmetic circuit 4107 of the sixth embodiment.

A dividing circuit 6803 calculates a correction luminance signal A(M,N) from the luminance signal applied to the element (M,N), the electron emission efficiency η(M,N) of element (M,N) obtained from LUT 2, and a minimum electron emission efficiency $\eta_{min}$ from among all of the m×n elements. Assume that this apparatus has a luminance resolution of R gray levels and that the luminance signal L has been applied to element (M,N). The circuitry is designed in such a manner that the correction luminance signal A(M,N) of the luminance signal L of R gray levels will be as follows:

$$A(M,N)=L\cdot[\eta_{min}/\eta(M,N)] \tag{5-1}$$

A current If:tot(M,N) passed through the column wire N is decided upon compensating the drive current If:eff of each element for the amount of a voltage drop ascribable to the wiring. In the sixth embodiment, a variance in the electron emission efficiency of each element is compensated for by using the correction luminance signal. Therefore, current of a constant value is passed through all m-number of element in the column wire N. Accordingly, the current If:tot(M,N) passed through the column wire N is as follows:

$$\text{If:tot(N)}=\text{If:leak(N)}+\text{If:eff} \tag{5-2}$$

By way of example, assume that the luminance resolution R has 256 gray levels, the luminance signal L applied to element (2,1) is 255, the electron emission efficiency of element (2,1) is 0.2%, the leakage current If:leak(1) of the first column wire is 0.5 mA, the minimum electron emission efficiency $\eta_{min}$ is 0.1% and the drive current If:eff is 1.0 mA. In this case the correction luminance signal A(2,1) of 256 gray levels and the current If:tot(1) passed through the first wiring column are as follows:

$$\begin{aligned} A(2,1) &= L\cdot[\eta\min/\eta(2,1)] \\ &= 255\cdot 0.1/0.2 \\ &= 123 \end{aligned} \tag{5-3}$$

$$\begin{aligned} \text{If:tot}(1) &= \text{If:leak}(1)+\text{If:eff} \\ &= 0.5\ \text{mA}+1.0\ \text{mA} \\ &= 1.5\ \text{mA} \end{aligned} \tag{5-4}$$

Figure 39A:
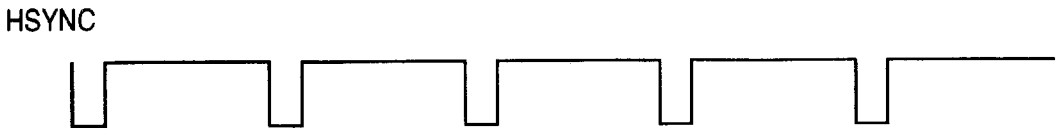
FIGS. 39A to 39G are waveform diagrams of waveforms associated with wiring of a first column according to the sixth embodiment.
Figure 39B:
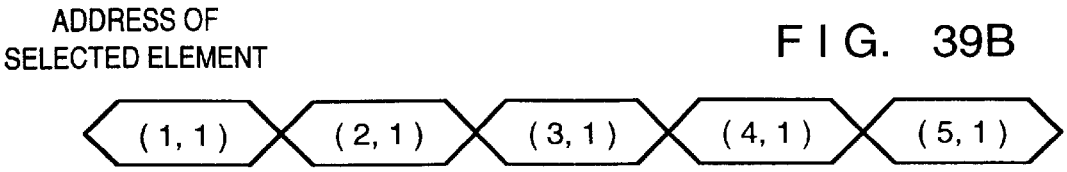
Figure 39C:
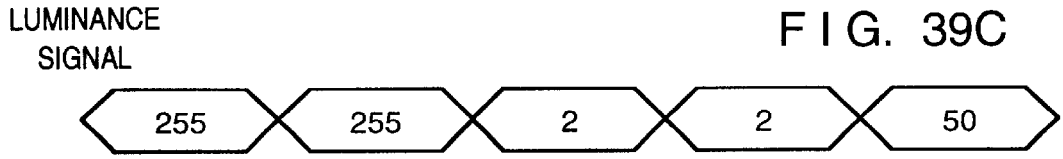
Figure 39D:
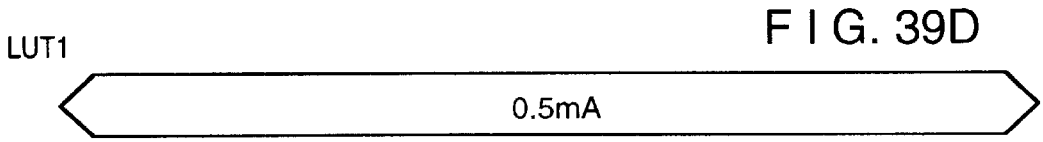
Figure 39E:
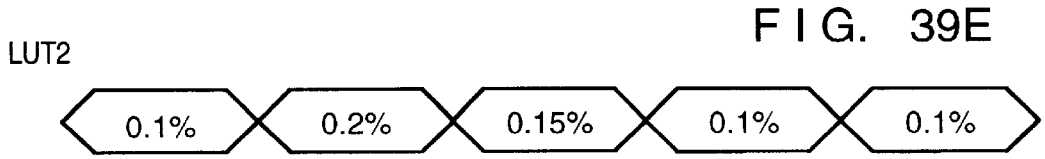
Figure 39F:
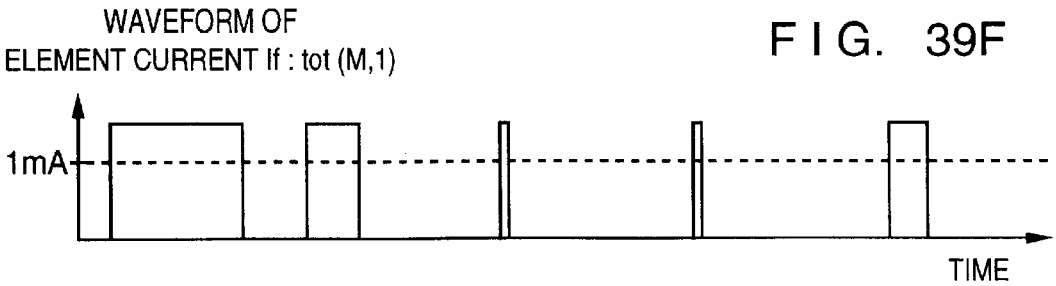
Figure 39G:
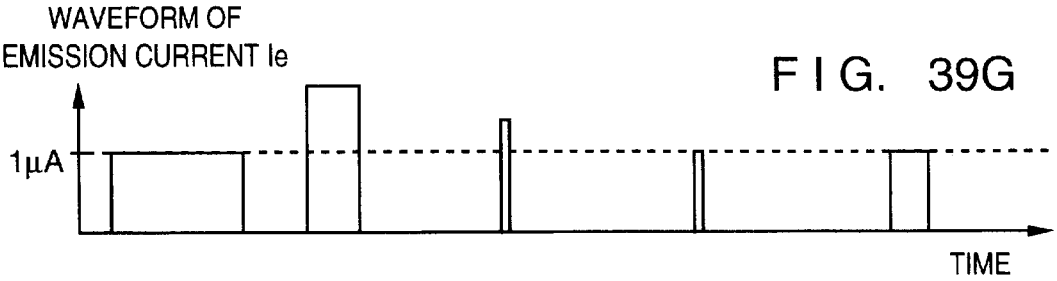

FIGS. 39A to 39G are diagrams showing the kind of current waveform into which the actual input waveform from the voltage modulating circuit is converted. Attention will be directed toward the first column wire of the image display panel to describe a temporal change in data in the circuitry or wiring associated with the first column wire. Here FIG. 39A represents a synchronizing signal HSYNC, FIG. 39B, the number of a selected element to be lit (this number also represents the LUT 1 and LUT 2 accessed), FIG. 39C, a video luminance signal sent to a selected pixel, FIG. 39D, the reactive current waveform of the first column wire read out of LUT 1, FIG. 39E, the electron emission efficiency η(M,N) of the selected element (M,N) read out of the LUT 2, FIG. 39F, the magnitude of the current If:tot(M, 1) passed through the first column wire, and FIG. 39G, the electron emission current Ie of the selected surface-conduction electron emission element (M,1) (M=1, 2, 3, 4, 5). In the sixth embodiment, a constant current waveform of the kind shown in FIG. 39F is applied to each column wire. Correction of a variance in the electron emission efficiency η(M,N) of each element is represented by the time during which the constant-current pulse of FIG. 39F is applied. Consequently, though the electron emission current (the peak value) differs from one to element to another, as shown in FIG. 39G, the overall emission electron quantity per one scan of an element is held constant if the luminance signal is the same.

Figure 40A:
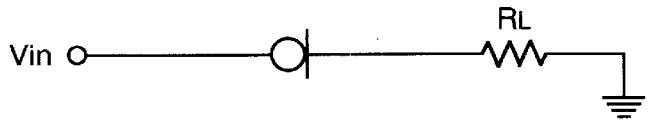
FIG. 40A is a diagram showing a constant-current diode.
Figure 40B:
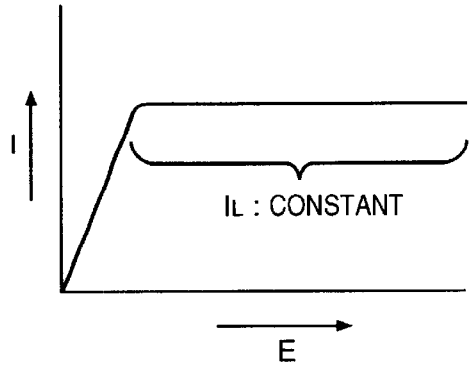
FIG. 40B is a diagram showing the V-I characteristic of the constant-current diode.
Figure 40C:
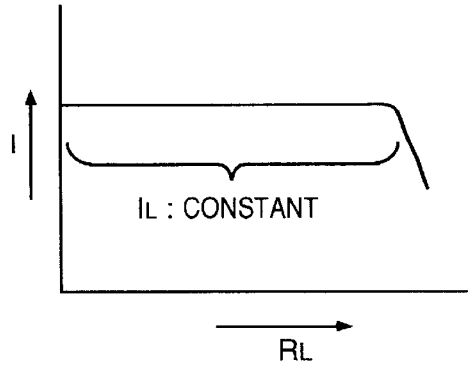
FIG. 40C is a diagram showing the R-I characteristic of the constant-current diode.

In the sixth embodiment, the video luminance signal and the variance correction value of electron emission efficiency are represented by pulse width if the compensating value of leakage current is constant. This means that a simply constructed constant-current diode is effective for use as the V/I converting circuit 4112. FIG. 40A shows a symbol representing a constant-current diode, which has the V-I characteristic shown in FIG. 40B. In FIG. 40B, IL represents the pinch-off current of the constant-current diode. The constant current IL is passed even if a bias voltage (E) below the withstand voltage is applied. Accordingly, the current IL which passes through a resistor RL is constant, as shown in FIG. 40C, regardless of the resistance value of the resistor RL, which is on the cathode side of the constant-current diode.

Figure 40D:
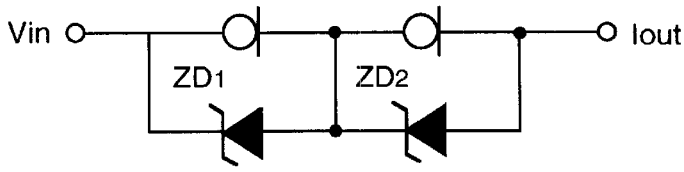
FIG. 40D is a diagram showing a constant-current diode circuit having a high withstand voltage.
Figure 40E:
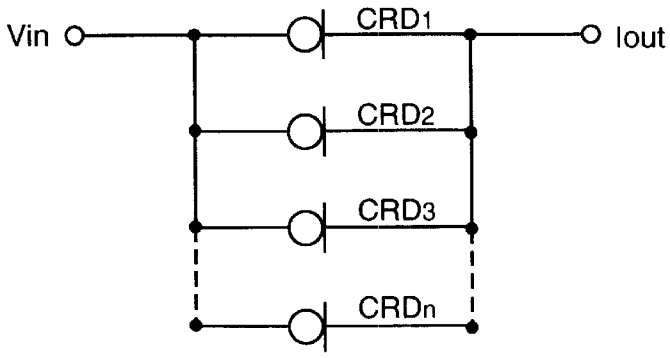
FIG. 40E is a diagram showing a constant-current diode circuit through which a large current is passed.
Figure 41A:
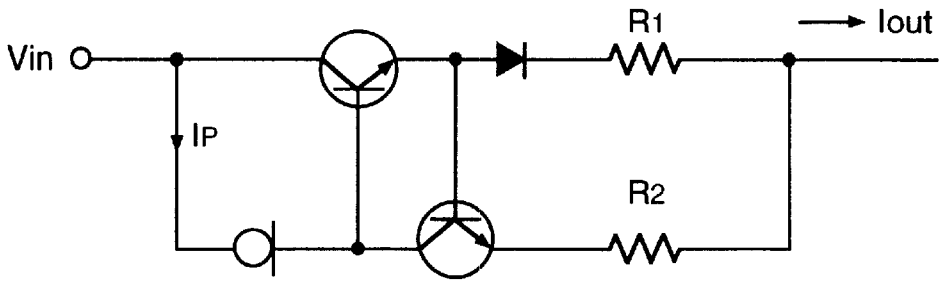
FIG. 41A is a diagram showing a V/I converting circuit having a constant-current diode.
Figure 41B:
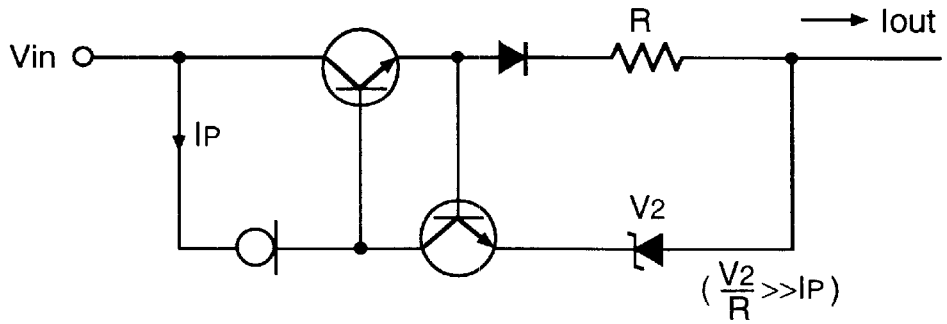
FIG. 41B is a diagram showing a V/I converting circuit having a constant-current diode.

If a constant-current diode is selected in such a manner that the current If:tot, which is necessary for the column wire N, and IL will coincide, then the V/I converting circuit can be constructed by a single element. In a case where the constant-current diode requires a high withstand voltage, constant-current diodes may be serially connected using Zener diodes, as shown in FIG. 40D. When a large current must be passed through a column wire, constant-current diodes should be connected in parallel, as illustrated in FIG. 40E. Though the circuitry is somewhat complex, the constant-current characteristic may be improved further if a circuit represented by (Iout=R1+R2)Ip/R1) in FIG. 41A or a circuit represented by (Iout=VZ/R) in FIG. 41B is used as the V/I converting circuit.

In the sixth embodiment, the luminance of a pixel and the correction value of electron emission efficiency are represented by pulse width and, hence, the current passed through n-number of column wires is constant and independent of pixel scanning. Accordingly, if the leakage current is constant, the V/I converting circuit need not be provided with a mechanism for adjusting the magnitude of the constant current. As a result, there is obtained a simply constructed image display apparatus in which the V/I converting circuit is composed solely of constant-current diodes.

Seventh Embodiment

In the description of the seventh embodiment, first the general features will be-discussed. Second, a method of creating a LUT will be described, in which the LUT stores the wiring resistance of the leakage current component of each column wire. Third, actual drive of an image display will be described in detail. Fourth, the principles of the seventh embodiment will be described. Fifth, the effects obtained by practicing the seventh embodiment will be described. The construction and method of manufacturing the image display panel, the method of manufacturing a multiple electron source and the method of fabricating a surface-conduction electron emission element are identical with those of the first embodiment.

{1. General Features of the Seventh Embodiment}

In the seventh embodiment, means are provided for measuring the potentials of n-number of column wires at all times. Before the image display is driven, the wiring resistance of the leakage current component is determined and stored in advance with regard to all n-number of the column wires using the potential measuring means. When the image display is driven, first a current which is a combination of the initial value of leakage current and the selected element current is passed through each of the n-number of column wires during one horizontal scan. Next, the potentials possessed by the n-number of column wires are measured again, the amount by which the selected element current has deviated from the ideal value is determined and the constant current passed through the column wires is changed. By repeating this operation, the selected element current is made to approach the ideal value. In the seventh embodiment, the luminance signal is represented by pulse width.

Figure 42:
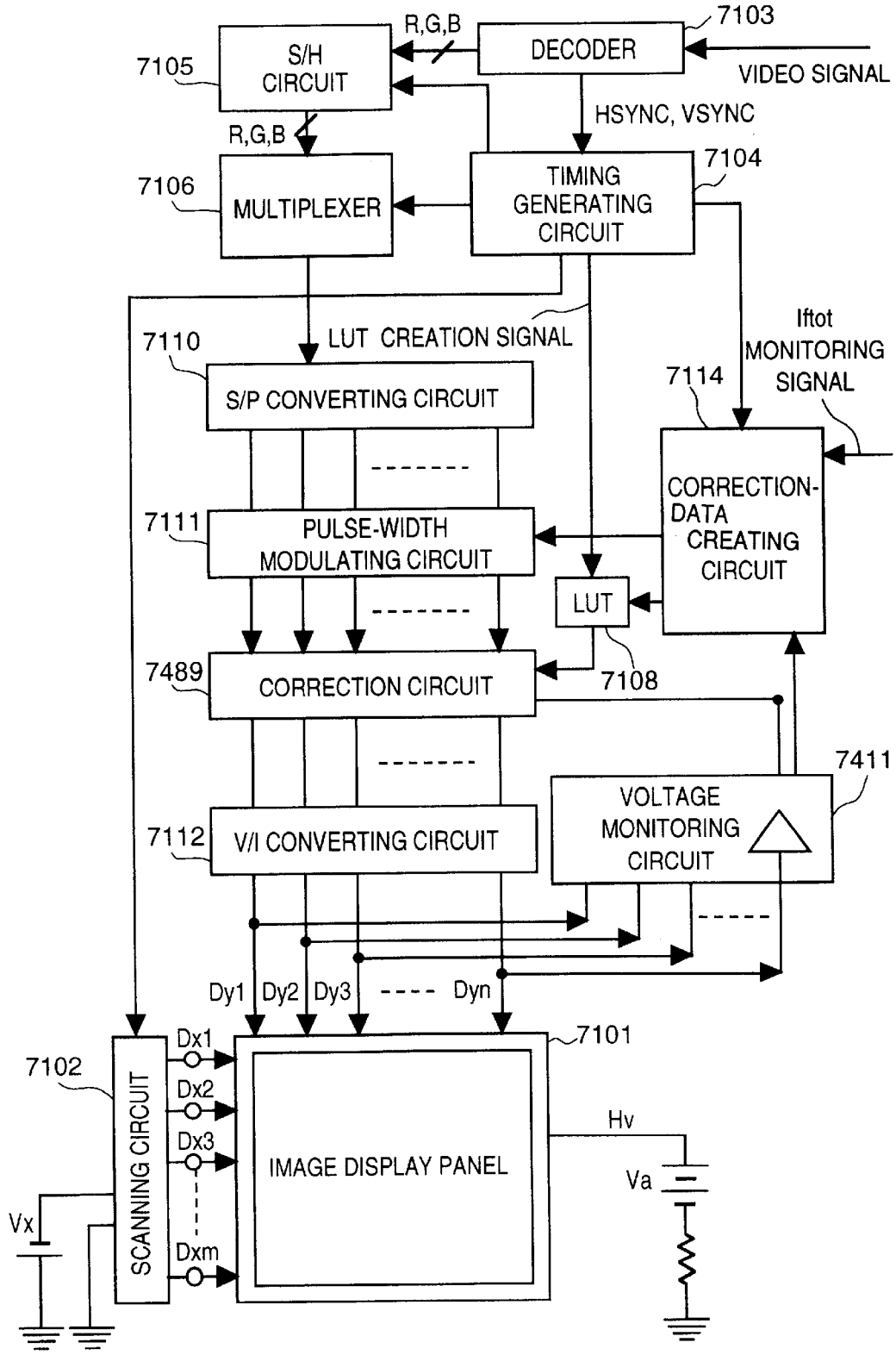
FIG. 42 is a diagram showing the flow of a video luminance signal according to a seventh embodiment.

FIG. 42 is a diagram which best shows the features of the seventh embodiment. This illustrates the flow of an image signal. An entered composite image signal is separated into luminance signals of the three primary colors, a horizontal synchronizing signal (HSYNC) and a vertical synchronizing signal (VSYNC) by a decoder 7103. A timing generator 7104 generates various timing signals synchronized to the HSYNC and VSYNC signals. The R, G, B luminance signals are sampled and held by an S/H (sample-and-hold) circuit 7105 at a timing conforming to the array of pixels. A multiplexer 7106 converts the held signal to a serial signal in dependence upon the order of the pixels. An S/P (serial/parallel) converting circuit 7110 converts the serial signal to a parallel signal row by row. As a consequence, all of the pixels in one row emit light in conformity with the video luminance signal during one horizontal scan.

A pulse-width modulating circuit 7111 generates drive pulses having a pulse width corresponding to the video signal intensity. By using a LUT 7108, which stores leakage currents that flow out to elements other than a selected element at the time the panel is driven, and a voltage monitoring circuit 7111, a correction circuit 7489 corrects the amplitude of the modulation signal voltage according to each column wire and the selected row and generates a constant-voltage pulse having this amount of voltage. A V/I converting circuit 7112 converts this constant-voltage pulse to a constant-current quantity. This constant current is sent to each column wire. At the same time, rows are selected successively by a scanning circuit 7102 to present a two-dimensional image display. The voltage monitoring circuit 7111 monitors the potentials of the terminals $D_{y1}$, $D_{y2}$, . . . , $D_{yn}$ of the column wires at all times and sends the monitored quantities to the correction circuit. The latter sends the corrected constant-voltage pulses to the V/I converting circuit 7112 in a time which is very short in comparison with the time of one scan. The V/I converting circuit 7112 sends constant-current pulses to the terminals $D_{y1}$, $D_{y2}$, . . . , $D_{yn}$ of the column wires. As a result, the current which flows into a selected element during one scan converges to a value in line with the desired video luminance signal.

{2. Creation of LUT}

In the seventh embodiment, the voltage monitoring circuit 7111 which measures the potentials of the n-number of column wires is used to obtain the equivalent resistances of the leakage current components with regard to all of the n-number of column wires and to store these values in advance. The equivalent resistance of the leakage current component is referred to as leak resistance Rleak(N). The values of leak resistance Rleak(N) are stored in the LUT.

Figure 43:
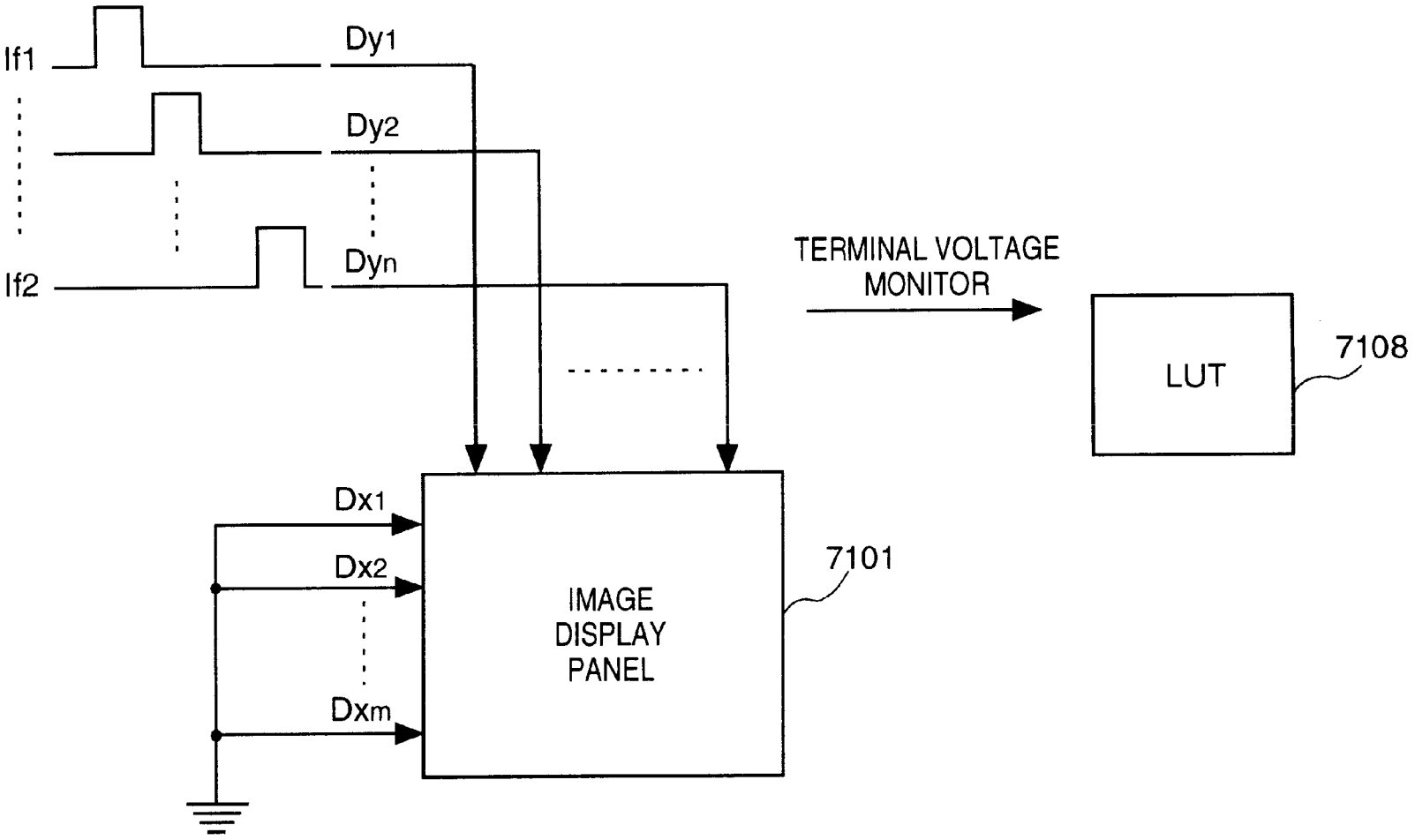
FIG. 43 is a diagram showing a method of creating a LUT in seventh and eighth embodiments.

Creation of the LUT will be described with reference to FIG. 43. FIG. 43 is a diagram schematically illustrating the procedure for measuring the potentials of the terminals $D_{y1}$, $D_{y2}$, . . . , $D_{yn}$ of the n-number of column wires. First, 0 V (ground level) is connected to the terminals $D_{x1}$, $D_{x2}$, . . . , $D_{xm}$ of the m-number of row wires, whereby the potentials of the m-number of row wires are made 0 V. Under these conditions, a constant current in the amount of the leakage current If:leak(N) is sent to the n-number of column wire in succession when the row wires are held at 0 V. The potential V(DyN) of all of the n-number of column wires is measured by the voltage monitoring circuit 7111. Thereafter, V(DyN)/If:leak(N) is calculated by the correction circuit and this value is adopted as the leakage resistance Rleak(N). Finally, the values of leakage resistance Rleak(N) obtained by the correction circuit are sent to the correction data creating circuit and these are stored at respective addresses of the LUT. The LUT is given 1×n addresses and n-number of leakage resistances Rleak(N) are stored at corresponding addresses.

By way of example, assume that the potential V(DyN) of column wiring measured by the voltage monitoring circuit 7111 is 5 V when the V/E converting circuit 7112 has passed a current of 0.5 mA as the leakage current If:leak(N). At such time the leakage resistance Rleak(N) is as follows:

$$V(DyN)/If{:}leak(N)=5\ V/0.5\ mA=10\ k\Omega \tag{6-1}$$

The leakage resistance Rleak(N) of 10 kΩ is stored at address (1,N) of the LUT. This operation is carried out with regard also to column wires other than the column wire N. Naturally, since the drive circuit is designed so that one row of elements is driven simultaneously, the voltage monitoring circuit 7111 is provided for every column wire. Accordingly, leakage resistances Rleak(N) of n-number of column wires N can be measured simultaneously.

{3. Drive of Image Display}

Reference will again be had to FIG. 42. In FIG. 42, operation up to entry of the video luminance signal into the S/P converting circuit is the same as described in connection with the other embodiment. Consequently, the video luminance signal is represented by pulse height up to entry of the signal into the pulse-width modulating circuit 7111. In the seventh embodiment, voltage pulses having the image signal as pulse height are changed by the pulse-width modulating circuit 7108 to constant-voltage pulses having a pulse width in which resolution is such that there are R gray levels. Thereafter, the constant-voltage pulses having the gray levels as pulse width are changed to constant-current pulses by the V/I converting circuit 7112.

Figure 44A:
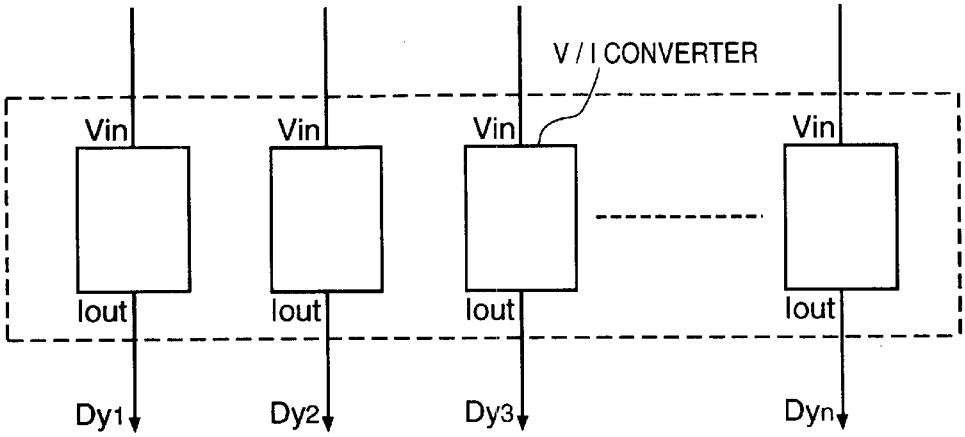
FIG. 44A is a diagram showing a V/I converting circuit.
Figure 44B:
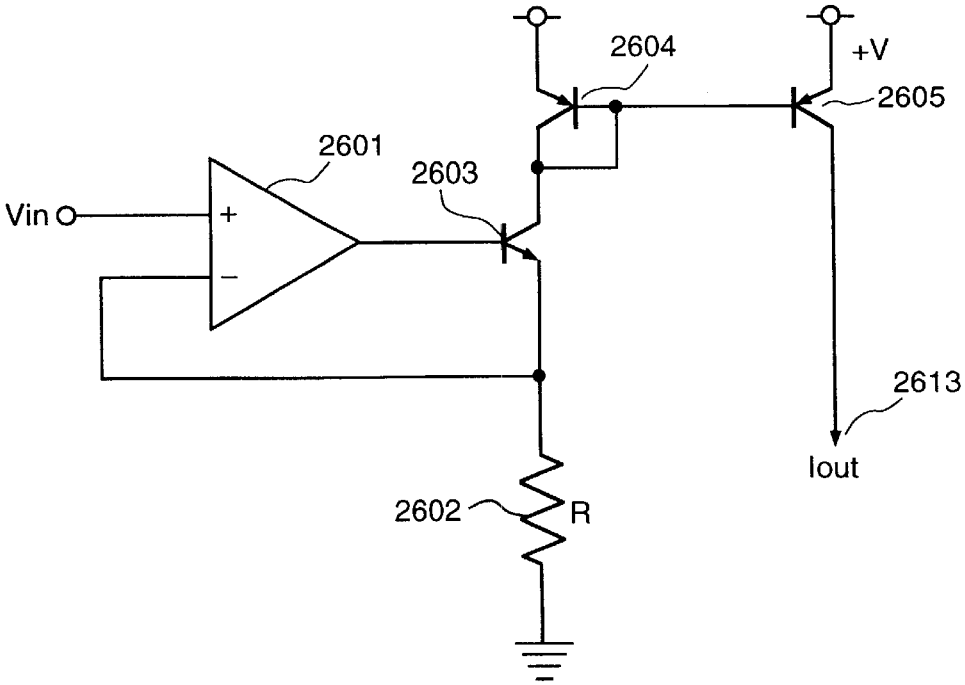
FIG. 44B is a diagram showing a concrete example of the circuitry of the V/I converter.

FIG. 44A illustrates the V/I converting circuit attached to each column wire. The V/I converting circuit 7112 is provided for each column wire, as shown in FIG. 44A. FIG. 44B is a specific example of the V/I converting circuit. Here the V/I converting circuit is of the current mirror type. In FIG. 44B, numeral 2601 denotes an operational amplifier, 2602 a resistor having a resistance value R, 2603 an npn transistor, 2604, 2605 pnp transistors and 2613 a terminal to which is connected a circuit through which a constant current must be passed. Regardless of the kind of impedance circuit connected ahead of the wiring 2613, the V/I converting circuit passes a current Iout=Vin/R into the circuitry ahead of the wiring 2613 in dependence upon the input voltage Vin as long as the impedance is not extremely large. Of course, a circuit well known for the purpose of constructing a constant-current source may be connected as the V/I converting circuit.

In the correction circuit 7489, a compensating constant-voltage pulse is added to the constant-voltage pulse having the gray level in the form of pulse width in such a manner that the V/I converting circuit 7112 will pass a constant current If:tot(N) [=If:leak(N)+If:eff], which is, obtained by adding the leakage current If:leak(N) to the: constant current If:eff passed through the selected element, through each of the column wires.

By way of example, assume that the electron emission current Ie from all elements is set at 0.6 $\mu$A and that the luminance of each pixel is represented by pulse width. In this case, the required element current If:eff is 0.8 mA; based upon FIG. 23. Accordingly, it will suffice to pass a current If:leak(N)+0.8 mA through all n-number of the column wires as If:tot(N). If the leakage resistance R(N) of any column wire N is 10 kΩ at this time, then the current If:tot(N) passed through the column wire N will be as follows:

$$\begin{aligned} \text{If:tot}(N) &= \text{If:leak}(N) + \text{If:eff} \\ &= V(DyN)/Rleak(N) + \text{If:eff} \\ &= 5\ \text{V}/10\ \text{k}\Omega + 0.8\ \text{mA} \\ &= 1.3\ \text{mA} \end{aligned} \tag{6-2}$$

[where V(Dyn) is the voltage of terminal DyN measured by the voltage monitoring circuit]. Accordingly, when the current of 1.3 mA is passed into the column wire N from the output of the V/I converting circuit, a current of 0.8 mA flows into the selected element and an emission current of 0.6 $\mu$A is obtained.

If the resistance value R of the V/I converting circuit is 1 kΩ, the correction circuit 7489 outputs a correction signal of 1.3 V as the input voltage Vin of the V/I converting circuit 7112 and the output of the V/I converting circuit delivers a pulse of a constant current of 1.3 mA.

Figure 45A:
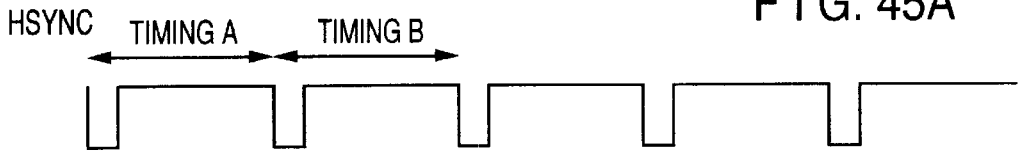
FIGS. 45A to 45H are waveform diagrams of waveforms associated with wiring of a first column according to the seventh embodiment.
Figure 45B:
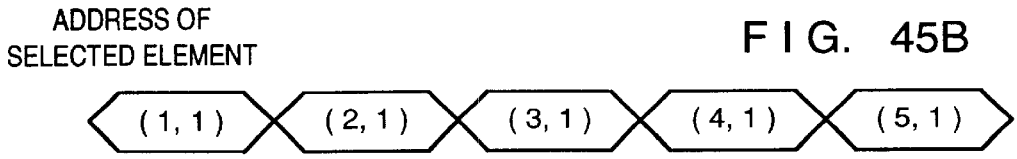
Figure 45C:
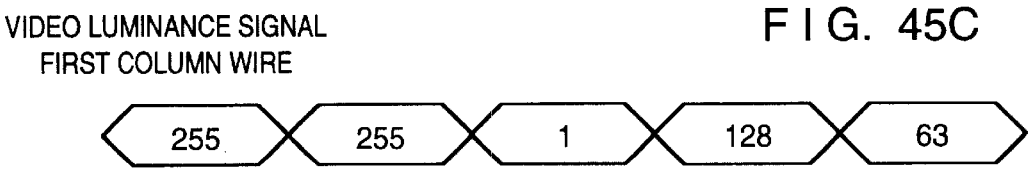
Figure 45D:
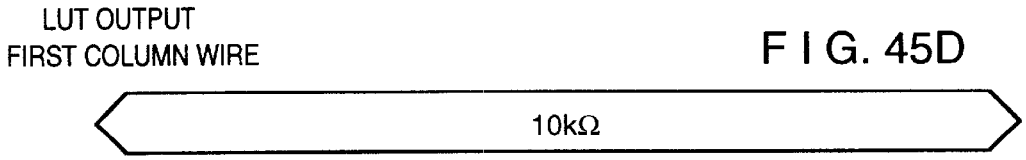
Figure 45E:
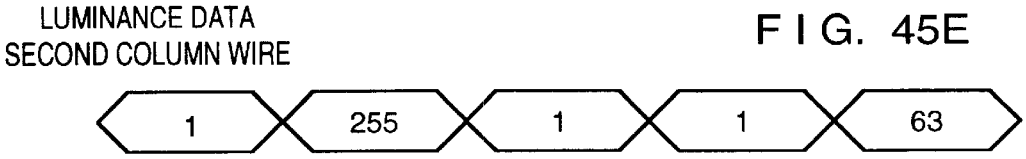
Figure 45F:
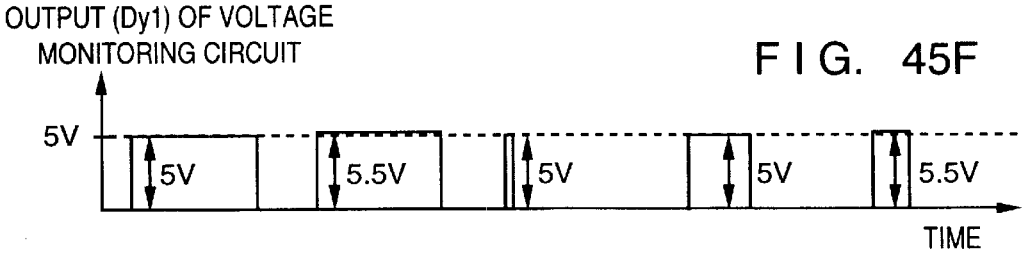
Figure 45G:
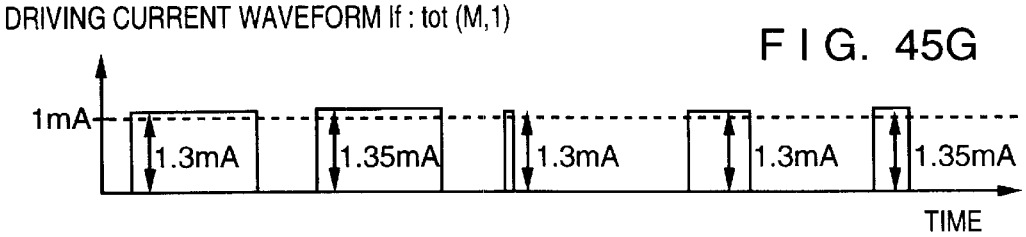
Figure 45H:
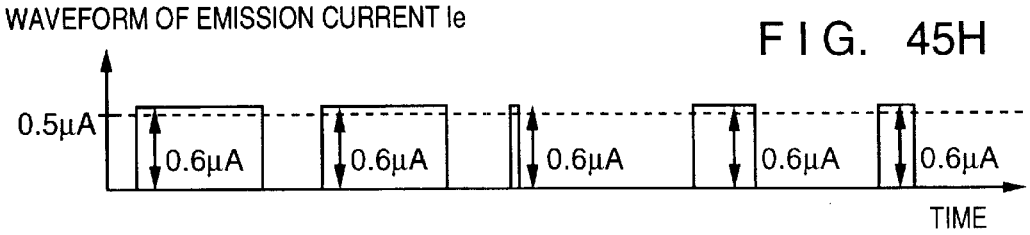

However, the measured potential V(DyN) of the voltage monitoring circuit 7411 differs depending upon how elements in the same row as the selected element are lit. This will be described with reference to FIG. 45. FIGS. 45A to 45H are timing charts of portions associated with the first column wire when elements (M,1) (M=1, 2, 3, 4, 5) are lit one after another. Here FIG. 45A represents a synchronizing signal HSYNC, FIG. 45B, the number of a selected element to be lit (this number also represents the number of the LUT accessed), FIG. 45C, a video luminance signal of pixel (M,1) on the first column wire, FIG. 45D, the leakage, resistance Rleak(N) of the leakage current If:leak(N) component of each column wire from the LUT, FIG. 45E, a video luminance signal of pixel (M,2) on the second column wire, FIG. 45F, the potential V(Dy1) of the first column wire measured by the voltage monitoring circuit 7111, FIG. 45G, the current quantity If:tot(M,1) passed through the first column wire, and FIG. 45H, the electron emission current Ie(M,1) emitted from the selected element. The electron emission current Ie(M,1) per unit time is constant, as indicated in FIG. 45H, with the luminance information being represented by pulse width.

Assume that the leakage resistance Rleak(1) of the first column wire is 10 kΩ. At the timing A at which the first row is selected by the scanning circuit, assume that 255, which is the maximum luminance signal, enters pixel (1,1) and that a luminance signal 0, which does not light any pixel, enters all of the pixels in the same row with the exception of pixel (1,1), as indicated in FIG. 45C. In other words, at timing A, in the first row only the pixel (1,1) is lit at the maximum luminance. In this case attention should be directed toward pixel (2,1) of the second column, which is indicated in FIG. 45E as being representative of the other pixels in the same row as pixel (1,1).

On the other hand, at timing B at which the second row is selected by the scanning circuit 7102, consider a case where 255, which is the maximum luminance signal, enters pixel (2,1) and 255, which is the maximum luminance signal, also enters the pixels other than this pixel. In other words, at timing B, all of the pixels in the second row light in response to the maximum luminance signal. At this time 255, which is the maximum luminance signal, also enters the pixel (2,2) of the second column indicated in FIG. 45E.

In a case such as this, a selection current does not flow into elements other than (1,1) at timing A. Therefore, the current which flows into the first row wire is only the element current of element (1,1) and the leakage currents of elements other than element (1,1). At this time there is almost no fluctuation in the potential of the first row wire and the measured potential V(Dy1) of the voltage monitoring circuit 7411 is 5 V as planned. Consequently, a current of 0.8 mA, as planned, flows into the element (1,1) from the constant current of 1.3 mA, which flowed into the first column wire.

At timing B, however, a large amount of selection element current flows into elements other than element (2,1), such as into the element (2,2), and the potential of the second row wire rises in comparison with that of the first row at timing A owing to the influence of the resistance of the row wire. Consequently, even though pixel (1,1) and pixel (2,1) are provided with the same luminance signals, the measured potential V(Dy1) of the voltage monitoring circuit 7411 differs. This means that while pixel (1,1) and pixel (2,1) are provided with identical luminance signals at the time of selection, the element current If:eff(2,1) is smaller than the element current If:eff(1,1). As a result, whereas element (1,1) performs an electron emission of 0.6 $\mu$A, element (2,1) performs an electron emission of less than 0.6 $\mu$A.

Under these conditions, the brightnesses of the respective pixels will differ even though the luminance signals are identical. Therefore, If:tot(N) is determined, and passed through the first column wire, in such a manner that the planned element current If:eff(2,1) of 0.8 mA will flow from the measured potential V(Dy1) of the voltage monitoring circuit 7411. Though this will be described later in the section on principles, the measured potential V(Dy1) and If:tot(N) are interrelated-in a complex manner. When If:tot (1) is passed, therefore, the measured potential V(Dy1) changes. Accordingly, a new If:tot(1) is found from the measured potential V(Dy1) as newly determined and this is passed through the first column wire. Furthermore, a new If:tot(1) is found from the new measured potential V(Dy1) and this is passed through the first column wire. A constant If:tot(1) will eventually flow in the course of this feedback operation performed innumerable times. The optimum element current of 0.8 mA will eventually flow into the element (2,1).

{4. Principles}

The principles of correction according to this embodiment will now be described. Though these principles have been established based upon a simple model set up with respect to the characteristics of a surface-conduction electron emission element used in this embodiment, the embodiment provides similar effects even if the characteristics of the surface-conduction electron emission element depart from the model.

By using the element current If:eff(M,N) which flows into a selected element (M,N) in a column wire N as well as the leakage current If:leak(N) which flows into elements other than the selected element (M,N), the constant current If:tot (N) which the V/I converting circuit 7112 passes through the column wire N is expressed as follows:

$$\text{If:tot(N)=If:leak(M,N)+If:eff(M,N)} \tag{7-1}$$

Accordingly, the leakage current If:leak(N) in Equation (7.1) is expressed as follows using the element current If(k,N) (k≈M) which flows into a half-selected element and the leakage Iout:leak(N) of current from the wiring:

$$\text{If:leak(N)=}\Sigma\text{If(k,N)(k≈M)+Iout:leak(N)} \tag{7-2}$$

In a case where the element is constituted by the surface-conduction electron emission element, the element current If which flows into the element is very small if the voltage Vf applied to the element is below Vth, which is the threshold value of the applied voltage, as in FIG. 23. Further, at this time the slope dIf/dVf (K,N) of the element current If{Vf (K,N)} with respect to the applied voltage Vf may be said to be almost constant, and the element current If may be said to be substantially proportional to the applied voltage Vf. In addition, the current leakage Iout:leak(N) is negligibly small in comparison with the sum ΣIf(k,N) (k≈M) of the element currents which flow into the half-selected elements. Accordingly, the leakage resistance Rleak(N) can be defined as follows:

$$\text{Rleak(N)=V(DyN)/If:leak(N)} \tag{7-3}$$

When the LUT is created, the leakage resistance Rleak(N) is stored beforehand at address 1×N.

When the image display is driven, the constant current If:tot(N) passed through the column wire N is expressed as follows using Equations (7-2), (7-3):

$$\text{If:tot}(N) = V(DyN)/Rleak(N) + \text{If:eff}(M, N) \tag{7-4}$$

(in the seventh embodiment, If:eff$(M, N)$ is assumed to be independent of $M, N$)

-continued $$= V(DyN)/Rleak(N) + \text{If:eff}$$

The constant current If:tot(N) thus passed through the column wire N can be decided using the element current If:eff necessary for the selected element, the leakage resistance Rleak(N) stored in the LUT and the voltage V(DyN) of the terminal DyN measured by the voltage monitoring circuit. However, as described above in section "{3. Drive of Image Display}", the potential of the selected row wire M changes from the potential applied by the scanning circuit 7102 owing to the effects of the large amount of element current that flows into the selected element in the same row. Consequently, the fact that a constant current is passed as If:tot(N) regardless of the fact that the potential of the row wire M changes means that the current If:eff which flows into the selected element changes.

Figure 46A:
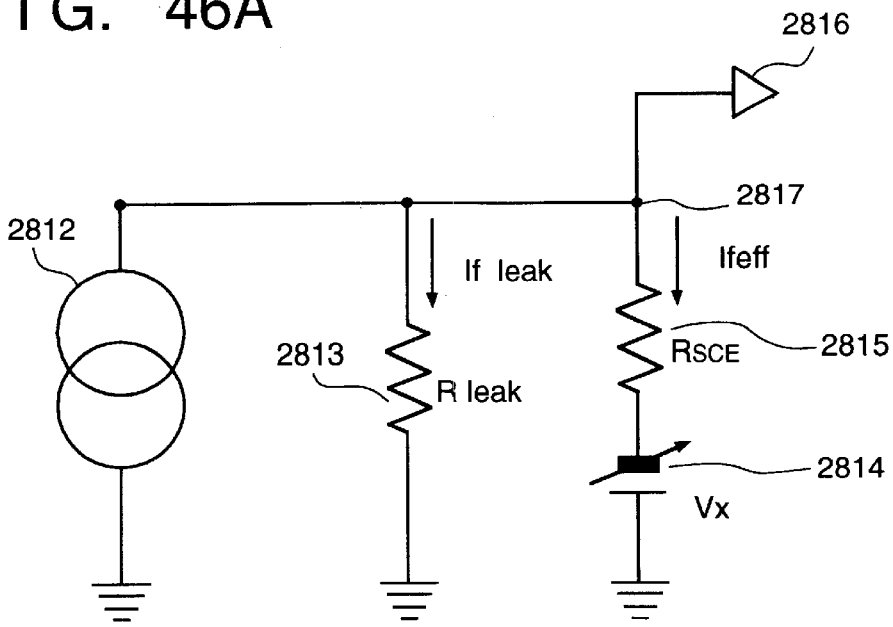
FIG. 46A is a diagram showing the principle of feedback correction according to the seventh embodiment.
Figure 46B:
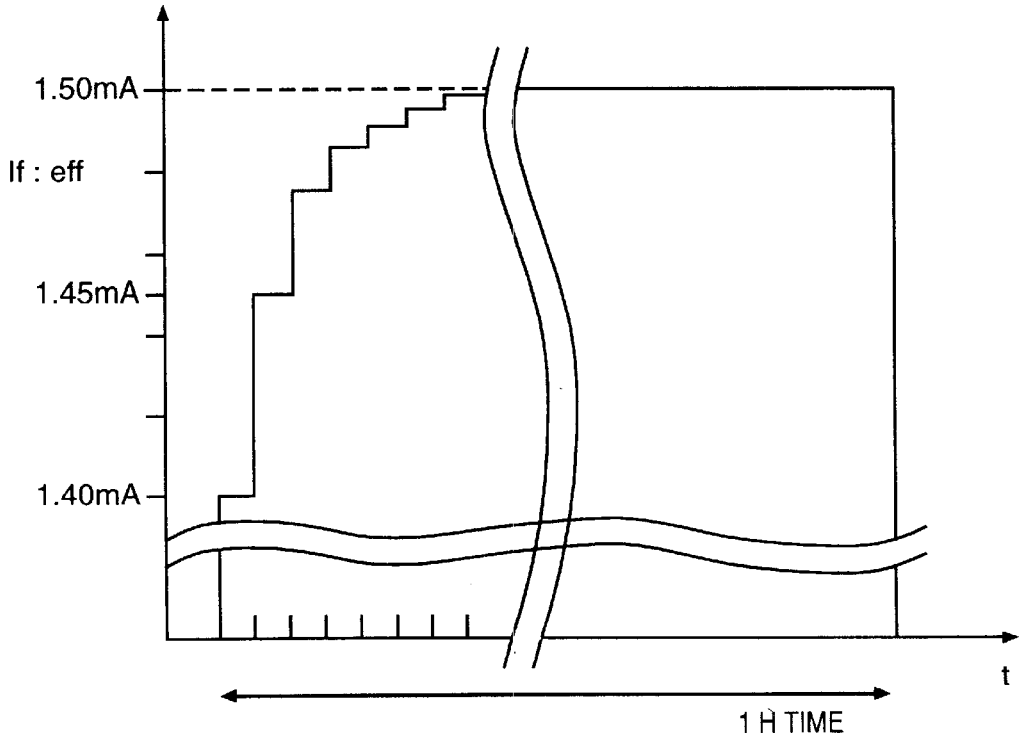
FIG. 46B is a diagram showing the distribution of If:eff corresponding to the circuit of FIG. 46A.

The reason why the element current If:eff which flows into the selected element is caused to change by the change in potential ascribable to the row wire M will be described with reference to FIG. 46A. FIG. 46B is a diagram schematically showing the manner in which the element current If:eff is distributed when the current If:tot(N) is passed through the column wire N. Numeral 2812 denotes a constant-current power supply, 2813 leakage resistance Rleak, 2815 selected-element resistance RSCE of the selected element, and 2816 a voltage monitoring circuit. Further, at numeral 2814, a variable-voltage power source Vx is shown as the potential, with respect to ground level, at the junction of the column wire M and element (M,N) when a half-selection voltage is applied in order to select the row wire M. The surface-conduction electron emission element possesses a non-linear V-I characteristic, as shown also in FIG. 23. However, if the V-I characteristic is assumed to be linear, as when the change in Vf is very small, the resistance RSCE at numeral 2815 may be defined as follows:

$$\text{RSCE}=\text{If/Vf} \tag{7-5}$$

Further, the voltage monitoring circuit 2816 measures the potential V(DyN) of a wire 2817. When the constant-current power supply 2812 passes the current If:tot in the circuit of FIG. 46A, assume that Ileak is the current passed through the leakage resistance Rleak 2813 and that If:eff is the current passed through the resistance RSCE 2815 of the selected element. In accordance with Ohm's law, the following is obtained:

$$\text{Va=RSCE·If:eff+Vb=If:leak·Rleak} \tag{7-6}$$

From the law of preservation of electric charge, $$\text{If:tot=If:eff+If:eff} \tag{7-7}$$

is obtained.

In order to facilitate subsequent calculations, assume the simplification Rleak=RSCE=1 kΩ and assume that a current If=SCE 1.5 mA flows into the selected element. If it is assumed that Vb=−1.0 V is the ideal value, then the voltage monitoring circuit measures $$\text{Va=RSCE·If:eff−Vb=Rleak·If:leak=1×1.5−1.0=1×If:eff} \tag{7-8}$$

From this we have $$\text{If:leak=0.5 mA} \tag{7-9}$$

Accordingly, we have $$If:tot(N)=If:leak+If:eff=0.5+1.5=2\ mA \quad (7\text{-}10)$$

If the potential of a selected row wire represented by Vx and the potential due to a current which flows into the row wire are −1.0 V, then If:tot(N) passed through the selected row wire becomes 2 mA. Accordingly, the constant-current power supply 2812 should be set so as to pass a current of 2 mA. In actuality, however, it is known that a large current flows into the row wire, depending upon the number of other elements lit in the same row. This means that Vx also changes under this influence.

The principle of this change due to the number of other elements lit in the same row as that of the selected element will now be described. When row M is scanned, assume that the only element lit in the row wire M is the element (M,N), and that other elements (Mk) (where k is an integer other than N) on the row wire M are not lit. The current which flows into the row wire M at this time is approximately the same as the current If:tot(N) that flows into the column wire N, which includes the selected element (M,N). Assume that Vx=−1.0 V holds owing to the voltage applied to the selected row wire M and the change in potential due to the current which flows into the row wire M having wiring resistance. If the potential at the junction between the row wire M and the scanning circuit 7102 is Vd, then, since the current which flows into the row wire M is small, this Vd takes on a value fairly close to Vx. Accordingly, this value of Vx [Vx=−1.0(V)] is adopted as the standard value. At the end of horizontal scanning of one row of the rows M, assume that only i-number of the other elements (M+1,k) in row (M+1) are lit in the scanning of row (M+1). At this time a selection current flows into the other i-number of elements in the row wire (M+1) and a current, which is larger than that when the row wire M was selected, flows into the row wire (M+1). As a consequence, Vx departs from the standard value due to the influence of the wiring resistance of row wire (M+1), and the potential of Vx rises in comparison with the potential which prevailed when the row M was scanned. If it is assumed that the amount of rise in Vx if 0.2 V so that Vx=−0.8 V holds, Va when row (M+1) is scanned is obtained as follows from Equations (7-8), (7-9):

$$Va=1\times If:eff-0.8=1\times If:leak\ \ If:tot=If:leak+If:eff \quad (7\text{-}11)$$

Solving this gives Va=0.6 V, If:eff=1.4 mA, If:leak=0.6 mA. In other words, as a result of the fact that Vb becomes large, Va rises by 0.1 V from 0.5 V. Consequently, the ratio of distribution of If:tot to If:eff and If:leak changes and the value of If:eff decreases. If the value of If:tot remains at Vb=2.0 mA, we have If:eff=1.4 mA, If:leak=0.6 mA. Since the value of If:eff decreases, the pixel corresponding to this element becomes darker. This means that If:tot must be increased.

If it is known that Vb=−0.8 V holds, then Va is obtained from Equation (7-11) as follows:

$$Va=1.5\times 1-0.8=0.7\ V \quad (7\text{-}12)$$

Accordingly, If:leak becomes as follows:

$$If:leak=Va/Rleak=0.7/1=0.7\ mA \quad (7\text{-}13)$$

In order to pass 1.5 mA through the selected element, therefore, 1.5+0.7=2.2 mA must be made to flow as If:tot.

In actuality, however, it is difficult to measure Vx and RSCE is obtained in fairly non-linear form, as a result of which RSCE is difficult to observe. Accordingly, the current If:tot to the column wire is changed using Va, which is capable of being monitored, and Rleak, which is already known by observation. Thus, a new Va is determined and the current If:tot, which is obtained as shown below on the basis of this Va and the ideal value If:eff of the element current which flows into the selected element, is passed by the constant-current power supply 2812 in a first feedback operation. From Equation (7-10) we have $$If:tot=If:eff(ideal\ value)+Va/Rleak \quad (7\text{-}14)$$

Therefore, the value calculated from Va, which was initially measured as If:tot, and from If:eff(ideal value)=1.0 mA is passed into the column wire after Va is measured. In other words, If:tot passed into the column wire at the first feedback operation is $$\begin{aligned} If:tot &= If:eff(ideal\ value) + Va/Rleak \quad (7\text{-}15) \\ &= 1.5 + 0.6/1 \\ &= 2.1 \end{aligned}$$

When this current is passed and Va is measured anew, we have Va=0.65 V. As a result, the current If:tot splits in such a manner that If:eff=1.45 mA and If:leak=0.65 mA are established.

At this time If:eff flows in an amount of 1.4 mA. Though this is closer by 0.1 mA to the ideal value 1.5 mA of If:eff, correction is still required. Accordingly, now when the current If:tot is passed, a current is passed into the column wire in such a manner that $$\begin{aligned} If:tot &= If:eff(ideal\ value) + Va/Rleak \quad (7\text{-}15) \\ &= 1.5 + 0.65 \\ &= 2.15\ mA \end{aligned}$$

is obtained as the current If:tot passed by the constant-current power supply 2812 in the second feedback operation, this being derived from Va=0.65 V measured at the time of the first feedback operation. When If:tot=2.15 mA is passed into the column wire, now Va=0.675 V is measured as Va. Thus the current If:tot=2.15 mA flows upon splitting into If:eff=1.475 mA and If:leak=0.675 mA. In this feedback operation, If:eff draws closer to the ideal value 1.5 mA.

By repeating this feedback that applies the correction, If:eff approaches the ideal value of 1.5 mA. When If:eff converges to establish the equality If:eff=1.5 mA, we have Va=0.7 V, If:leak=0.7 mA. Though the feedback operation is performed, the correction is carried out using a fast clock signal so that convergence is achieved in a time sufficiently shorter than [1/30 (the time for one screen)]/500 (the vertical resolution)=about $6\times10^{-5}$ sec (60 $\mu$s), which is the time needed to light one row (the scanning time of one row) in a case where a television signal is the signal entered. Such feedback can be implemented in digital control or high-speed analog control using a high-speed clock.

{5. Effects of Seventh Embodiment}

According to this embodiment, an electron emission distribution arising from a voltage distribution produced in wiring can be corrected in real time while an image is being displayed. This makes it possible to correct a temporal change in the voltage distribution of the wiring caused by the pattern of the image display. Further, since the electron emission current is constant, a stable image display can be presented using surface-conduction electron emission elements having a non-linear V-I characteristic. As a result, an image display faithful to the video luminance signal can be presented.

Figure 53A:
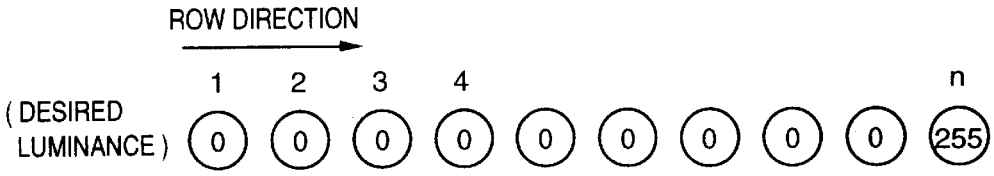
FIGS. 53A, 53B, 54A, 54B, 55A, 55B are diagrams exemplifying the effects of the seventh embodiment.
Figure 53B:
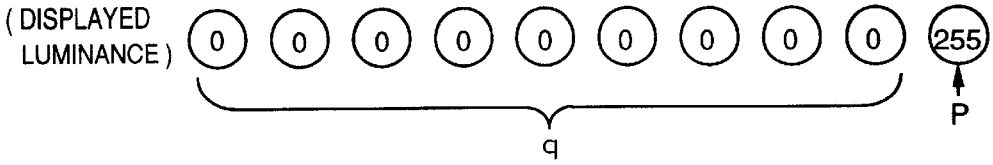
Figure 54A:
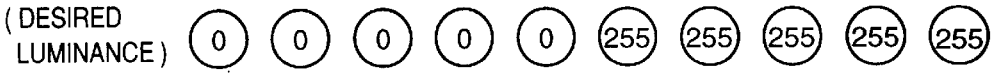
Figure 54B:
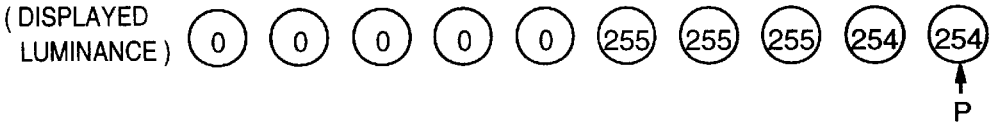
Figure 55A:
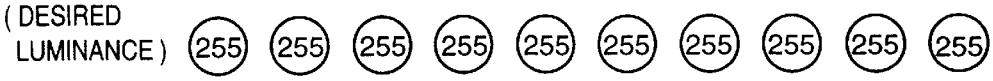
Figure 55B:
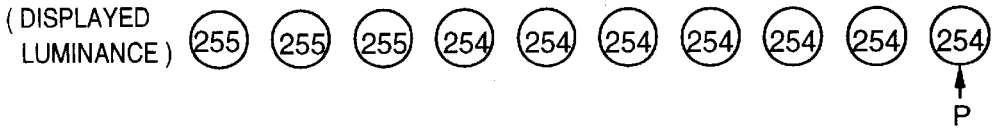

For example, as shown in FIGS. 53B, 54B and 55B, the accuracy of displayed luminance is improved greatly in comparison with the conventional method.

Specifically, leakage current is controlled by the method of applying suitable voltages Vx, O to row wires. This provides the following effects:

First, in comparison with the prior-art example shown in FIGS. 5B, 6B, 7B, fluctuation in luminance when the display pattern is changed can be reduced by a wide margin, as indicated at the arrows P.

Second, in the prior art, pixels for which the desired luminance is zero still emit light (see q in FIG. 5B). This can be prevented.

Third, it is possible to prevent an unselected row from emitting light.

Fourth, with this embodiment, it is also possible to correct for a change in leakage current arising from a voltage drop produced by wiring resistance. As a result, a distribution in luminance within one row also can be reduced (see FIG. 55B).

As a result of the foregoing, a deviation or fluctuation in luminance and a decline in contrast can be reduced.

Eighth Embodiment

In an eighth embodiment, the luminance signal applied to each pixel is represented by the current waveform of a constant-current pulse. This embodiment is similar to the seventh embodiment is other respects.

Figure 47:
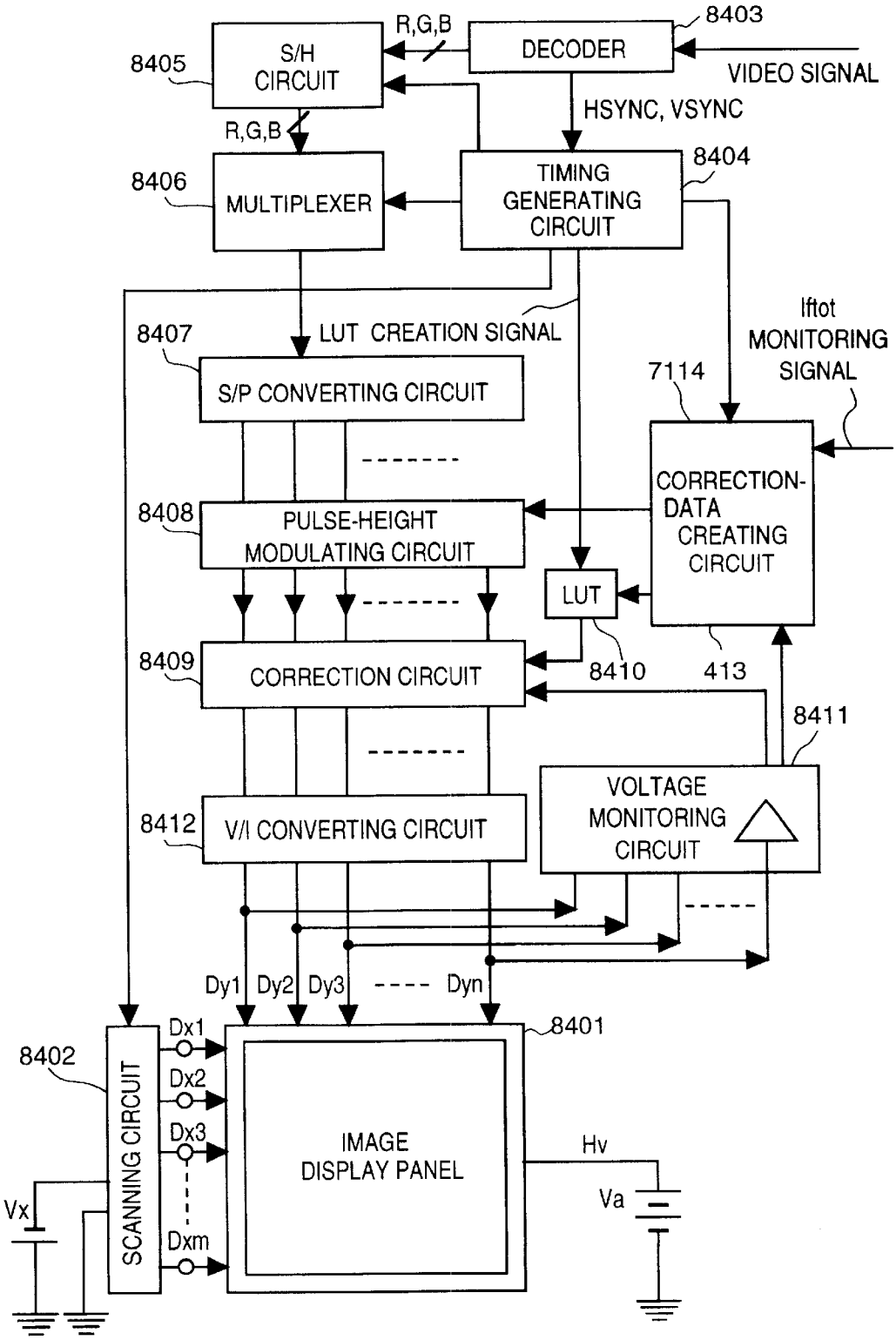
FIG. 47 is a diagram showing the flow of a luminance signal according to an eighth embodiment.

FIG. 47 illustrates the flow of signals in the eighth embodiment. FIG. 47 differs from FIG. 42 of the seventh embodiment in that the pulse-width modulating circuit 7111 is replaced by a pulse-height modulating circuit 8408. The entered composite image signal is separated into luminance signals of the three primary colors, the horizontal synchronizing signal (HSYNC) and the vertical synchronizing signal (VSYNC) by a decoder 8403. A timing generator 8404 generates various timing signals synchronized to the HSYNC and VSYNC signals. The R, G, B luminance signals are sampled and held by an S/H (sample-and-hold) circuit 8405 at a timing conforming to the array of pixels. A multiplexer 8406 converts the held signal to a serial signal in dependence upon the order of the pixels. An S/P (serial/parallel) converting circuit 8407 converts the serial signal to a parallel signal row by row.

The pulse-height modulating circuit 8408 produces a drive pulse having a voltage value commensurate with the image signal intensity (in the eighth embodiment, the value of luminance is not represented by the pulse width of the pulse). By using a LUT 8410, which stores leakage currents that flow out to elements other than a selected element at the time the panel is driven, and a voltage monitoring circuit 8411 for monitoring the amplitude of the panel driving current signal, a correction circuit 8409 determines a voltage quantity corrected according to each column wire and the selected row. A V/I converting circuit 8412 converts the corrected voltage quantity to constant-current pulses of a fixed current quantity.

The constant current is passed into each column wire. At the same time, rows are selected successively by a scanning circuit 8402 to present a two-dimensional image display. The procedure for creating the LUT 8410 is similar to that of the seventh embodiment. The principle of correction according to the eighth embodiment also is similar to that of the seventh embodiment.

{Drive of Image Display}

When an image is displayed according to the eighth embodiment, the value of luminance is represented by the magnitude of the current flowing through the column wire. In this embodiment, the pulse-height modulating circuit 8408 changes the image signal, which has entered from the S/P converting circuit 8407, to a constant-voltage pulse having a pulse height conforming to the image display of R gray levels in terms of resolution. (The pulse width is constant and does not depend upon the scanned row.) Thereafter, the constant-voltage pulses having the gray levels as pulse height are changed to constant-current pulses by the V/I converting circuit 8412.

The V/I converting circuit 8412 may be constructed by a circuit well known as a constant-current power supply. For example, the V/I converting circuit is of the current mirror type described above with reference to FIG. 44B of the seventh embodiment. In the correction circuit 8409, a compensating constant-voltage pulse is added to the constant-voltage pulse having the gray level in the form of pulse height in such a manner that the V/I converting circuit 8412 will pass a constant current If:tot(N) [=If:leak(N)+If:eff], which is obtained by adding the leakage current If:leak(N) to the constant current If:eff passed through the selected element, through each of the column wires.

In general, when the video luminance signal which enters the pulse-height modulating circuit 8408 is L, the constant-current pulse If:tot(N) passed through the column wire N is $$\begin{aligned} \mathrm{If:tot}(N) &= \mathrm{If:leak}(N) + \mathrm{If:eff} \\ &= \mathrm{If:leak}(N) + \mathrm{If:eff} \times L/(R-1) \end{aligned} \tag{10-1}$$

[where V(Dyn) is the voltage of terminal DyN measured by the voltage monitoring circuit].

By way of example, assume that the pixel (M,N) is lit by a video luminance signal L=255 from among the R=256, which is the maximum luminance signal, and that it is required that the electron emission current Ie from the element (M,N) at this time be set at 0.6 $\mu$WA. In this case, the required element current If:eff is 0.8 mA, based upon FIG. 23. Accordingly, it will suffice to pass a current If:leak(N)+0.8 mA through all n-number of the column wires as If:tot(N). If the leakage resistance R(N) of a column wire N is 10 kΩ at this time, then the current If:tot(N) passed through the column wire N will be as follows:

$$\begin{aligned} \mathrm{If:tot}(N) &= \mathrm{If:leak}(N) + \mathrm{If:eff} \\ &= V(DyN)/\mathrm{Rleak}(N) + \mathrm{If:eff} \\ &= 5\ V/10\ k\Omega + 0.8\ \mathrm{mA} \\ &= 1.3\ \mathrm{mA} \end{aligned} \tag{10-2}$$

[where V(Dyn) is the voltage of terminal DyN measured by the voltage monitoring circuit]. Accordingly, when the current of 1.3 mA is passed into the column wire N from the output of the V/I converting circuit, a current of 0.8 mA flows into the selected element and an emission current of 0.6 $\mu$A is obtained.

If the resistance value R of the V/I converting circuit in FIG. 44B is 1 kΩ, the correction circuit 8409 outputs a correction signal of 1.3 V as the input voltage Vin of the V/I converting circuit 8412 and the output of the V/I converting circuit delivers a pulse of a constant current of 1.3 mA.

Figure 48A:
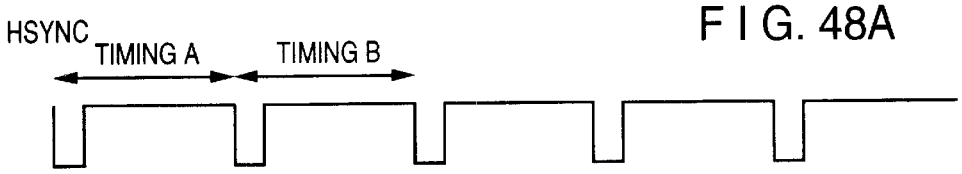
FIGS. 48A to 48H are waveform diagrams of waveforms associated with wiring of a first column according to the eighth embodiment.
Figure 48B:
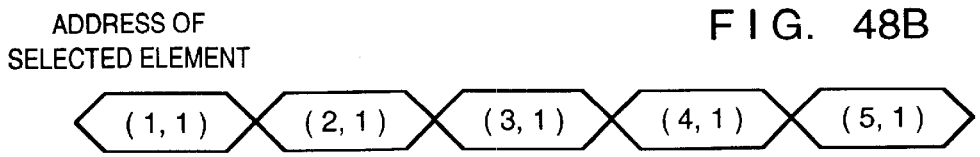
Figure 48C:
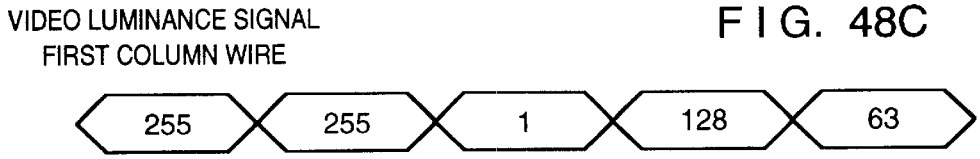
Figure 48D:
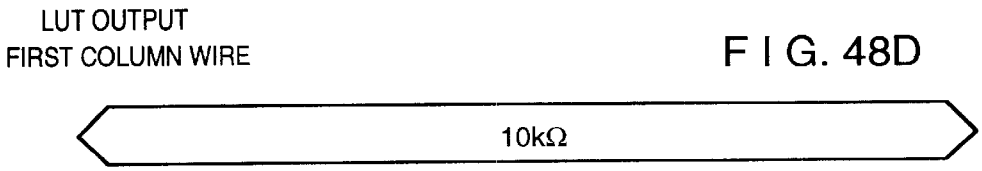
Figure 48E:
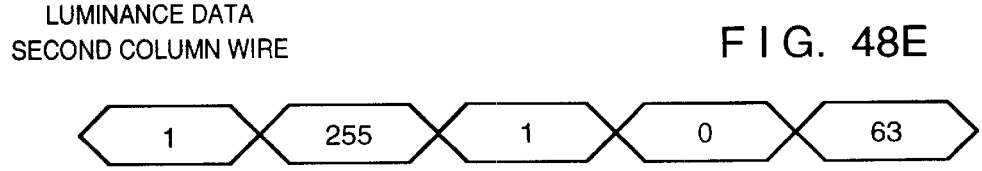
Figure 48F:
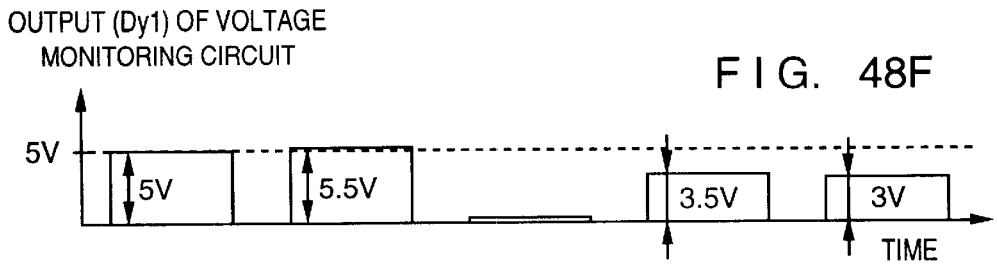
Figure 48G:
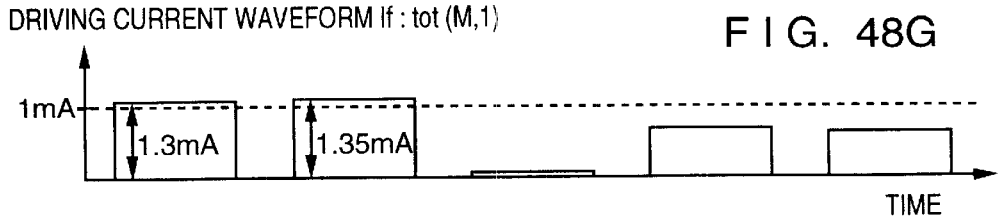
Figure 48H:
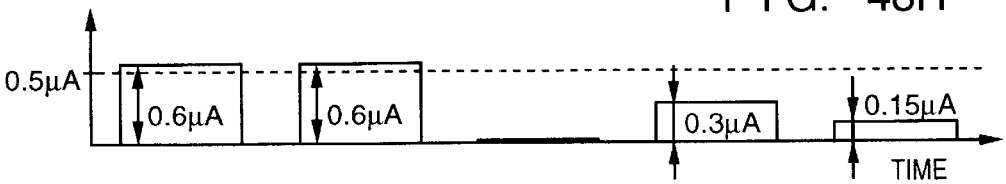

However, depending upon how elements in the same row as the selected element are lit, the leakage current If:leak(N) varies in the same manner as in the seventh embodiment and, hence, the measured potential V(DYN) of the voltage monitoring circuit 8411 differs. This will be described with reference to FIGS. 48A to 48H. FIGS. 48A to 48H are timing charts of portions associated with the first column wire when elements (M,1) (M=1, 2, 3, 4, 5) are lit one after another. Here FIG. 48A represents a synchronizing signal HSYNC, FIG. 48B, the number of a selected element to be lit (this number also represents the LUT accessed), FIG. 48C, a video luminance signal-of pixel (M,1) on the first column wire, FIG. 48D, the leakage resistance Rleak(N) of the leakage current If:leak(N) component of the first column wire from the LUT, FIG. 48E, a video luminance signal of pixel (M,2) on the second column wire, FIG. 48F, the potential V(Dy1),of the first column wire measured by the voltage monitoring circuit 8111, FIG. 48G, the current quantity If:tot(M,1) passed through the first column wire, and FIG. 48H, the electron emission current Ie(M,1) emitted from the selected element. In the eighth embodiment, the electron emission time of element (M,1) is constants, as shown in FIG. 48H, and the luminance information is represented by pulse height.

Assume that the leakage resistance Rleak(1) of the first column wire is 10 kΩ. At the timing A at which the first row wire is selected by the scanning circuit, assume that 255, which is the maximum luminance signal, enters pixel (1, 1) and that a luminance signal 0, which does not light any pixel, enters all of the pixels in the same row with the exception of pixel (1,1), as indicated in FIG. 48C. In other words, at timing A, in the first row only the pixel (1,1) is lit at the maximum luminance. In this case attention should be directed toward pixel (2,1) of the second column, which is indicated in FIG. 48E, as being representative of the other pixels in the same row as pixel (1,1).

On the other hand, at timing B at which the second row wire is selected by the scanning circuit 8402, consider a case where 255, which is the maximum luminance signal; enters pixel (2,1) and 255, which is the maximum luminance signal, also enters the pixels other than this pixel. In other words, at timing B, all of the pixels in the second row light in response to the maximum luminance signal. At this time 255, which is the maximum luminance signal, also enters the pixel (2,2) of the second column indicated FIG. 48E.

In a case such as this, a selection current does not flow into elements other than (1,1) at timing A. Therefore, the current which flows into the first row wire is only the element current of element (1,1) and the leakage currents of elements other than element (1,1). At this time there is almost no fluctuation in the potential of the first row wire and the measured potential V(Dy1) of the voltage monitoring circuit 8411 is 5 V as planned. Consequently, a current of 0.8 mA, as planned, flows into the element (1,1) from the constant current of 1.3 mA, which flowed into the first column wire.

At timing B, however, a large amount of selection element current flows into elements other than element (2,1), such as into the element (2,2), and the potential of the second row wire rises in comparison with that of the first row wire at timing A. Consequently, even though pixel (1,1) and pixel (2,1) are provided with the same luminance signals, the measured potential V(Dy1l) of the voltage monitoring circuit 8411 differs. This means that while pixel (1,1) and pixel (2,1) are provided with identical luminance signals at the time of selection, the element current If:eff(2,1) becomes smaller than the element current if:eff(1,1). As a result, whereas element (1,1) performs an electron emission of 0.6 μA, element (2,1) performs an electron emission of less than 0.6 μA. Under these conditions, the brightnesses of the respective pixels will differ even though the luminance signals are identical. As a consequence, an attractive image display is not obtained.

Accordingly, If:tot(N) is determined by a feedback method identical with that of the seventh embodiment, and this current is passed through the first column wire, in such a manner that the planned element current If:eff(2,1) of 0.8 mA will flow from the measured potential V(Dy1) of the voltage monitoring circuit 8411. A current of 1.35 mA flows as the constant current If:tot(1) (g), and the optimum element current of 0.8 mA flows into the element (2,1). As a result, the desired electron emission of 0.6 mA is obtained. When element (3,1), element (4,1) and element (5,1), which receive video luminance signals different from 255 of element (1,1) and element (2,1), are lit, the method of applying correction feedback is used in the same manner as when the element (2,1) is lit.

Ninth Embodiment (Embodiment of multifunctional display apparatus)

Figure 49:
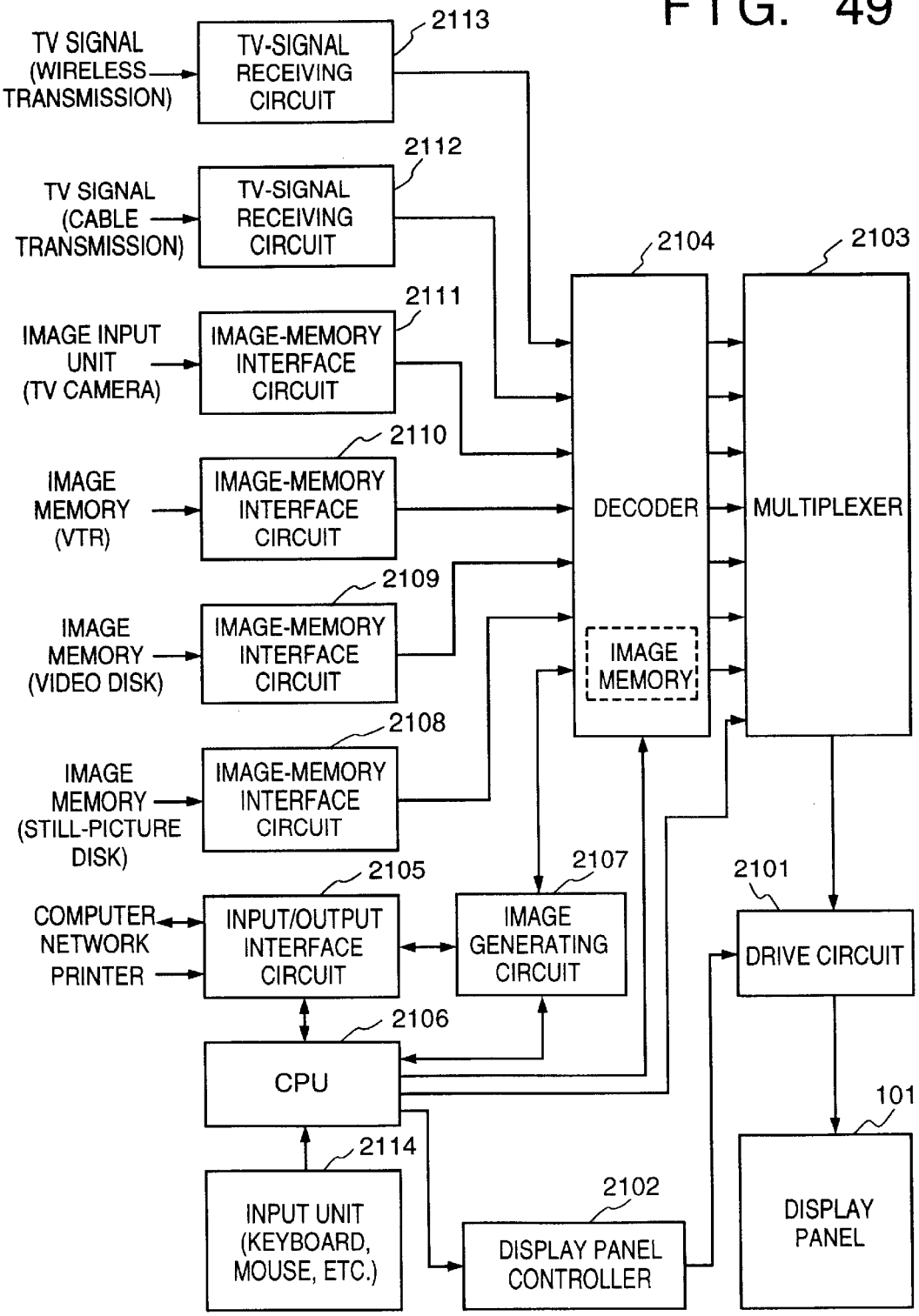
FIG. 49 is a diagram showing an example of a multifunctional display apparatus.

FIG. 49 is a diagram showing an example of a multifunctional display apparatus constructed in such a manner that image information supplied from various image information sources, the foremost of which is a television (TV) broadcast, can be displayed on a display apparatus according to the first through eighth embodiments.

Shown in the Figure are a display panel 101, a drive circuit 2101 for the display panel, a display controller 2102, a multiplexer 2103, a decoder 2104, an input/output interface circuit 2105, a CPU 2106, an image forming circuit 2107, image-memory interface circuits 2108, 2109 and 2110, an image-input interface circuit 2111, TV-signal receiving circuits 2112, 2113, and an input unit 2114. It should be noted that the circuitry of the first through eighth embodiments is included in the drive circuit 2101 and display panel 101 of FIG. 49. In a case where the display apparatus of this embodiment receives a signal containing both video information and audio information as in the manner of a television signal, for example, audio is of course reproduced at the same time that video is displayed. However, circuitry and speakers related to the reception, separation, reproduction, processing and storage of audio information not directly related to the features of this invention are not described.

The functions of the various units will be described in line with the flow of the image signal.

First, the TV-signal receiving circuit 2113 receives a TV image signal transmitted using a wireless transmission system that relies upon radio waves, optical communication through space, etc. The system of the TV signals received is not particularly limited. Examples of the systems are the NTSC system, PAL system and SECAM system, etc. A TV signal comprising a greater number of scanning lines (e.g., a so-called high definition TV signal such as one based upon the MUSE system) is a signal source that is ideal for exploiting the advantages df the above-mentioned display panel suited to enlargement of screen area and to an increase in the number of pixels. A TV signal received by the TV-signal receiving circuit 2113 is outputted to the decoder 2104.

The TV-signal receiving circuit 2112 receives the TV image signal transmitted by a cable transmission system using coaxial cable or optical fibers, etc. As in the case of the TV-signal receiving circuit 2113, the system of the received TV signal is not particularly limited. Further, the TV signal received by this circuit also is outputted to the decoder 2104. The image-input interface circuit 2111 is a circuit for accepting an image signal supplied by an image input unit such as a TV camera or image reading scanner. The accepted image signal is outputted to the decoder 2104.

The image-memory interface circuit 2110 accepts an image signal that has been stored in a video tape recorder (hereinafter abbreviated to VTR) and outputs the accepted image signal to the decoder 2104. The image-memory interface circuit 2109 accepts an image signal that has been stored on a video disk and outputs the accepted image signal to the decoder 2104.

The image-memory interface circuit 2108 accepts an image signal from a device storing still-picture data, such as a so-called still-picture disk, and outputs the accepted still-picture data to the decoder 2104. The input/output interface circuit 2105 is a circuit for connecting the display apparatus and an external computer, computer network or output device such as a printer. It is of course possible to input/output image data, character data and graphic information and, depending upon the case, it is possible to input/output control signals and numerical data between the CPU 2106, with which the display apparatus is equipped, and an external unit.

The image generating circuit 2107 is for generating display image data based upon image data and character/graphic information entered from the outside via the input/output interface circuit 2105 or based upon image data character/graphic information outputted by the CPU 2106. By way of example, the circuit is internally provided with a rewritable memory for storing image data or character/graphic information, a read-only memory in which image patterns corresponding to character codes have been stored, and a circuit necessary for generating an image, such as a processor for executing image processing. The display image data generated by the image generating circuit 2107 is outputted to the decoder 2104. In certain cases, however, it is possible to input/output image data relative to an external computer network or printer via an input/output interface circuit 2105.

The CPU 2106 mainly controls the operation of the display apparatus and operations relating to the generation, selection and editing of display images. For example, the CPU outputs a control signal to the multiplexer 2103 to suitably select or combine image signals displayed on the display panel. At this time the CPU generates a control signal for the display panel controller 2102 in conformity with the image signal displayed and suitably controls the operation of the display apparatus, such as the frequency of the frame, the scanning method (interlaced or non-interlaced) and the number of screen scanning lines. Furthermore, the CPU outputs image data and character/graphic information directly to the image generating circuit 2107 or accesses the external computer or memory via the input/output interface circuit 2105 to enter the image data or character/graphic information. It goes without saying that the CPU 2106 may also be used for purposes other than these. For example, the CPU may be directly applied to a function for generating and processing information, as in the manner of a personal computer or word processor. Alternatively, the CPU may be connected to an external computer network via the input/output interface circuit 2105, as mentioned above, so as to perform an operation such as numerical computation in cooperation with external equipment.

The input unit 2114 is for allowing the user to enter instructions, programs or data into the CPU 2106. Examples are a keyboard and mouse or various other input devices such as a joystick, bar code reader, voice recognition unit, etc. The decoder 2104 is a circuit for reversely converting various image signals, which enter from the units 2107~2113, into color signals of the three primary colors or a luminance signal and I, Q signals. It is desired that the decoder 2104 be internally equipped with an image memory, as indicated by the dashed line. This is for the purpose of handling a television signal that requires an image memory when performing the reverse conversion, as in a MUSE system, by way of example. Providing the image memory is advantageous in that display of a still picture is facilitated and in that, in cooperation with the image generating circuit 2107 and CPU 2106, editing and image processing such as thinning out of pixels, interpolation, enlargement, reduction and synthesis are facilitated.

The multiplexer 2103 suitably selects the display image based upon a control signal which enters from the CPU 2106. More specifically, the multiplexer 2103 selects a desired image signal from among the reversely-converted image signals which enter from the decoder 2104 and outputs the selected signal to the drive circuit 2101. In this case, by changing over and selecting the image signals within the display time of one screen, one screen can be divided up into a plurality of areas and images which differ depending upon the area can be displayed as in the manner of a so-called split-screen television. The display panel controller 2102 controls the operation of the drive circuit 2101 based upon the control signal which enters from the CPU 2106.

With regard to the basic operation of the display panel 101, a signal for controlling the operating sequence of a driving power supply (not shown) for the display panel 101 is outputted to the drive circuit 2101, by way of example. In relation to the method of driving the display panel 101, a signal for controlling, say, the frame frequency or scanning method (interlaced or non-interlaced) is outputted to the drive circuit 2101. Further, there is a case in which a control signal relating to adjustment of picture quality, namely luminance of the display image, contrast, tone and sharpness, is outputted to the drive circuit 2101.

The drive circuit 2101 is a circuit for generating a drive signal applied to the display panel 101 and operates based upon the image signal which enters from the multiplexer 2103 and the control signal which enters from the display panel controller 2102.

The functions of the various units are as described above. By using the arrangement shown in FIG. 49, image information which enters from a variety of image information sources can be displayed on the display panel 101 in the-display apparatus of this embodiment. Specifically, various image signals, the foremost of which is a television broadcast signal, are reversely converted in the decoder 2104, suitably selected in the multiplexer 2103 and entered into the drive circuit 2101. On the other hand, the display controller 2102 generates a control signal for controlling the operation of the drive circuit 2101 in dependence upon the image signal displayed. On the basis of the aforesaid image signal and control signal, the drive circuit 2101 applies a drive signal to the display panel 101. As a result, an image is displayed on the display panel 1201. This series of operations is under the overall control of the CPU 2106.

Further, in the display apparatus of this embodiment, the contribution of the image memory incorporated within the decoder 2104, the image generating circuit 2107 and CPU 2106 make it possible not only to display image information selected from a plurality of items of image information but also to subject the displayed image information to image processing such as enlargement, reduction, rotation, movement, edge emphasis, thinning-out, interpolation, color conversion and vertical-horizontal ratio conversion and to image editing such as synthesis, erasure, connection, substitution and fitting. Further, though not particularly touched upon in the description of this embodiment, it is permissible to provide a special-purpose circuit for performing processing and editing with regard also to audio information in the same manner as the image processing and image editing set forth above.

Accordingly, the display apparatus of this invention is capable of being provided with various functions in a single unit, such as the functions of TV broadcast display equipment, office terminal equipment such as television conference terminal equipment, image editing equipment for handling still pictures and moving pictures, computer terminal equipment and word processors, games, etc. Thus, the display apparatus has wide application for industrial and private use.

FIG. 49 merely shows an example of the construction of a multifunctional display apparatus. However, the apparatus is not limited to this arrangement. For example, circuits relating to functions not necessary for the particular purpose of use may be deleted from the structural elements of FIG. 49. Conversely, depending upon the purpose of use, structural elements may be additionally provided. For example, in a case where the display apparatus is used as a TV telephone, it would be ideal to add a transmitting/receiving circuit inclusive of a television camera, audio microphone, illumination equipment and modem to the structural elements.

As many apparently widely different embodiments of the present invention can be made without departing from the spirit and scope thereof, it is to be understood that the invention is not limited to the specific embodiments thereof except as defined in the appended claims.

What is claimed is:

1. An electron-beam generating device comprising:

a plurality of cold cathode elements arrayed in the form of rows and columns on a substrate;

m-number of row wires and n-number of column wires for wiring said plurality of cold cathode elements into a matrix; and drive signal generating means for generating signals which drive said plurality of cold cathode elements one row at a time, wherein said drive signal, generation means includes:

current-value determining means for determining a current value, which will be passed through each of the n-number of column wires, on the basis of an externally entered electron-beam demand value, current applying means for passing the current, which has been determined by said current-value determining means, through each column wire; and voltage applying means for applying a first voltage from a voltage source to a selected row wire of said m-number of row wires and applying a second voltage from a voltage source to unselected row wires of said m-number of row wires, while the first voltage is being applied to the selected row wire, where the first voltage is different from the second voltage, wherein the second voltage applied to the unselected row wires causes a leakage current of the current supplied to each column wire to become constant.

2. The device according to claim 1, wherein said current-value determining means comprises means for outputting the current value, which has been determined on the basis of the electron-beam demand value, as a voltage signal that has been amplitude-modulated or pulse-width modulated; and said current applying means comprises a voltage/current converting circuit.

3. The device according to claim 2, wherein said voltage/current converting circuit includes a transistor, an operational amplifier and a resistor.

4. The device according to claim 1, wherein said current-value determining means comprises:

element-current determining means for determining an element current, which is to be passed through a cold cathode element connected to the selected row wire to which the first voltage is applied, on the basis of the externally entered electron-beam demand value and an output characteristic of the cold cathode element; and correcting means for correcting the element current determined by said electron-element current determining means.

5. The device according to claim 4, wherein said correcting means includes leakage-current determining means for determining a leakage current passed through the unselected row wires of said m-number of row wires to which the second voltage is applied while the first voltage is being applied to the selected row wire and adding means for adding an output value from said element-current determining means and an output value from said leakage-current determining means.

6. The device according to claim 5, wherein said leakage-current determining means includes means for applying the second voltage to a row wire; and current measuring means for measuring a current which flows into a column wire.

7. The device according to claim 5, wherein said leakage-current determining means comprises a memory in which leakage currents found in advance by measurement or calculation are stored.

8. The device according to claim 1, wherein image data is used as the externally entered electron-beam demand value.

9. The device according to claim 1, wherein said cold cathode elements are surface-conduction electron emission elements.

10. The apparatus of claim 1, wherein said current-value determining means comprises:

element-current determining means for determining an element current, which is to be passed through a cold cathode element of a selected row wire to which the first voltage is applied, on the basis of the externally entered electron-demand value and an output characteristic of the cold cathode element; and correcting means for correcting the element current determined by said electron-element current determining means.

11. The apparatus of claim 10, wherein said correcting means includes leakage-current determining means for determining a leakage current passed through the row wire to which the second voltage is applied; and adding means for adding an output value from said element-current determining means and an output value from said leakage-current determining means.

12. The apparatus according to claim 11, wherein said leakage-current determining means includes:

means for applying the second voltage to a row wire; and current measuring means for measuring a current which flows into a column wire.

13. The apparatus according to claim 14, wherein said correcting means includes:

wiring-potential measuring means for measuring wiring potential; and means for changing an amount of a correction in conformity with a result of measurement by said wiring-potential measuring means.

14. The apparatus according to claim 11, wherein said leakage-current determining means comprises a memory in which leakage currents found in advance by measurement or calculation are stored.

15. A device according to claim 1, wherein the second voltage is a ground level.

16. An image forming apparatus comprising:

an electron-beam generating device having:

a plurality of cold cathode elements arrayed in the form of rows and columns on a substrate;

m-number of row wires and n-number of column wires for wiring said plurality of cold cathode elements into a matrix; and drive signal generating means for generating signals which drive said plurality of cold cathode elements one row at a time, wherein said drive signal generating means includes:

current value determining means for determining a current value, which will be passed through each of the n-number of column wires, on the basis of an externally entered electron-beam demand value;

current applying means for passing the current, which has been determined by said current-value determining means through each column wire; and voltage applying means for applying a first voltage from a voltage source to a selected row wire of said m-number of row wires and applying a second voltage from a voltage source to unselected row wires of said m-number of row wires, while the first voltage is being applied to the selected row wire, where the first voltage is different from the second voltage; and an image forming member for forming an image by irradiation with an electron beam outputted by said electron beam generating device, wherein the second voltage applied to the unselected row wires causes a leakage current of the current supplied to each column wire to become constant.

17. The image forming apparats according to claim 16, wherein said image forming member comprises a phosphor.

18. The apparatus according to claim 16, wherein said current-value determining means comprises means for outputting the current value, which has been determined on the basis of the electron-beam demand value, as a voltage signal that has been amplitude modulated-or pulse-width. modulated; and said current applying means comprises a voltage/current converting circuit.

19. The apparatus of claim 18, wherein said voltage/current converting circuit includes a transistor, an operational amplifier and a resistor.

20. The apparatus according to claim 16, wherein said cold cathode elements are surface-conduction electron emission elements.

21. An apparatus according to claim 16, wherein the second voltage is a ground level.

22. A method of driving an electron-beam generating device having a plurality of cold cathode elements arrayed in the form of rows and columns on a substrate, m-number of row wires and n-number of column wires for wiring the plurality of cold cathode elements into a matrix, and drive signal generating means for generating signals which drive the plurality of cold cathode elements one row at a time, said method comprising:

a current-value determining step of determining a current value, which will be passed through each of the n-number of column wires, on the basis of an externally entered electron-beam demand value;

a current applying step of passing the current, which has been determined at said current-value determining step, through each column wire; and a voltage applying step of applying a first voltage from a voltage source to a selected row wire of said m-number of row wires and applying a second voltage from a voltage source to unselected row wires of said m-number of row wires, while the first voltage is being applied to the selected row wire, where the first voltage is different from the second voltage, wherein the second voltage applied to the unselected row wires causes a leakage current of the current supplied to each column wire to become constant.

23. The method according to claim 22, wherein said current-value determining step comprises a step of outputting the current value, which has been determined on the basis of the electron-beam demand value, as a voltage signal that has been amplitude-modulated or pulse-width modulated; and said current applying step comprises a step of converting a voltage signal to a current signal.

24. The method according to claim 22, wherein said current-value determining step comprises:

an element-current determining step of determining an element current, which is to be passed through a cold cathode element connected to the selected row wire to which the first voltage V1 is applied, on the basis of the externally entered electron-beam demand value and an output characteristic of the cold cathode element; and a correcting step of correcting the element current determined in said electron-element current determining step.

25. The method according to claim 24, wherein said correcting step includes a leakage-current determining step of determining a leakage current passed through the unselected row wires of said m-number of row wires to which the second voltage is applied while the first voltage is being applied to the selected row wire and an adding step of adding an output value from said element-current determining step and an output value obtained from said leakage current determining step.

26. The method according to claim 25, wherein said leakage-current determining step includes a current measuring step of measuring current which flows through a column wire when the second voltage has been applied to a row wire.

27. The method according to claim 25, wherein said leakage-current determining step comprises a step of reading data out of a memory in which leakage currents found in advance by measurement or calculation are stored.

28. The method according to claim 22, wherein image data is used as the externally entered electron-beam demand value.

29. A method according to claim 22, wherein the second voltage is a ground level.

30. An electron-beam generating device comprising:

a plurality of electron emission elements arrayed in the form of rows and columns;

m-number of row wires and n-number of column wires for wiring said plurality of electron emission elements into a matrix;

a current source for supplying a predetermined current to the column wires;

a first voltage source for applying a first voltage to a selected row wire of the m-number of row wires; and a second voltage source for applying a second voltage different from the first voltage to unselected row wires of the m-number of row wires, while the first voltage is being applied to the selected row wire, wherein the second voltage applied to the unselected row wires causes a leakage current of the current supplied to each column wire to become constant.

31. A device according to claim 30, wherein the second voltage is a ground level.

32. An electron-beam generating device comprising:

a plurality of electron emission elements arrayed in the form of rows and columns;

m-number of row wires and n-number of column wires for wiring said plurality of electron emission elements into a matrix;

a first current source for supplying a predetermined current to the column wires; and a voltage source for applying voltage to the row wires, wherein the m-number of row wires include a selected row wire to which a first voltage is applied and unselected row wires of said m-number of row wires to which a second voltage different from the first voltage is applied by said voltage source while the first voltage is being applied to the selected row wire, wherein the second voltage applied to the unselected row wires causes a leakage current of the current supplied to each column wire to become constant.

33. A device according to claim 32, wherein the second voltage is a ground level.

34. An electron-beam generating device comprising:

a plurality of electron emission elements arrayed in the form of rows and columns; and m-number of row wires and n-number of column wires for wiring said plurality of electron emission elements into a matrix, wherein a predetermined current is applied to the column wires, and the m-number of row wires include a selected row wire to which a first voltage is applied and unselected row wires of said m-number of row wires to which a second voltage different from the first voltage is applied while the first voltage is being applied to the selected row wire, and the second voltage is applied to the unselected row wires so that a current being caused to flow through the unselected row wires of the predetermined current is controlled, wherein the second voltage applied to the unselected row wires causes a leakage current of the current supplied to each column wire to become constant.

35. A device according to claim 34, wherein the second voltage is a ground level.

36. An electron-beam generating device comprising:

a plurality of electron emission elements arrayed in the form of rows and columns; and m-number of row wires and n-number of column wires for wiring said plurality of electron emission elements into a matrix, wherein a predetermined current is applied to the column wires, and the m-number of row wires include a selected row wire to which a first voltage is applied and unselected row wires of said m-number of row wires to which a second voltage different from the first voltage is applied while the first voltage is being applied to the selected row wire, and the second voltage is applied to the unselected row wires so that unnecessary emission of electrons from the electron emission elements connected to the unselected row wires is prevented, wherein the second voltage applied to the unselected row wires causes a leakage current of the current supplied to each column wire to become constant.

37. A device according to claim 36, wherein the second voltage is a ground level.

38. An image forming apparatus comprising:

an electron-beam generating device having:

a plurality of electron emission elements arrayed in the form of rows and columns;

m-number of row wires and n-number of column wires that wire said plurality of electron emission elements into a matrix;

a current source for supplying a predetermined current to the column wires;

a first voltage source for applying a first voltage to a selected row wire of the m-number of row wires; and a second voltage source for applying a second voltage different from the first voltage to unselected row wires of said m-number of row wires of the m-number of row wires while the first voltage is being applied to the selected row wire; and an image forming member for forming an image by irradiation with an electron beam outputted by said electron-beam generating device, wherein the second voltage applied to the unselected row wires causes a leakage current of the current supplied to each column wire to become constant.

39. An apparatus according to claim 38, wherein the second voltage is a ground level.

40. An image forming apparatus comprising:

an electron-beam generating device having:

a plurality of electron emission elements arrayed in the form of rows and columns;

m-number of row wires and n-number of column wires for wiring said plurality of electron emission elements into a matrix;

a first current source for supplying a predetermined current to the column wires; and a voltage source for applying voltage to the row wires, wherein the m-number of row wires include a selected row wire to which a first voltage is applied and unselected row wires of said m-number of row wires to which a second voltage being different from the first voltage is applied by said voltage source while the first voltage is being applied to the selected row wire; and an image forming member for forming an image by irradiation with an electron beam outputted by said electron-beam generating device, wherein the second voltage applied to the unselected row wires causes a leakage current of the current supplied to each column wire to become constant.

41. An apparatus according to claim 40, wherein the second voltage is a ground level.

42. An image forming apparatus comprising:

an electron-beam generating device having:

a plurality of electron emission elements arrayed in the form of rows and columns; and m-number of row wires and n-number of column wires for wiring said plurality of electron emission elements into a matrix, wherein a predetermined current is applied to the column wires, and the number of row wires include a selected row wire to which a first voltage is applied and unselected row wires of said m-number of row wires row wires to which a second voltage different from the first voltage is applied, and the second voltage is applied to the unselected row wires while the first voltage is being applied to the selected row wire so that a current being flowed to the unselected row wires of the predetermined current is controlled; and an image forming member for forming an image by irradiation with an electron beam outputted by said electron-beam generating device, wherein the second voltage applied to the unselected row wires causes a leakage current of the current supplied to each column wire to become constant.

43. An apparatus according to claim 42, wherein the second voltage is a ground level.

44. An image forming apparatus comprising:

an electron-beam generating device having:

a plurality of electron emission elements arrayed in the form of rows and columns: and m-number of row wires and n-number of column wires for wiring said plurality of electron emission elements into a matrix, wherein a predetermined current is applied to the column wires, and the m-number of row wires include a selected row wire to which a first voltage is applied and unselected row wires of said m-number of row wires to which a second voltage different from the first voltage is applied while the first voltage is being applied to the selected row wire, and the second voltage is applied to the unselected row wires so that unnecessary emission of electrons from the electron emission elements connected to the unselected row wires is prevented; and an image forming member for forming an image by irradiation with an electron beam outputted by said electron-beam generating device, wherein the second voltage applied to the unselected row wires causes a leakage current of the current supplied to each column wire to become constant.

45. An apparatus according to claim 44, wherein the second voltage is a ground level.

46. A driving method of driving an electron-beam generating device which comprises a plurality of electron emission elements arrayed in the form of rows and columns and m-number of row wires and n-number of column wires that wire the plurality of electron emission elements into a matrix, the method comprising the steps of:

applying a first voltage to a selected row wire of the m-number of row wires, and applying a second voltage different from the first voltage to unselected row wires of said m-number of row wires of the m-number of row wires by a voltage source while the first voltage is being applied to the selected row wire; and supplying a predetermined current to the column wires, wherein the second voltage applied to the unselected row wires causes a leakage current of the current supplied to each column wire to become constant.

47. A method according to claim 46, wherein the second voltage is a ground level.

48. A driving method of driving an electron-beam generating device which comprises a plurality of electron emission elements arrayed in the form of rows and columns and m-number of row wires and n-number of column wires that wire the plurality of electron emission elements into a matrix, the method comprising the steps of:

applying a first voltage to a selected row wire of the m-number of row wires and a second voltage different from the first voltage to unselected row wires of said m-number of row wires of the m-number of row wires while the first voltage is being applied to the selected row wire; and supplying a predetermined current to the column wires, wherein the second voltage is applied to the unselected row wires so that a current being caused to flow through the unselected row wires of the predetermined current is controlled, and wherein the second voltage applied to the unselected row wires causes a leakage current of the current supplied to each column wire to become constant.

49. A method according to claim 48, wherein the second voltage is a ground level.

50. A driving method of driving an electron-beam generating device which comprises a plurality of electron emission elements arrayed in the form of rows and columns and m-number of row wires and n-number of column wires that wire the plurality of electron emission elements into a matrix, the method comprising the steps of:

applying a first voltage to a selected row wire of the m-number of row wires and a second voltage different from the first voltage to unselected row wires of said m-number of row wires of the m-number of row wires while the first voltage is being applied to the selected row wire; and supplying a predetermined current to the column wires, wherein the second voltage is applied to the unselected row wires so that unnecessary emission of electrons from the electron emission elements connected to the unselected row wires is prevented, and wherein the second voltage applied to the unselected row wires causes a leakage current of the current supplied to each column wire to become constant.

51. A method according to claim 50, wherein the second voltage is a ground level.

52. An electron-beam generating device, comprising:

a plurality of electron emission devices arrayed in a form of rows and columns;

m-number of row wires and n-number of column wires for wiring the plurality of the electron emission devices into a matrix;

a current source for supplying a predetermined current to the column wires; and a driving circuit for applying a voltage to the row wires, wherein said driving circuit applies a first voltage to a selected row wire of the plurality of row wires and a second voltage different form the first voltage to the unselected row wires of said m-number of row wires of the plurality of row wires while the first voltage is being applied to the selected row wire, and wherein the second voltage applied to the unselected row wires causes a leakage current of the current supplied to each column wire to become constant.

53. An electron-beam generating device according to claim 52, wherein the second voltage is a ground level.

54. An image forming apparatus, comprising:

an electron-beam generating device including:

a plurality of electron emission devices arrayed in a form of rows and columns, m-number of row wires and n-number of column wires for wiring the plurality of the electron emission devices into a matrix;

a current source for supplying a predetermined current to the column wires; and a driving circuit for applying a voltage to the row wires, wherein said driving circuit applies a first voltage to a selected row wire of the plurality of row wires and a second voltage different form the first voltage to the unselected row wires of said m-number of row wires row wires of the plurality of row wires while the first voltage is being applied to the selected row wire; and an image forming member for forming an image based upon irradiation of electron beams from the electron-beam generating device, wherein the second voltage applied to the unselected row wires causes a leakage current of the current supplied to each column wire to become constant.

55. An electron-beam generating apparatus having a plurality of cold cathode devices arranged in a matrix on a substrate, m-number of row wires and n-number of column wires for wiring the plurality of cold cathode devices into the matrix and drive signal generating means for generating a signal for driving the plurality of cold cathode devices in a row unit, said drive signal generating means comprising:

current value determination means for determining a current value to be flowed in each of the n-number of column wires based on a demand value of electron beam input from an exterior;

current supplying means for supplying the current value determined by said current value determination means to the each of the n-number of column wires; and voltage application means for applying a voltage V1 to a selected row wire of the m-number of row wires and a voltage V2 to all remaining row wires;

wherein the voltage V1 is different from the voltage V2, and a leak current of the current flowing by said current supplying means in each of the n-number of column wires becomes constant by application of the voltage V2, such that a current value flowing in a desired cold cathode device becomes constant.

56. An apparatus according to claim 55, wherein said current value determination means outputs an amplitude modulated or pulse width modulated voltage signal in correspondence to the current value determined by the demand value, said current supplying means includes a voltage-current conversion circuit.

57. An apparatus according to claim 56, wherein said voltage-current conversion circuit includes transistors, operational amplifiers and resistors.

58. An apparatus according to claim 51, wherein said reactive current determination means comprising:

means for applying the voltage V2 to row wires; and current measurement means for measuring a current flowing through each of the column wires.

59. An apparatus according to claim 57, wherein said reactive current determination means has a memory for storing a reactive current value obtained by measurement or calculation, in advance.

60. An apparatus according to claim 55, wherein the demand value of electron beam input from the exterior includes image data.

61. An apparatus according to claim 55, wherein the cold cathode devices are surface conduction electron emission devices.

62. An image forming apparatus having an electron-beam generating apparatus and an image forming material for forming an image by irradiation of electron-beams emitted from the electron-beam generating apparatus, wherein said electron-beam generating apparatus is an apparatus according to claim 55.

63. An apparatus according to claim 62, wherein said image forming material includes phosphors.

64. An electron-beam generating apparatus having a plurality of cold cathode devices arranged in a matrix on a substrate, m-number of row wires and n-number of column wires for wiring the plurality of cold cathode devices into the matrix and drive signal generating means for generating a signal for driving the plurality of cold cathode devices in a row unit, said drive signal generating means comprising:

current value determination means for determining a current value flowing in each of the n-number of column wires based on a demand value of electron beam input from an exterior;

current supplying means for supplying the current value determined by said current value determination means to each of the n-number of column wires; and voltage application means for applying a voltage V1 to a selected row wire of the m-number of row wires and a voltage V2 to all remaining row wires;

wherein the voltage V1 is different from the voltage V2, and said current value determination means comprises:

device current determination means for determining a device current value to be flowed in each of cold cathode devices connected to a row wire to which the voltage V1 is applied, based on the demand value of electron beam input from the exterior and an output characteristic of each of the cold cathode devices, and correction means for correcting the device current value determined by said device current determination means;

wherein said correction means comprises:

reactive current determination means for determining a reactive current value flowing in a row wire to which the voltage V2 is applied, and addition means for adding a value determined by said device current determination means to a value determined by said reactive current determination means, and wherein said correction means corrects the device current value based on a result added by said addition means.

65. An electron-beam generating apparatus having a plurality of cold cathode devices arranged in a matrix on a substrate, m-number of row wires and n-number of column wires for wiring the plurality of cold cathode devices into the matrix and drive signal generating means for generating a signal for driving the plurality of cold cathode devices in a row unit, said drive signal generating means comprising:

current value determination means for determining a current value flowing in each of the n-number of column wires based on a demand value of electron beam input from an exterior;

current supplying means for supplying the current value determined by said current value determination means to each of the n-number of column wires; and voltage application means for applying a voltage V1 to a selected row wire of the m-number of row wires and a voltage V2 to all remaining row wires;

wherein the voltage V1 is different from the voltage V2, and said current value determination means comprises:

device current determination means for determining a device current value to be flowed in each of cold cathode devices connected to a row wire to which the voltage V1 is applied, based on the demand value of electron beam input from the exterior and an output characteristic of each of the cold cathode devices;

correction means for correcting the device current value determined by said device current determination means; and wherein said correction means includes:

wire potential measurement means for measuring a potential of a wire of the row and column wires; and means for determining a correction value for correcting the device current based on a result measured by said wire potential measurement means.

66. A method of driving an electron-beam generating apparatus having a plurality of cold cathode devices arranged in a matrix on a substrate, m-number of row wires and n-number of column wires for wiring the plurality of cold cathode devices into the matrix and drive signal generating means for generating a signal for driving the plurality of cold cathode devices in a row unit, the method comprising:

a current value determination step of determining a current value to be flowed in each of the n-number of column wires based on a demand value of electron beam input from an exterior;

a current supplying step of supplying the current value determined in said current value determination step to each of the n-number of column wires; and a voltage application step of applying a voltage V1 to a selected row wire of the m-number of row wires and a voltage V2 different form the voltage V1 to all remaining row wires, in synchronism with said current supplying step, wherein a leak current of the current flowing in said current supplying step in each of the n-number of column wires becomes constant by application of the voltage V2, such that a current value flowing in a desired cold cathode device becomes constant.

67. A method according to claim 66, wherein in said current value determination step, an amplitude modulated or pulse width modulated voltage signal is outputted in correspondence to the current value determined by the demand value, the amplitude modulated or pulse modulated voltage signal is converted into a current signal.

68. A method according to claim 66, wherein the demand value of electron beam input from the exterior includes image data.

69. A method for driving an image forming apparatus having an electron-beam generating apparatus and an image forming material for forming an image by irradiation of electron-beams emitted from the electron-beam generating apparatus, wherein said electron-beam generating apparatus is driven by the method according to claim 66.

70. A method of driving an electron-beam generating apparatus having a plurality of cold cathode devices arranged in a matrix on a substrate, m-number of row wires and n-number of column wires for wiring the plurality of cold cathode devices into the matrix and drive signal generating means for generating a signal for driving the plurality of cold cathode devices in a row unit, the method comprising:

a current value determination step of determining a current value to be flowed in each of the n-number of column wires based on a demand value of electron beam input from an exterior;

a current supplying step of supplying the current value determined in said current value determination step to the each of the n-number of column wires; and a voltage application step of applying a voltage V1 to a selected row wire of the m-number of row wires and a voltage V2 different form the voltage V1 to all remaining row wires, in synchronism with said current supplying step;

wherein said current value determination step includes:

a device current determination step of determining a device current value to be flowed in each of cold cathode devices connected to a row wire to which the voltage V1 is applied, based on the demand value of electron beam input from the exterior and an output characteristic of each of the cold cathode devices; and a correction step of correcting the device current value determined by said device current determination means;

wherein said correction step comprises a reactive current determination step for determining a reactive current value flowing in a row wire to which the voltage V2 is applied, and wherein a value determined in said device current determination step is added to a value determined in said reactive current determination step, and the device current value is corrected based on a result of addition.

71. A method according to claim 70, wherein said reactive current determination step comprises a current measurement step of measuring a current flowing through each of the column wires when the voltage V2 is applied to row wires.

72. A method according to claim 70, wherein said reactive current determination step comprises a step of reading out data from a memory which in advance stores a reactive current value obtained by measurement or calculation.

73. A driving method for driving an electron-beam generating apparatus having a plurality of cold cathode devices arranged in a matrix on a substrate, m-number of row wires and n-number of column wires for wiring the plurality of cold cathode devices into the matrix and drive signal generating means for generating a signal for driving the plurality of cold cathode devices in a row unit, the method comprising:

a current value determination step of determining a current value flowing in each of the n-number of column wires based on a demand value of electron beam input from an exterior;

a current supplying step of supplying the current value determined in said current value determination step to each of the n-number of column wires; and a voltage application step of applying a voltage V1 to a selected row wire of the m-number of row wires and a voltage V2 to all remaining row wires;

wherein said current value determination step comprises:

a device current determination step of determining a device current value to be flowed in each of cold cathode devices connected to a row wire to which the voltage V1 is applied, based on the demand value of electron beam input from the exterior and an output characteristic of each of the cold cathode devices, a wire potential measurement step of measuring a potential of each of the column wires, and a step of determining a correction value for correcting the device current based on a result measured at said wire potential measurement step.

* * * * *

UNITED STATES PATENT AND TRADEMARK OFFICE

CERTIFICATE OF CORRECTION

PATENT NO. : 6,445,367 B1 
DATED : September 3, 2002
INVENTOR(S) : Noritake Suzuki et al.

It is certified that error appears in the above-identified patent and that said Letters Patent is hereby corrected as shown below:

Title page, Item [54] and Column 1, line 2,
Title, "PLURALITY" should read -- A PLURALITY --.

Title page,
Item [56], References Cited, FOREIGN PATENT DOCUMENTS,
"01031332 should read -- 01-031332
02257551 02-257551
03055738 03-055738
04028137" 04-028137 --; and
OTHER PUBLICATIONS, "Leti"' " should read -- Leti" --.

Column 1,
Line 38, "C.C." should read -- C. --.

Column 3,
Line 15, "with." should read -- with --.

Column 4,
Line 38, "the-luminance" should read -- the luminance --.

Column 6,
Line 16, "equation" should read -- equations --;
Line 35, "controlled, constant current" should read -- controlled constant-current --;
Line 38, "controlled" should read -- controlled, --; and
Line 57, "the" should be deleted.

Column 8,
Line 53, "particularly," should read -- particular, --.

Column 10,
Line 31, "in" should read -- in a --.

Column 11,
Lines 25 and 27, "element" should read -- element; --; and

UNITED STATES PATENT AND TRADEMARK OFFICE

CERTIFICATE OF CORRECTION

PATENT NO. : 6,445,367 B1
DATED : September 3, 2002
INVENTOR(S) : Noritake Suzuki et al.

It is certified that error appears in the above-identified patent and that said Letters Patent is hereby corrected as shown below:

Column 12,
Line 57, "52A," should read -- 52A and --; and
Line 59, "55A," should read -- 55A and --.

Column 14,
Line 47, "of a of" should read -- of --.

Column 22,
Line 8, "1102," should read -- 1102 and --.

Column 25,
Line 2, "matrix > Described" should read -- matrix) ¶ Described --; and
Line 52, "which" should read -- which is --.

Column 26,
Line 36, "applicable" (first occurrence) should read -- application --;
Line 44, "$Dy_n$" should read -- $D_{yn}$ --; and
Line 52, "$D_{xm}$" should read -- $D_{xm}$. --.

Column 28,
Line 62, "through" should read -- through the --; and
Line 63, "embodiments." should read -- embodiment. --.

Column 31,
Lines 23 and 34, "(K = M)" should read -- ($K \neq M$) --; and
Line 53, "essential" should read -- essentially --.

Column 32,
Line 14, "((M,N)," should read -- (M,N), --.

Column 33,
Line 64, "$\eta'(M,N)$" should read -- $\eta(M,N)$ --.

UNITED STATES PATENT AND TRADEMARK OFFICE

CERTIFICATE OF CORRECTION

PATENT NO. : 6,445,367 B1
DATED : September 3, 2002
INVENTOR(S) : Noritake Suzuki et al.

It is certified that error appears in the above-identified patent and that said Letters Patent is hereby corrected as shown below:

Column 38,
Line 33, "one to" should read -- one --.

Column 41,
Line 28, "is," should read -- is --; and
Line 29, "the:" should read -- the --.

Column 43,
Line 4, "interrelated-in" should read -- interrelated in --; and
Lines 34, 37 and 49, "($K \approx M$)" should read -- ($K \neq M$) --;

Column 47,
Line 33, "is" should read -- in --.

Column 48,
Line 42, "0.6μWA." should read -- 0.6μA.--.

Column 49,
Line 17, ",of" should read -- of --;
Line 22, "constants," should read -- constant, --;
Line 39, "signal;" should read -- signal, --;
Line 63, "V(Dy11)" should read -- V(Dy1) --; and
Line 67, "if:eff(1,1)." should read -- If:eff(1,1). --.

Column 52,
Line 51, "the-display" should read -- the display --.

Column 53,
Line 51, "signal, generation" should read -- signal generating --; and
Line 56, "value," should read -- value; --.

Column 54,
Line 34, "includes" should read -- includes: --;
Lines 47 and 58, "apparatus of" should read -- device according to --; and
Line 66, "apparatus" should read -- device --.

UNITED STATES PATENT AND TRADEMARK OFFICE

CERTIFICATE OF CORRECTION

PATENT NO. : 6,445,367 B1
255DATED : September 3, 2002
INVENTOR(S) : Noritake Suzuki et al.

It is certified that error appears in the above-identified patent and that said Letters Patent is hereby corrected as shown below:

Column 55,
Line 4, "apparatus" should read -- device -- and "14" should read -- 10 --;
Line 11, "apparatus" should read -- device --;
Line 36, "and" should be deleted;
Line 51, "apparats" should read -- apparatus --; and
Line 57, "modulated-or pulse-width." should read -- modulated or pulse-width --.

Column 56,
Line 54, "leakage current" should read -- leakage-current --.

Column 57,
Line 37, "wire," should read -- wire, and --; and
Line 58, "controlled," should read -- controlled, and --.

Column 58,
Line 12, "prevented," should read -- prevented, and --.

Column 60,
Line 60, "form" should read -- from --.

Column 61,
Line 5, "columns," should read -- columns; --;
Line 14, "form" should read -- from --;
Line 16, "row wires" (first occurrence) should be deleted;
Line 40, "wires;" should read -- wires, --;
Line 56, "51," should read -- 57, --; and
Line 57, "comprising:" should read -- comprises: --.

Column 62,
Line 27, "wires;" should read -- wires, --;
Line 35, "devices," should read -- devices; --;
Line 39, "means;" should read -- means, --;
Line 43, "applied," should read -- applied; --; and
Line 67, "wires;" should read -- wires, --.

UNITED STATES PATENT AND TRADEMARK OFFICE

CERTIFICATE OF CORRECTION

PATENT NO. : 6,445,367 B1
DATED : September 3, 2002
INVENTOR(S) : Noritake Suzuki et al.

It is certified that error appears in the above-identified patent and that said Letters Patent is hereby corrected as shown below:

Column 63,
Line 7, "devices;" should read -- devices; and --;
Line 10, "means; and" should read -- means, --; and
Line 33, "form" should read -- from --.

Column 64,
Line 6, "form" should read -- from --;
Line 8, "steps;" should read -- step, --;
Line 19, "means;" should read -- means, --;
Line 52, "wires;" should read -- wires, --;
Line 60, "devices," should read -- devices; -- and
Line 62, "wires," should read -- wires; --.

Signed and Sealed this

Eighteenth Day of November, 2003

JAMES E. ROGAN
*Director of the United States Patent and Trademark Office*